US011369243B2

(12) United States Patent
Zhong et al.

(10) Patent No.: US 11,369,243 B2
(45) Date of Patent: Jun. 28, 2022

(54) DUST BIN, VACUUM CLEANER COMBINATION AND STICK VACUUM CLEANER

(71) Applicant: Positec Power Tools (Suzhou) Co., Ltd, Suzhou (CN)

(72) Inventors: Hongfeng Zhong, Jiangsu (CN); Jingtao Xu, Jiangsu (CN); Shisong Zhang, Jiangsu (CN); Binbin Xu, Jiangsu (CN); Xiaoli Pang, Jiangsu (CN); Hongbing Wu, Jiangsu (CN); Guojun Chen, Jiangsu (CN); Xianghua Meng, Jiangsu (CN); Zhen Zhang, Jiangsu (CN)

(73) Assignee: Positec Power Tools (Suzhou) Co., Ltd., Suzhou (CN)

( * ) Notice: Subject to any disclaimer, the term of this patent is extended or adjusted under 35 U.S.C. 154(b) by 156 days.

(21) Appl. No.: 16/728,748

(22) Filed: Dec. 27, 2019

(65) Prior Publication Data

US 2020/0129025 A1 Apr. 30, 2020

Related U.S. Application Data

(63) Continuation of application No. PCT/CN2018/093478, filed on Jun. 28, 2018.

(30) Foreign Application Priority Data

Jun. 28, 2017 (CN) ..... 201710508580.9
Feb. 28, 2018 (CN) ..... 201810168406.9
(Continued)

(51) Int. Cl.
*A47L 9/16* (2006.01)
*A47L 5/22* (2006.01)
(Continued)

(52) U.S. Cl.
CPC ..... *A47L 9/1683* (2013.01); *A47L 5/225* (2013.01); *A47L 5/24* (2013.01); *A47L 5/28* (2013.01);
(Continued)

(58) Field of Classification Search
CPC ..... A47L 9/108; A47L 9/1683; A47L 5/225; A47L 5/24; A47L 5/28; A47L 5/362;
(Continued)

(56) References Cited

U.S. PATENT DOCUMENTS 3,618,297 A 11/1971 Hamrick
4,953,255 A * 9/1990 Jenkins ..... A47L 5/365 15/327.2
(Continued)

FOREIGN PATENT DOCUMENTS

CN 1462603 A 12/2003
CN 2822497 Y 10/2006
(Continued)

OTHER PUBLICATIONS https://instrumentationtools.com/float-operated-level-switches-working-principle/, Float Level Switch Working Principle, Mar. 19, 2016 (Year: 2016).*

*Primary Examiner* — David Redding
(74) *Attorney, Agent, or Firm* — Dentons US LLP

(57) ABSTRACT

A dust bin and a vacuum cleaner combination provided with the dust bin are provided. The dust bin includes a dust chamber, a dust inlet detachably connected to a dust suction apparatus, and a sealing structure for implementing the sealing between the dust suction apparatus and the dust bin. The dust suction apparatus has a dust outlet joined to the dust inlet. The vacuum cleaner combination includes a dust suction apparatus and a dust bin detachably connected to the dust suction apparatus. The dust suction apparatus has a
(Continued)

housing and a dust cup assembly connected to the housing. The dust cup assembly includes a cup body and a filter apparatus disposed in the cup body. Compared with the prior art, in the present invention, a detachable multi-purpose dust bin with a simple structure is disposed, so that the dust collection chamber of the vacuum cleaner is flexibly increased.

12 Claims, 68 Drawing Sheets

(30) Foreign Application Priority Data

Jun. 25, 2018 (CN) ..... 201820984123.7
Jun. 25, 2018 (CN) ..... 201820984124.1

(51) Int. Cl.

| | |
|---|---|
| ***A47L 5/28*** | (2006.01) |
| ***A47L 9/14*** | (2006.01) |
| ***A47L 9/19*** | (2006.01) |
| ***A47L 9/24*** | (2006.01) |
| ***A47L 9/28*** | (2006.01) |
| ***A47L 9/32*** | (2006.01) |
| ***A47L 9/10*** | (2006.01) |
| ***A47L 5/24*** | (2006.01) |
| ***A47L 5/36*** | (2006.01) |
| ***A47L 9/02*** | (2006.01) |
| ***A47L 9/12*** | (2006.01) |

(52) U.S. Cl.

CPC ..... *A47L 5/362* (2013.01); *A47L 9/02* (2013.01); *A47L 9/106* (2013.01); *A47L 9/127* (2013.01); *A47L 9/1409* (2013.01); *A47L 9/165* (2013.01); *A47L 9/1608* (2013.01); *A47L 9/1658* (2013.01); *A47L 9/1666* (2013.01); *A47L 9/1691* (2013.01); *A47L 9/19* (2013.01); *A47L 9/242* (2013.01); *A47L 9/2805* (2013.01); *A47L 9/2842* (2013.01); *A47L 9/2894* (2013.01); *A47L 9/322* (2013.01)

(58) Field of Classification Search

CPC . A47L 9/02; A47L 9/106; A47L 9/127; A47L 9/1409; A47L 9/1608; A47L 9/165; A47L 9/1658; A47L 9/1666; A47L 9/1691; A47L 9/19; A47L 9/242; A47L 9/2805; A47L 9/2842; A47L 9/2894; A47L 9/322; A47L 9/122; A47L 5/00; A47L 5/22; A47L 9/00; A47L 9/10; A47L 9/16; A47L 9/1616; A47L 9/244; A47L 9/28

See application file for complete search history.

(56) References Cited

U.S. PATENT DOCUMENTS

| | | | | |
|---|---|---|---|---|
| 5,388,301 | A | 2/1995 | Bosyj et al. | |
| 5,920,955 | A * | 7/1999 | Berfield ..... | A47L 7/0042 15/352 |
| 8,074,321 | B2 | 12/2011 | Fry et al. | |
| 2006/0191099 | A1 | 8/2006 | Fry et al. | |
| 2012/0079671 | A1 | 4/2012 | Stickney et al. | |
| 2012/0260454 | A1 | 10/2012 | Lester | |

FOREIGN PATENT DOCUMENTS

| | | | |
|---|---|---|---|
| CN | 101128145 | A | 2/2008 |
| CN | 101143635 | A | 3/2008 |
| CN | 101437435 | A | 5/2009 |
| CN | 102133070 | A | 7/2011 |
| CN | 203776827 | U | 8/2014 |
| CN | 205107554 | U | 3/2016 |
| CN | 206687664 | U | 12/2017 |
| GB | 2474176 | A | 6/2011 |
| WO | 2000054644 | A1 | 9/2000 |
| WO | 01006189 | A1 | 1/2001 |

* cited by examiner

DUST BIN, VACUUM CLEANER COMBINATION AND STICK VACUUM CLEANER

This application is a continuation of International Application No. PCT/CN2018/093478 filed on Jun. 28, 2018, which claims priority under 35 U.S.C. 119(e) to Chinese Application Nos. 201710508580.9, filed Jun. 28, 2017, 201810168406.9, filed on Feb. 28, 2018, 201820984123.7, filed on Jun. 25, 2018, and 201820984124.1, filed on Jun. 25, 2018, which are hereby incorporated by reference in their entirety as if fully set forth herein.

BACKGROUND

Technical Field

The present invention relates to the field of cleaning technologies, and in particular, to a dust bin, a vacuum cleaner combination provided with the dust bin, and a stick vacuum cleaner provided with the vacuum cleaner combination.

Related Art

In the prior art, there are usually lots of garbage such as sawdust and sewage with garbage in an environment such as a garage. A common vacuum cleaner has only a dust collection space of a dust bag or dust cup. The space is soon filled with garbage when there is plenty, and needs to be repeatedly emptied. In addition, as more garbage is collected, the efficiency of separation is reduced.

Therefore, for the problems in the prior art, it is necessary to provide a flexibly disposed dust bin capable of increasing a dust collection space, a vacuum cleaner combination provided with the dust bin, and a stick vacuum cleaner provided with the vacuum cleaner combination.

SUMMARY

The present invention provides a flexibly disposed dust bin capable of increasing a dust collection space, a vacuum cleaner combination provided with the dust bin, and a stick vacuum cleaner provided with the vacuum cleaner combination. The dust bin has a simple structure and can be used by users more conveniently.

To achieve the foregoing objectives, a technical solution of the present invention is:

A dust bin, joined to a dust suction apparatus, the dust suction apparatus comprising a housing and a dust cup assembly connected to the housing, and the dust cup assembly comprising a cup body, wherein the dust bin comprises a dust chamber and a dust inlet in communication with the dust chamber, and the cup body is joined to the dust inlet.

Preferably, the dust bin comprises a base portion and a top portion that is combined with the base portion, and the dust inlet is located at the top portion.

Preferably, the base portion is provided with transparent window.

Preferably, the base portion comprises a main joint portion, the top portion has a first joint portion that is combined with the main joint portion and a second joint portion located opposite the first joint portion, there is a first combination mode for the base portion and the top portion, and the main joint portion is joined to the first joint portion in the first combination mode.

Preferably, a circumferential sealing ring is disposed in a circumferential direction in which the main joint portion is joined to the first joint portion.

Preferably, there is a second combination mode for the base portion and the top portion, and the main joint portion is joined to the second joint portion in the second combination mode.

Preferably, the base portion has a first buckling portion, the top portion has a second buckling portion, the second buckling portion has a first buckling surface and a second buckling surface that are disposed opposite each other, the first buckling portion is buckled with the first buckling surface in the first combination mode, and the first buckling portion is buckled with the second buckling surface in the second combination mode.

Preferably, the distance between the first buckling surface and the first joint portion is equal to the distance between the second buckling surface and the second joint portion.

Preferably, the dust bin comprises a float member, and the float member is floatingly disposed in the dust chamber.

Preferably, the dust bin is provided with a limiting member, and the float member cooperates with the limiting member and is movable relative to the limiting member.

Preferably, the dust bin comprises a base portion and a top portion detachably mounted on the base portion, the float member is disposed in the base portion, the top portion further comprises a middle member that is combined with the float member when the float member reaches a preset level, and the middle member is provided with a sensing element.

Preferably, a sensing element is disposed on the float member.

To achieve the foregoing objectives, another technical solution adopted by the present invention is:

A vacuum cleaner combination, comprising a dust suction apparatus, the dust suction apparatus having a housing and a dust cup assembly connected to the housing, and the dust cup assembly comprising a cup body, wherein the vacuum cleaner combination further comprises the above-mentioned dust bin that is joined to the dust suction apparatus.

Preferably, the cup body has a dust outlet, and the dust outlet is airtightly joined to the dust inlet.

Preferably, a first sealing member is disposed between the dust outlet and the dust inlet.

Preferably, the dust outlet is cylindrical, the size of the dust inlet is greater than the size of the dust outlet, and the first sealing member is located between the dust outlet and the dust inlet.

Preferably, the dust cup has a dust cup cover for sealing the dust outlet and a second sealing member that implements mutual sealing between the dust outlet and the dust cup cover, and the first sealing member circumferentially surrounds the second sealing member and the dust cup cover.

Preferably, the dust bin has an abutting portion for controlling the dust cup cover to automatically open, and the abutting portion is located in the first sealing member.

Preferably, the dust suction apparatus has a latching portion for controlling the dust cup cover to open or close, the abutting portion has a first position, and the abutting portion abuts against and is combined with the latching portion to control the dust cup cover to open when the abutting portion is in the first position.

Preferably, a regulator for adjusting the position of the abutting portion is disposed in the dust bin, the abutting portion has a second position, and the abutting portion does not abut against the latching portion and the dust cup cover does not open when the abutting portion is in the second position.

Preferably, the dust suction apparatus is further provided with a rotating portion and a reset structure, the dust cup cover rotates around the rotating portion when the latching portion controls the dust cup cover to open, and the dust cup cover is driven by the reset structure to automatically open outward after the latching portion releases locking.

Preferably, the dust cup cover automatically opens outward at an angle ranging from 110 degrees to 190 degrees.

Preferably, the vacuum cleaner combination is capable of switching between a working mode and a transport/storage mode;

in the working mode, the dust bin is joined to the dust suction apparatus, and the dust chamber of the dust bin is in communication with the cup body for dust collection; and in the transport/storage mode, the dust suction apparatus is accommodated in the dust chamber of the dust bin.

Preferably, the cup body is provided with a dust outlet, and the dust outlet is airtightly joined to the dust inlet in the working mode and the transport/storage mode.

Preferably, the dust cup cover opens in the working mode.

Preferably, the vacuum cleaner combination comprises a float member disposed in the dust bin and a joint member and a control element that are disposed on the dust suction apparatus, and the float member is floatingly disposed in the dust chamber; the joint member and the float member constitute a switch assembly, and the switch assembly is configured to generate a trigger signal when the float member reaches a preset level; and the control element performs a corresponding action according to the trigger signal.

Preferably, one of the float member and the joint member in the switch assembly is a sensing member, and the other is a sensed member; and when the float member reaches the preset level, the sensing member senses the sensed member to generate the trigger signal.

Preferably, one of the joint member and the float member in the switch assembly is a triggering member, and the other is a triggered member; and when the float member reaches the preset level, the triggering member contacts the triggered member to generate the trigger signal.

Preferably, the dust bin comprises a limiting member, and the float member cooperates with the limiting member and is movable relative to the limiting member.

Preferably, the dust suction apparatus has a control element, and according to the trigger signal, the control element sends an alarm signal and/or controls the driving member to stop driving.

Preferably, the vacuum cleaner combination comprises a float member disposed in the dust bin, a switch assembly, and a control element disposed on the dust suction apparatus, the float member is floatingly disposed in the dust chamber, the switch assembly is configured to generate a trigger signal when the float member reaches a preset level, and the control element performs a corresponding action according to the trigger signal.

Preferably, the switch assembly comprises a middle member disposed in the dust bin and a joint member disposed on the dust suction apparatus, the middle member is movably disposed between the float member and the joint member, and the float member drives the middle member to move to make a successful trigger with the joint member when the float member reaches the preset level.

Preferably, one of the middle member and the joint member is a sensing member, and the other is a sensed member; and when the float member reaches the preset level, the float member drives the middle member to rotate to sense or be sensed by the joint member to generate the trigger signal.

Preferably, one of the middle member and the joint member is a triggering member, and the other is a triggered member; and when the float member reaches the preset level, the float member drives the middle member to rotate to contact the joint member to generate the trigger signal.

Preferably, the dust bin comprises a limiting member, and the float member cooperates with the limiting member and is movable relative to the limiting member.

Preferably, the dust suction apparatus has a control element, and according to the trigger signal, the control element sends an alarm signal and/or controls the driving member to stop driving.

Preferably, the dust suction apparatus has a first dust collection capacity, the dust bin has a second dust collection capacity, and a dust collection capacity of the vacuum cleaner combination is the sum of the first dust collection capacity and the second dust collection capacity.

To achieve the foregoing objectives, another technical solution adopted by the present invention is:

A stick vacuum cleaner, comprising a hollow extension pipe and a cleaner head, wherein the stick vacuum cleaner further comprises the above-mentioned vacuum cleaner combination, the dust suction apparatus in the vacuum cleaner combination is detachably connected to the extension pipe, one end of the extension pipe is in communication with the dust suction inlet of the dust suction apparatus, the other end of the extension pipe is in communication with the cleaner head, and the cleaner head is provided with a suction passage in communication with the inside of the extension pipe Compared with the prior art, in the present embodiments, a separate dust bin is provided. The dust bin is disposed to be detachable, has a variety of assembly states and a simple structure, and can be flexibly used, thereby increasing a dust collection chamber of a vacuum cleaner.

BRIEF DESCRIPTION OF THE DRAWINGS

The present invention is further described below with reference to the accompanying drawings and the implementations.

DETAILED DESCRIPTION

Figure 1:
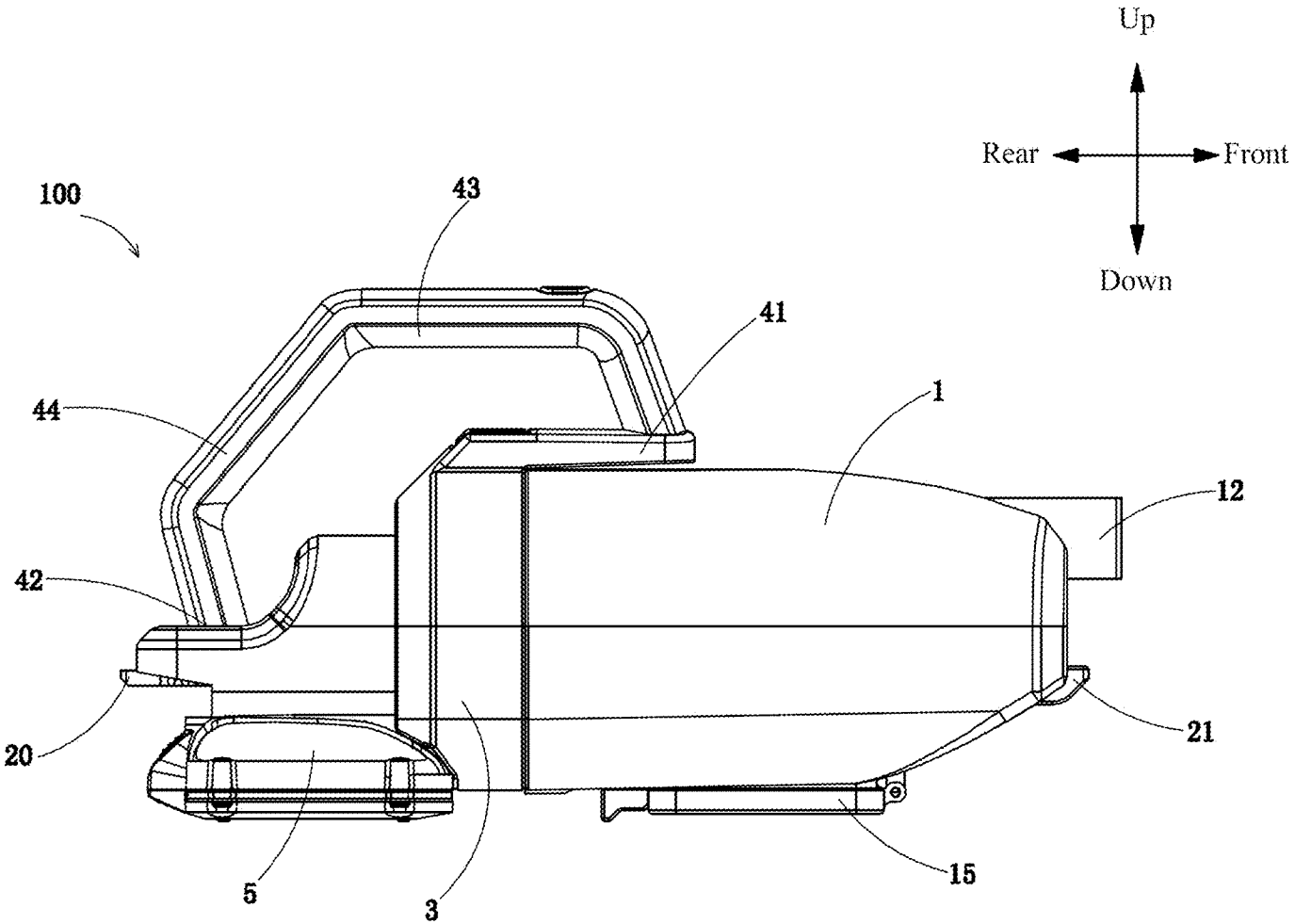
FIG. 1 is a schematic diagram of a handheld vacuum cleaner according to a first embodiment of the present invention.
Figure 2:
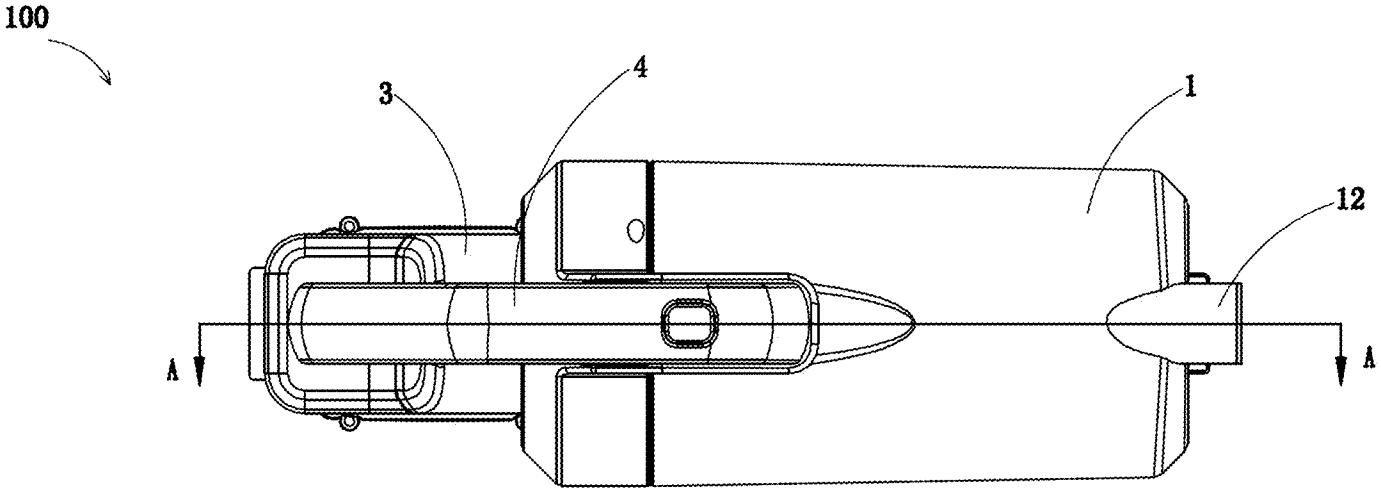
FIG. 2 is a schematic diagram of FIG. 1 from another angle.

A vacuum cleaner combination includes a dust suction apparatus and a dust bin joined to the dust suction apparatus to collect dust from the dust suction apparatus. The vacuum cleaner combination includes a first working mode and a second working mode. In the first working mode, the dust suction apparatus is not joined to the dust bin, and the dust suction apparatus works separately and sucks and collects dust. In the second working mode, the dust suction apparatus is joined to the dust bin, and both the dust bin and a dust cup of the dust suction apparatus collect dust. The dust suction apparatus has a first dust collection capacity. The dust bin has a second dust collection capacity. A dust collection capacity of the vacuum cleaner combination is the sum of the first dust collection capacity and the second dust collection capacity. That is, if the dust collection capacity of the dust suction apparatus is A and the dust collection capacity of the dust bin is B, the dust collection capacity of the vacuum cleaner combination is A+B. The dust bin is disposed, so that the dust collection capacity is increased without adding an additional dust collection channel, mode switching is simple and easy, and it is not necessary to detach the original dust cup.

The dust bin includes a dust chamber and a dust inlet in communication with the dust chamber. In the second working mode, the dust inlet receives garbage passing through the dust suction apparatus. The dust bin is disposed to be detachable from the dust suction apparatus, so that a dust collection chamber of a vacuum cleaner is flexibly increased. The dust bin has a simple structure. After the dust bin is joined to the dust suction apparatus, the structure is compact and occupies a small space, and the cleaning requirements of scenarios with different amounts of garbage can be met. For a scenario with a small amount of dust such as a domestic scenario, the dust suction apparatus may be used alone. The dust suction apparatus may be a handheld vacuum cleaner, a horizontal vacuum cleaner or another vacuum cleaner that is suitable for domestic use and can be joined to the dust bin through structural design. For a scenario with a large amount of dust such as a garage or an outdoor space with a large amount of dust, the dust bin may be used to accommodate dust and garbage, so as to reduce the frequency of dumping garbage by a user. If the dust bin is used in a garage or an outdoor space, rollers may be disposed under the dust bin, so that the user can directly pull the dust bin without lifting the dust bin, thereby enhancing the user experience and facilitate the use of the dust bin.

The dust bin and the dust suction apparatus are disposed in different ways to switch the vacuum cleaner combination between a working mode and a transport/storage mode. In the working mode, the dust bin is joined to the dust suction apparatus, the dust suction apparatus sucks dust, the dust bin collects dust, and garbage sucked in by the dust suction apparatus is collected in the dust chamber through the dust inlet. In the transport/storage mode, the dust suction apparatus is accommodated in the dust chamber of the dust bin.

The dust suction apparatus includes a dust cup assembly and a motor assembly. The motor assembly includes a motor and a fan, and the motor drives the fan to rotate to form a negative pressure in the dust cup assembly. The dust cup assembly includes a cup body, a filter apparatus disposed in the cup body, a dust outlet for emptying debris, and a dust cup cover for sealing the dust outlet. The dust outlet is located opposite and combined with the dust inlet in the second working mode. The dust outlet is located opposite and combined with the dust inlet in the working mode and the transport/storage mode. The dust bin has an abutting portion that controls the dust cup cover to automatically open. The abutting portion is disposed, so that the dust cup cover can automatically open without a separate operation of a user when the dust bin is combined with the dust suction apparatus, thereby improving the use convenience.

In the description of the following embodiments of the present invention, the "dust" refers to different substances in different use scenarios rather than dust in the literal sense. For example, in an indoor domestic scenario, "dust" may be powder, bread crumbs, cookie crumbs, mud, rice grains, clean water spilled on the floor, dirty water or the like. In a garage environment or a scenario with dust in a large area, "dust" may be sawdust, dirt, dirty water or the like. The "dust" represents different substances in different use scenarios, including, but not limited to, the foregoing examples.

To make the objectives, technical solutions, and advantages of the present invention clearer, the present invention is further described in detail below with reference to the accompanying drawings and the embodiments. It should be understood that the specific embodiments described herein are merely used to explain the present invention, but are not intended to limit the present invention. The dust suction apparatus may be a household vacuum cleaner that can be joined to a dust bin through structural design such as a handheld vacuum cleaner and a horizontal vacuum cleaner. The following embodiments are described with a handheld vacuum cleaner as an example, and the description of the embodiments of the handheld vacuum cleaner is also applicable to the horizontal vacuum cleaner and other household vacuum cleaners that can be joined to a dust bin.

As shown in FIG. 1 to FIG. 6, a handheld vacuum cleaner 100 is provided in a first embodiment of the present invention, and a filter apparatus is disposed obliquely in this embodiment. Specifically, the handheld vacuum cleaner 100 includes a dust cup assembly 1, a housing 3 connected to the dust cup assembly 1, a handle assembly 4 disposed on the housing 3 and used for gripping, a battery assembly 5 disposed below the handle assembly 4 and used for supplying electricity to the handheld vacuum cleaner 100, and an air flow generator 6 used for supplying power to the handheld vacuum cleaner 100 and generating a negative pressure for vacuuming. The air flow generator 6 is disposed in the housing 3. The handheld vacuum cleaner 100 has a first positioning buckle 20 and a second positioning buckle 21 that are respectively located at two ends of the handheld vacuum cleaner 100. The battery assembly 4 is disposed below and behind the air flow generator 5. The dust cup assembly 1 may be fastened to the housing 3 by a buckle structure, or an end of the dust cup assembly 1 is disposed to be cylindrical and the dust cup assembly 1 and the housing 3 are provided with rotating threads to fasten the dust cup assembly 1 to the housing 3 by the rotating threads.

As shown in FIG. 1 to FIG. 6, the dust cup assembly 1 has a dust suction inlet 12 for guiding an external air flow into the handheld vacuum cleaner 100, and the dust suction inlet 12 is located on a side of the dust cup assembly 1. The battery assembly 5 and the air flow generator 6 are located on the same side of the dust cup assembly 1 and are opposite the side on which the dust suction inlet 12 is located. The housing 3 is provided with an air flow outlet 32. An air flow path is formed between the dust suction inlet 12 and the air flow outlet 32. An air flow flows from the dust suction inlet 12, passes through the dust cup assembly 1 and the air flow generator 6 in sequence, and eventually leaves the air flow outlet 32.

As shown in FIG. 3 to FIG. 6, in an embodiment of the present invention, the dust cup assembly 1 includes a cup body 11, a filter apparatus 13 disposed in the cup body 11, a dust outlet 14 disposed on the cup body 11, a dust cup cover 15 for sealing the dust outlet 14, a latching portion 16 for controlling the dust cup cover 15 to be opened or locked, a rotating portion 17, and a reset structure 18. When the latching portion 16 controls the dust cup cover 15 to be opened or locked, the dust cup cover 15 rotates around the rotating portion 17, and when the dust cup cover 15 is unlocked, the dust cup cover 15 is driven by the reset structure 18 to automatically open. The dust cup cover 15 opens at an angle ranging from 110 degrees to 190 degrees. The reset structure 18 is disposed, so that one-push dumping can be implemented without needing to manually open the dust cup cover 15 for dumping, to make the operation convenient and quick. In an embodiment of the present invention, as shown in FIG. 7, the reset structure 18 is a torsion spring structure. Certainly, in other embodiments, a person skilled in the art may use other reset structures that can achieve the objectives of the present invention. An outer periphery of the dust cup cover 15 or the dust outlet 14 is provided with a second sealing member (not shown in the figure) for sealing the dust outlet 14 and the dust cup cover 15.

Figure 7:
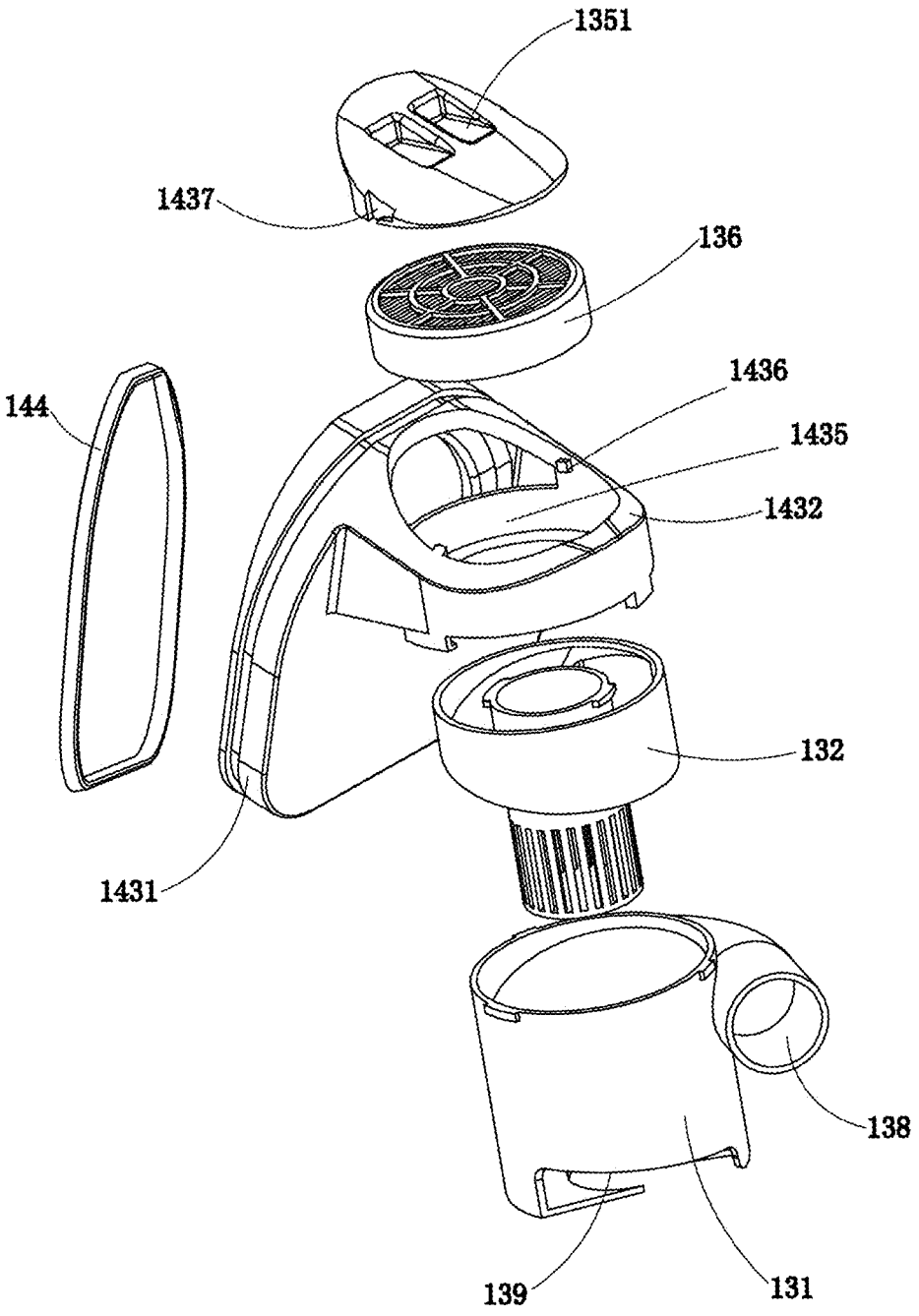
FIG. 7 is an exploded view of a filter apparatus in the handheld vacuum cleaner according to the first embodiment of the present invention from an angle.
Figure 8:
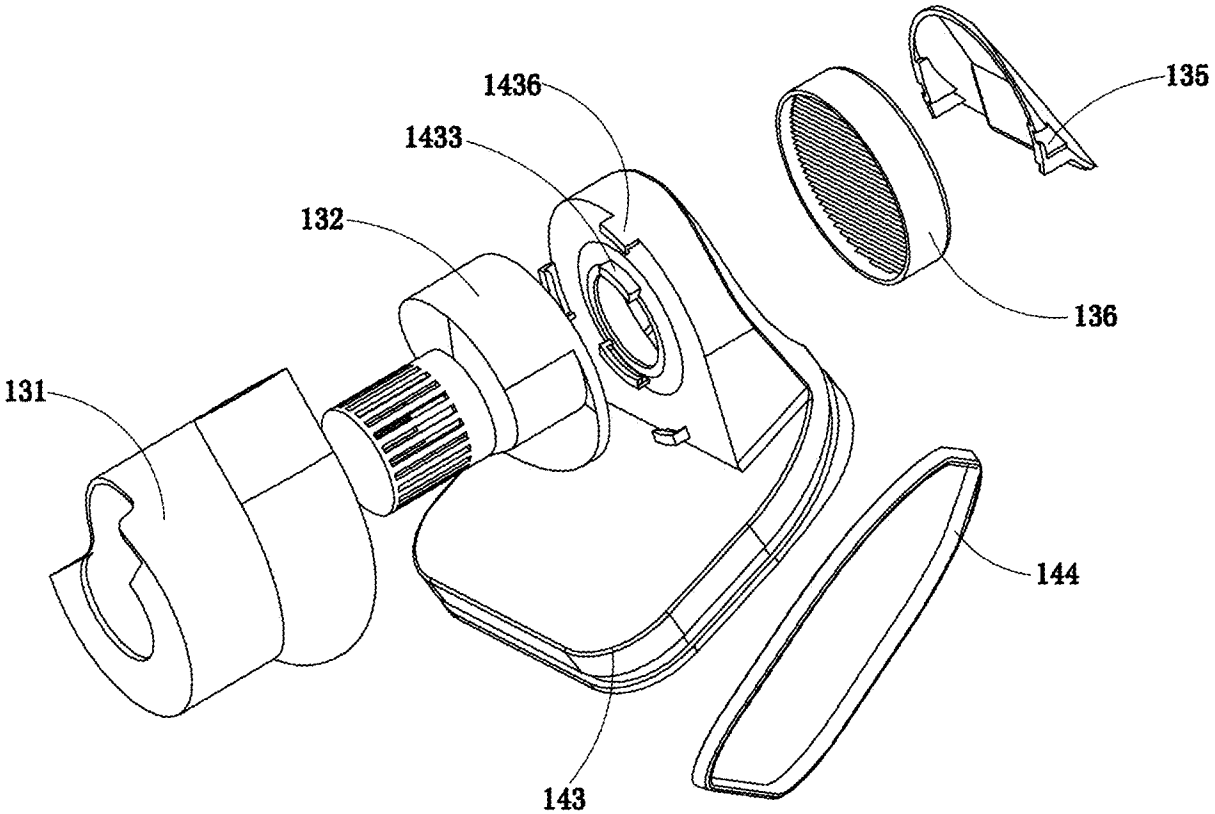
FIG. 8 is an exploded view of a filter apparatus in the handheld vacuum cleaner according to the first embodiment of the present invention from another angle.
Figure 9:
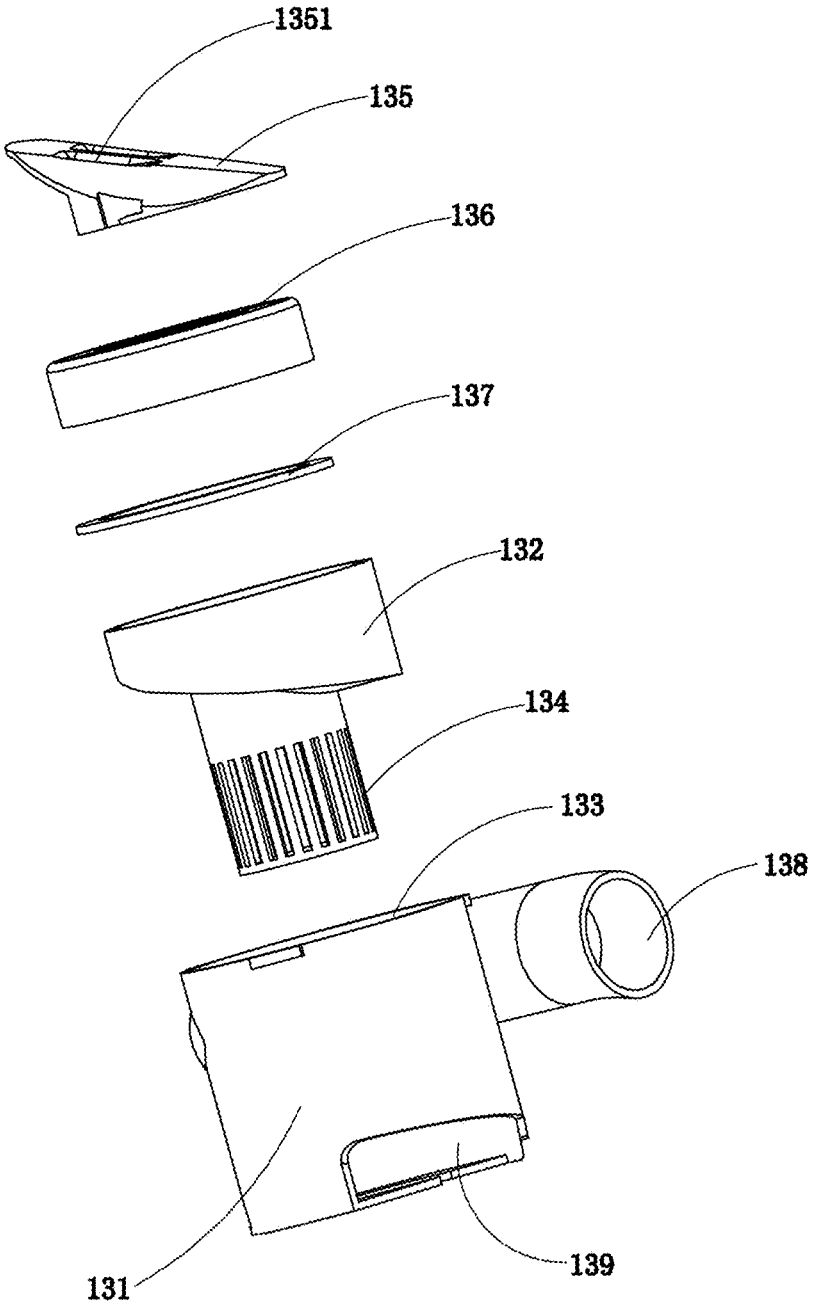
FIG. 9 is an exploded view of a filter apparatus without a positioning plate in the handheld vacuum cleaner according to the first embodiment of the present invention.

As shown in FIG. 7 to FIG. 9, in the embodiments of the present invention, the filter apparatus 13 is a filter apparatus using a cyclone separator. The filter apparatus 13 includes a positioning plate 143, a main body portion 131 fastened to the positioning plate 143, a cyclone 132 fastened to the positioning plate 143 and located in the main body portion 131, a filter 136, a cover plate 135 that is pressed against the filter 136 to position the filter 136, and a sealing ring 137 for sealing the filter 136 to prevent dust from leaving from an outer edge of the filter 136. The positioning plate 143 has a first fastening body 1431 and a second fastening body 1432 integrally connected to an end of the first fastening body 1431. The first fastening body 1431 is connected to the cup body 11, and the first fastening body 1431 is provided with a fastening sealing ring 144. The fastening sealing ring 144 is disposed to ensure the fastened sealing performance between the first fastening body 1431 and the cup body 11. In this embodiment, the first fastening body 1431 and the second fastening body 1432 are an integral structure. In other embodiments, the first fastening body 1431 and the second fastening body 1432 may be implemented by using a split assembly structure. For example, the two parts are fastened by insertion or buckling or gluing. In this embodiment, the filter 136 is a waterproof filter, for example, a waterproof HEPA filter.

As shown in FIG. 7 to FIG. 9, in the embodiments of the present invention, the second fastening body 1432 has a receiving hole 1435 for receiving the filter 136, a first positioning portion 1433 for fastening the cyclone 132, a second positioning portion 1434 for fastening the main body portion 131, and a third positioning portion 1436 for fastening the cover plate 135. A top portion of the cover plate 135 is provided with an air outlet 1351 and a fourth positioning portion 1437 buckled with the third positioning portion 1436. The mounting relationships between all the structures of the dust cup assembly 1 are as follows: The cyclone 132 is first fastened to the second fastening body 1432 by the first positioning portion 1433. The main body portion 131 is then fastened to the second fastening body 1432 by the second positioning portion 1434. The filter 136 is then placed in the receiving hole 1435. The sealing ring 137 is placed between the filter 136 and the second fastening body 1432 and implements sealing in a circumferential direction to prevent dust from flying out of the filter 136 in the circumferential direction. The cover plate 135 is then pressed against the filter 136 and is fastened to the second fastening body 1432 by the combination of the third positioning portion 1436 and the fourth positioning portion 1437, and the filter 136 is further positioned. An air flow obtained by cyclonic separation flows from the air outlet 1351 to the air flow generator 6. In the embodiments shown in the accompanying drawings of the present invention, the first fastening body 1431 intersects with and is approximately perpendicular to the second fastening body 1432. The angle between the first fastening body 1431 and the second fastening body 1432 is not explicitly limited, and any angle is feasible provided that structures such as the cyclone 136 are conveniently mounted.

As shown in FIG. 7 to FIG. 9, the main body portion 131 is provided with a separation inlet 138 connected to the dust suction inlet 12 and a separation outlet 139 for throwing dust out of the main body portion 131. The cyclone 132 is provided with several pores 134 for a cyclonic air flow to pass through. A cyclone chamber 133 is defined in the main body portion 131. On the air flow path, the filter 136 is located downstream of the cyclone 132. A dusty air flow enters the main body portion 131 through the separation inlet 138, cyclonic separation is performed on the dusty air flow in the cyclone chamber 133, dust is thrown out through the separation outlet 139 and collected in the dust cup assembly 1, the filtered air flow containing a small amount of dust then flows to the filter 136 through the pores 134 for re-filtration, and the air flow re-filtered by the filter 136 passes through the air flow generator 6 to be discharged from the air flow outlet 32.

Figure 4:
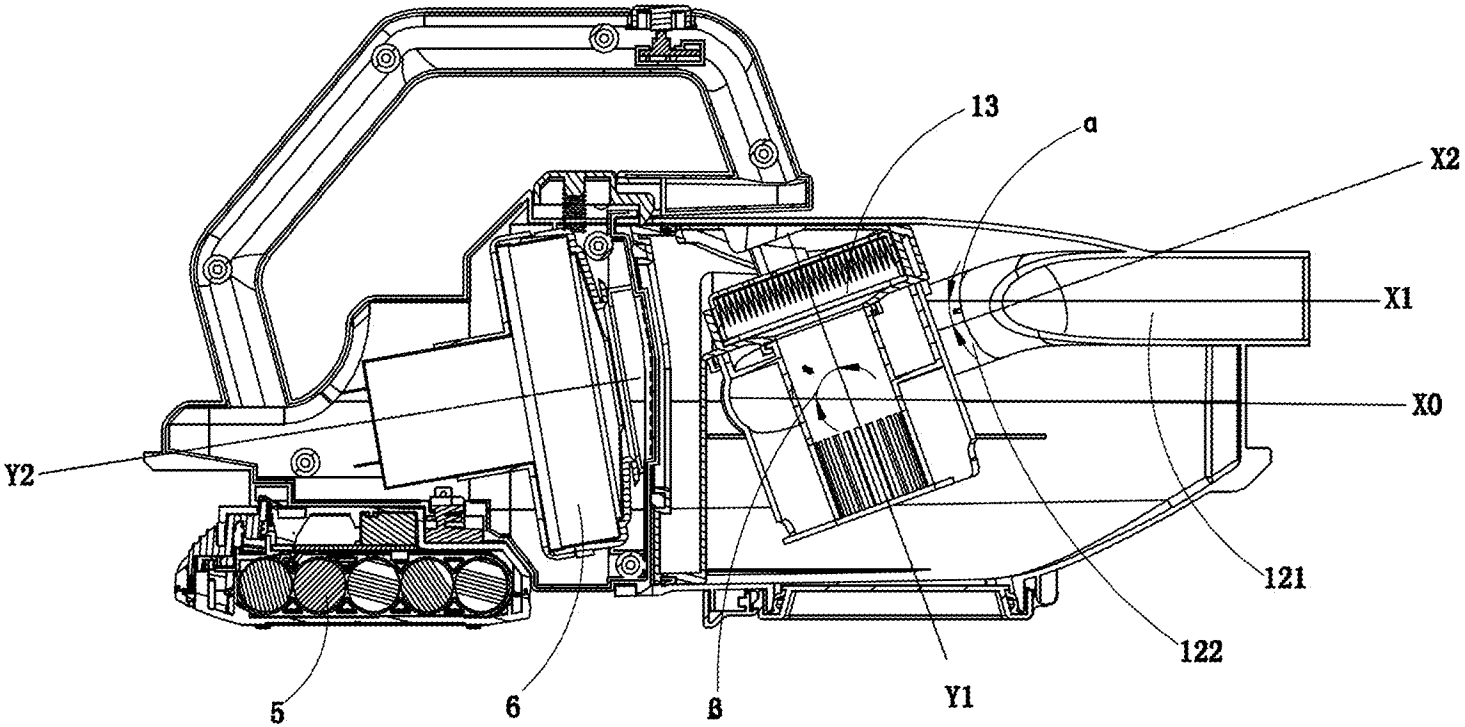
FIG. 4 is a sectional view along a line A-A in FIG. 2, indicating various axes.

As shown in FIG. 4, the cup body 11 includes a longitudinal axis X0 extending longitudinally, and the longitudinal axis X0 is a length direction of the handheld vacuum cleaner. The filter apparatus 13 is provided with a first axis Y1 extending longitudinally, the filter apparatus 13 is disposed obliquely relative to the longitudinal axis X0, and there is an acute angle between the longitudinal axis X0 and the first axis Y1. The filter apparatus 13 is disposed obliquely, so that compared with a vertically placed filter apparatus in the prior art, the height of the entire machine is reduced, and compared with a horizontally placed filter apparatus in the prior art, the length of the entire machine is reduced, so that the vacuum cleaner has a compact structure, a small size, and a light weight, and meets the current market demand for lightweight and miniaturized vacuum cleaners. Moreover, the filter apparatus 13 is disposed obliquely, so that compared with a horizontally placed filter apparatus with a same or similar structure in the prior art, when dusty liquid is collected, the separation outlet 139 may be disposed at a higher position, and compared with a horizontally placed filter apparatus in the prior art, the position of the separation outlet 139 of the filter apparatus 13 may be raised to prevent dusty liquid from being drawn into the cyclone chamber again to avoid blockage of the filter 136, prolong the service life of the filter 136, and prevent moisture in the liquid from entering the air flow generator to protect electrical parts from damage.

As shown in FIG. 4, the filter apparatus 13 extends obliquely downward toward the dust suction inlet 12 as viewed in a flow direction of the air flow. The angle between the longitudinal axis X0 and the first axis Y1 is in principle greater than 0 degrees and less than 90 degrees. In the preferred embodiments of the present invention, the angle between the longitudinal axis X0 and the first axis Y1 is between 30 degrees and 60 degrees. In this preferred angle range, the entire machine has a small structure, and the effect of cyclonic separation and the dust removal performance of the entire machine can be ensured.

As shown in FIG. 3 to FIG. 9, a dust collection chamber 22 is formed in the cup body 11, and the separation outlet 139 is in communication with the dust collection chamber 22. The dust collection chamber 22 is used to collect dust obtained after cyclonic separation in the filter apparatus in the present embodiment. The filter apparatus 13 is disposed obliquely relative to the cup body 11 having the dust collection chamber 22. If a vacuum cleaner has a plurality of filter apparatuses and the plurality of filter apparatuses have a plurality of dust accommodation cavities independent of each other, the body forming the dust collection chamber may be considered as the cup body in the present embodiment. That is, if a vacuum cleaner has a plurality of filter apparatuses and the plurality of filter apparatuses have a plurality of independent dust accommodation cavities, it may be considered that the vacuum cleaner has a plurality of cup bodies according to the present embodiment, and the filter apparatus is disposed obliquely relative to an axis of the cup body in which the filter apparatus is located. Certainly, in another case in which there is only one dust collection chamber, a vacuum cleaner has one cup body in the present embodiment, and the filter apparatus is disposed obliquely relative to an axis of the independent cup body. In the present embodiment, the filter apparatus is disposed obliquely. From another angle, if a bottom surface of the vacuum cleaner is parallel to a horizontal plane and the vacuum cleaner is placed in the horizontal plane, the filter apparatus is oblique relative to the horizontal plane.

As shown in FIG. 3 to FIG. 9, when a dusty air flow swirls in the cyclone chamber 133, the separated dust is thrown out of the separation outlet 139 under the action of the air flow and accumulated in the dust collection chamber 22. The dust collection chamber 22 is located outside the filter apparatus 13. That is, the dust collection chamber 22 is in communication with but spatially separated from the cyclone chamber 133. This design can prevent dust from drawn back into the filter apparatus 13 by the flowing air flow, thereby effectively improving the separation effect of the dusty air flow and avoiding blockage of the filter 136.

Figure 3:
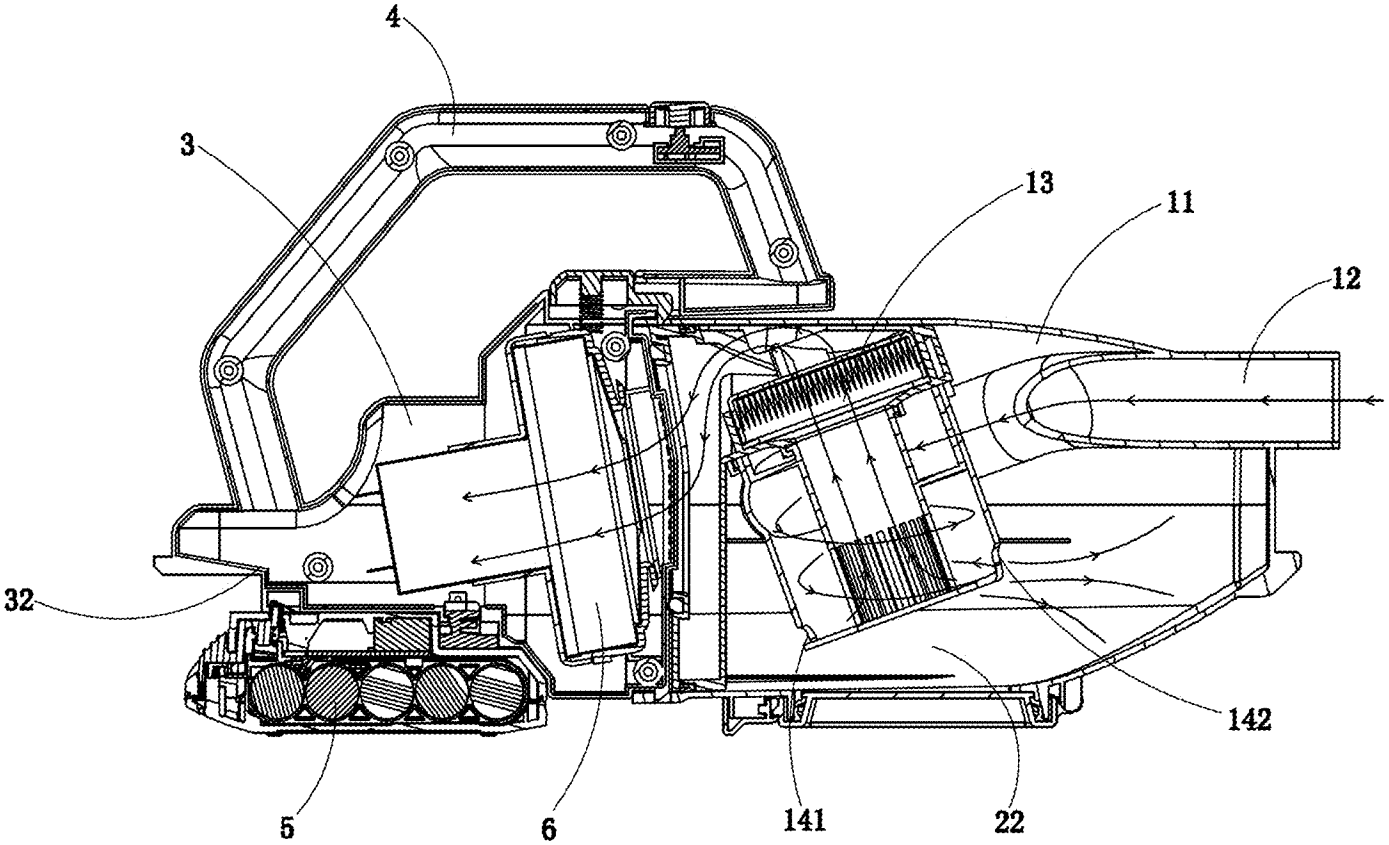
FIG. 3 is a sectional view along a line A-A in FIG. 2, indicating a flow direction of an air channel.

As shown in FIG. 3, from an angle of the dust collection chamber 22, after the filter apparatus 13 is disposed obliquely, a low point 141 near the dust collection chamber and a high point 142 far away from the dust collection chamber 25 relative to the low point 141 are formed at an end, adjacent to the dust collection chamber 22, of the filter apparatus 13, and the separation outlet 139 is disposed at the high point 142. The filter apparatus 13 is disposed obliquely, so that as compared with a horizontally placed filter apparatus with a same or similar structure in the prior art, when dusty liquid is collected, this design may increase a dust collection space, and the separation outlet 139 is disposed at the high point to raise the position of the separation outlet 139 of the filter apparatus 13, which can prevent dusty liquid from being drawn into the cyclone chamber again to avoid blockage of the filter, prolong the service life of the filter, and prevent moisture in the liquid from entering into the air flow generator to protect electrical parts from damage.

In the embodiments of the present invention, the cyclone 132 is a one-stage cyclone structure, and dust in a dusty air flow entering the main body portion 131 can be centrifugally thrown out in a cyclonic manner in the cyclone chamber 133, thereby further improving the dust removal effect. In other embodiments, the cyclone 132 may be a multi-stage cyclone structure. That is, in the flow direction of the air flow, the cyclone chamber 133 includes a plurality of cyclone chambers that are sequentially connected. In this way, a dusty air flow entering the main body portion 131 can pass through the plurality of cyclone chambers in sequence for repeated dust and air separation, thereby improving the dust removal effect.

Figure 5:
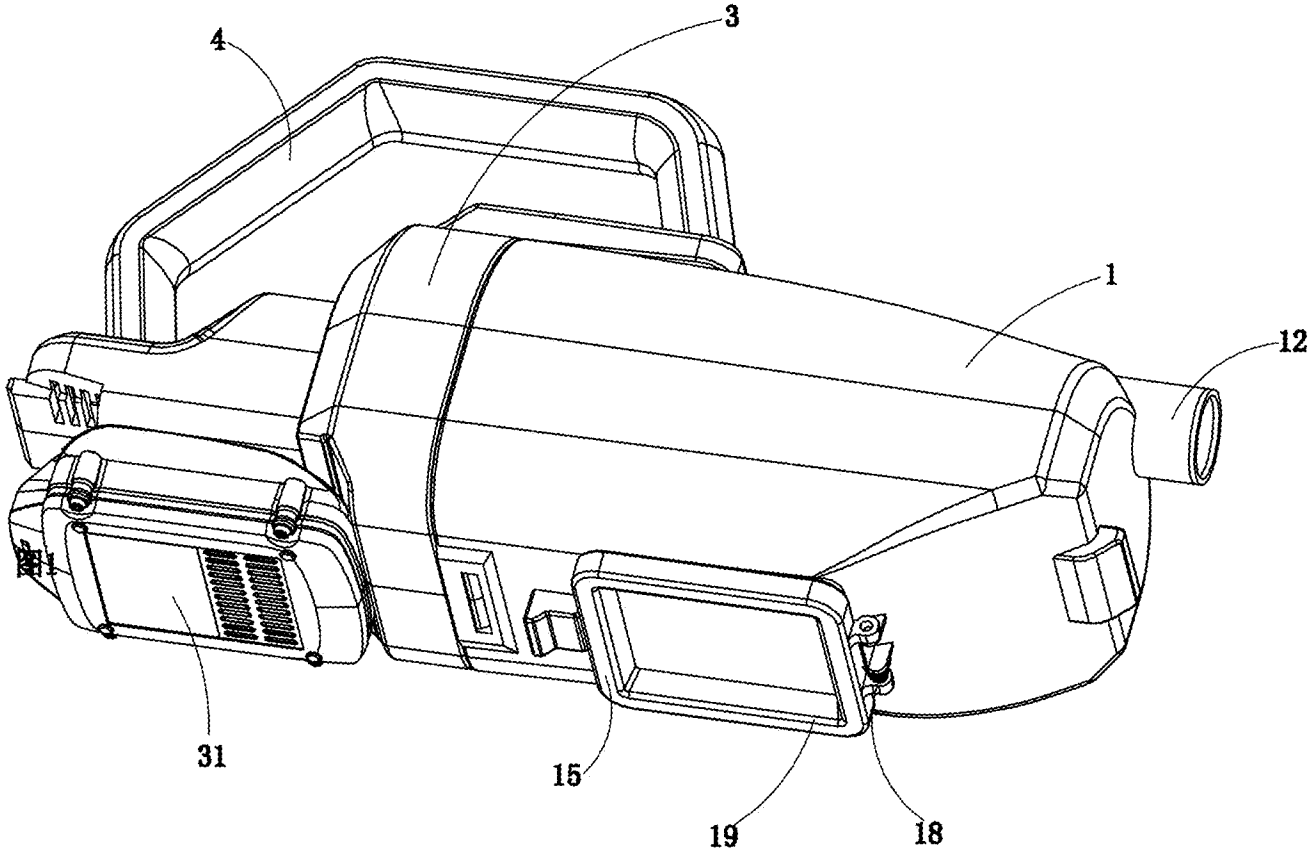
FIG. 5 is a schematic diagram showing that a dust cup cover is closed in the handheld vacuum cleaner according to the first embodiment of the present invention.

As shown in FIG. 5, a bottom surface 19 is located below the dust cup assembly 1, a support surface 31 is located below the battery assembly 5, and the bottom surface 19 is coplanar with the support surface 31. In this way, the dust cup assembly 1 and the battery assembly 5 together support the entire machine, so that the entire machine is relatively stably placed, and does not tilt or fall. The foregoing coplanar design is a preferred embodiment of the present invention, and in other embodiments, due to the weight and placement angle of the air flow generator 6, the center of gravity of the entire machine tends to be at the rear part of the entire machine. In this case, the dust cup assembly 1 is not necessarily required to support the entire machine, so that the bottom surface 19 may be non-coplanar with the support surface 31.

Figure 6:
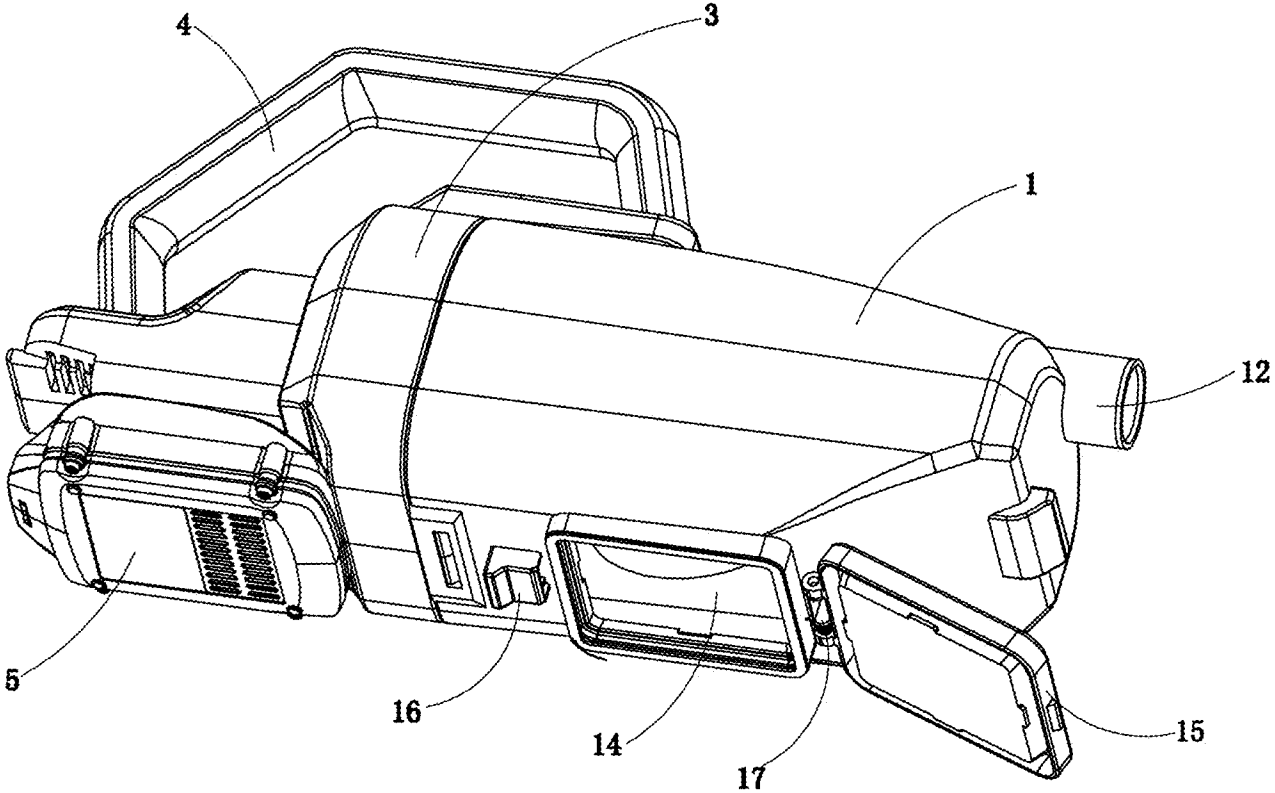
FIG. 6 is a schematic diagram showing that a dust cup cover is open in the handheld vacuum cleaner according to the first embodiment of the present invention.

As shown in FIG. 4 and FIG. 6, the dust suction inlet 12 includes a first flow-directing section 121 and a second flow-directing section 122 connected to the first flow-directing section 121. In the embodiments in the accompanying drawings of the present invention, the first flow-directing section 121 is formed on the cup body 11, and the second flow-directing section 122 is formed on the main body portion 131. Since the first flow-directing section 121 and the second flow-directing section 122 connected thereto are separately formed on two components, the first flow-directing section 121 may be connected to the second flow-directing section 122 by a fastening structure or by a mutual fit between the first flow-directing section 121 and the second flow-directing section 122. In other embodiments of the present invention, the first flow-directing section 121 in direct and proximate communication with the outside and the second flow-directing section 122 connected to the first flow-directing section 121 may be directly formed on the cup body 11, and the cup body 11 is then connected to the main body portion 131 by the second flow-directing section 122. In the embodiments in which both the first flow-directing section 121 and the second flow-directing section 122 are disposed on the cup body 11, the first flow-directing section 121 and the second flow-directing section 122 may be an integrally formed structure or may be two separate structures that are combined with each other.

As shown in FIG. 4, the first flow-directing section 121 has a first intake axis X1, the second flow-directing section 122 has a second intake axis X2, and an angle α between the first intake axis X1 and the second intake axis X2 plus an angle β between the first axis Y1 and the longitudinal axis X0 is equal to 90 degrees. That is, the sum of the two angles is 90 degrees. Since an air flow tangentially enters the filter apparatus 13 and the filter apparatus 13 is disposed obliquely, a direction of the separation inlet 138 changes accordingly, and an air flow guided by the dust suction inlet 12 needs to be tilted and steered to enter the separation inlet 138.

As shown in FIG. 4, the relationship between the first flow-directing section 121 and the filter apparatus 13 is as follows: The first intake axis X1 intersects with and is not perpendicular to the first axis Y1, and an angle between the intake axis X1 and the first axis Y1 ranges from 30 degrees to 60 degrees. In the embodiments of the present invention, for the consistency of reference standard, the first intake axis X1 is parallel to the longitudinal axis X0. With the same standard, an angle of inclination of the filter apparatus 12 and an angle of rotation of the second flow-directing section 24 can be accurately designed.

The inclination direction of the filter apparatus 13 may be defined by the angular relationship between the first axis Y1 and the longitudinal axis X0 as described above. On the premise that the filter apparatus 13 is disposed obliquely relative to the longitudinal axis X0, the positional relationship between the filter apparatus 12 and other components is described in detail below.

As shown in FIG. 4, the air flow generator 6 extends obliquely relative to the longitudinal axis X0 of the dust cup assembly 1, specifically, the air flow generator 6 is provided with a second axis Y2, the air flow generator 6 is disposed obliquely relative to the longitudinal axis X0, and there is an acute angle between the second axis Y2 and the longitudinal axis X0. In the preferred embodiments of the present invention, an angle between the longitudinal axis X0 and the first axis Y2 ranges from 5 degrees to 30 degrees. The filter apparatus 13 also extends obliquely relative to the air flow generator 6. Specifically, an angle between the first axis Y1 and the second axis Y2 ranges from 60 degrees to 85 degrees.

As shown in FIG. 4, since the filter apparatus 13 is disposed obliquely, if the air flow generator 6 is placed at the original angle, the length of an air flow channel between the filter apparatus 13 and the air flow generator 6 is prolonged. To reduce the channel length and enable the air flow separated by the filter apparatus 13 to quickly enter the air flow generator 6, the air flow generator 6 is also disposed obliquely. The air flow generator 6 extends obliquely upward toward the filter 136, so as to reduce the length of the air flow channel between the filter apparatus 13 and the air flow generator 6.

As shown in FIG. 3 and FIG. 4, the air flow generator 6 extends obliquely upward, the air flow generator 6 may be considered to be placed horizontally and extend obliquely upward, and an upward inclination angle of the air flow generator 6 is related to the inclination angle of the filter apparatus 13. Considering from two aspects, that is, an air channel between the filter apparatus 13 and the air flow generator 6 is the shortest and a volume of the entire machine is not affected, an appropriate inclination angle of the air flow generator 6 is selected. In other embodiments of the present invention, instead of being disposed obliquely, the air flow generator 6 is placed horizontally. If the air flow generator 6 is placed vertically, the height of the entire handheld vacuum cleaner 100 is increased. When the air flow generator 6 is placed horizontally, an increase in the height of the entire handheld vacuum cleaner 100 can be avoided. As shown in FIG. 5, in the embodiments of the present invention, the battery assembly 5 may be placed in a space defined after the air flow generator 6 is disposed obliquely. In this way, the space is appropriately utilized, so as to further reduce the length of the entire handheld vacuum cleaner 100, thereby reducing the volume of the entire machine.

The air flow generator 6 includes a rotating shaft (not shown in the figure) and a rotatable impeller (not shown in the figure) disposed on the rotating shaft. When the air flow generator 6 is working, the rotating shaft drives the impeller to rotate to generate strong suction and pressure. Under the action of suction and pressure, an air flow flowing through the air flow generator 6 is discharged at a high speed, and an air flow at an air inlet end of the air flow generator 6 is continuously filled to the air flow generator 6, resulting in an instantaneous vacuum inside the housing 3, so that an external dusty air flow can be drawn into the dust cup assembly 1 through the dust suction inlet 12. When the handheld vacuum cleaner 200 is working, a dusty air flow entering from the dust suction inlet 10 first enters the filter apparatus 13 for filtration, and dust and dirt removed through filtering are kept in the cup body 11. Air filtered by the filter apparatus 13 is then re-filtered by the filter 136 to filter out dust and moisture again, and air re-filtered by the filter 136 flows to the air flow generator 6. The air can cool the air flow generator 6 in the process of flowing to the air flow generator 6, thereby prolonging the service life of the air flow generator 6. Next, the air is discharged from the air flow outlet 32 to the outside of the housing 3.

As shown in FIG. 4, in the embodiments in the accompanying drawings of the present invention, the filter 136 is located between the cyclone 132 and the air flow generator 6. The cyclone 132 is disposed upstream of the filter 136, and the cyclone 132 pretreats dry and wet dusty air flows, so that only air flows with a relatively small of dust flows through the filter 136, thereby avoiding blockage of the filter 136, prolonging the service life of the filter 136, and improving the dust removal performance. In the preferred embodiments of the present invention, the filter 136 is a waterproof HEPA filter. Since the handheld vacuum cleaner 100 in the present embodiment can be used as a vacuum cleaner for use in both a wet scenario and a dry scenario, dust may be dust with the properties of a liquid. With the waterproof function, moisture is prevented from entering the air flow generator 6, thereby protecting electrical devices from damage. In other embodiments, instead of being limited to a waterproof HEPA filter, the filter 136 may be another filtering structure, for example, a multi-stage filtering structure that is combined with or integrally formed with the filter apparatus 13 and provides two-stage filtering. Dust and impurities can be adequately removed through multi-stage filtration. When the present embodiment is applied to wet treatment, for example, water absorption, in addition to the waterproof design of the filter 136 and the liquid treatment of the cyclone 132, the electrical devices such as the air flow generator 6 may also be waterproofed to further protect the electrical devices, thereby eventually ensuring the working stability and safety of liquid treatment of the vacuum cleaner.

As shown in FIG. 1, the handle assembly 4 is provided with two ends extending from front to back, namely, a first end 41 and a second end 42. The first end 41 is close to the cup body 11 and located above the cup body 11. The second end 42 is located behind the housing 11 and close to the air flow generator 6. Because the air flow generator 6 is adjacent to the battery assembly 5, the second end 42 is also close to the battery assembly 5 and located above the battery assembly 5. The handle assembly 4 is disposed to extend from front to back, so that when a user grips the handle to lift the machine, the user applies a force properly and use the machine comfortably. In addition, since the filter apparatus 13 is disposed obliquely in the present embodiment, the handle assembly 4 is not designed to be D-shaped, thereby further reducing the height of the entire handheld vacuum cleaner 100.

As shown in FIG. 1, in the handheld vacuum cleaner 100 in this embodiment, the handle assembly 4 includes a horizontal gripping area 43 and an oblique gripping area 44 connected to the horizontal gripping area 43, and the horizontal gripping area 43 and the oblique gripping area 44 form a V shape. The horizontal gripping area 43 is connected to the first end 41, the oblique gripping area 44 is connected to the horizontal gripping area at an obtuse angle, and the oblique gripping area 44 is connected to the second end 42.

Figure 10:
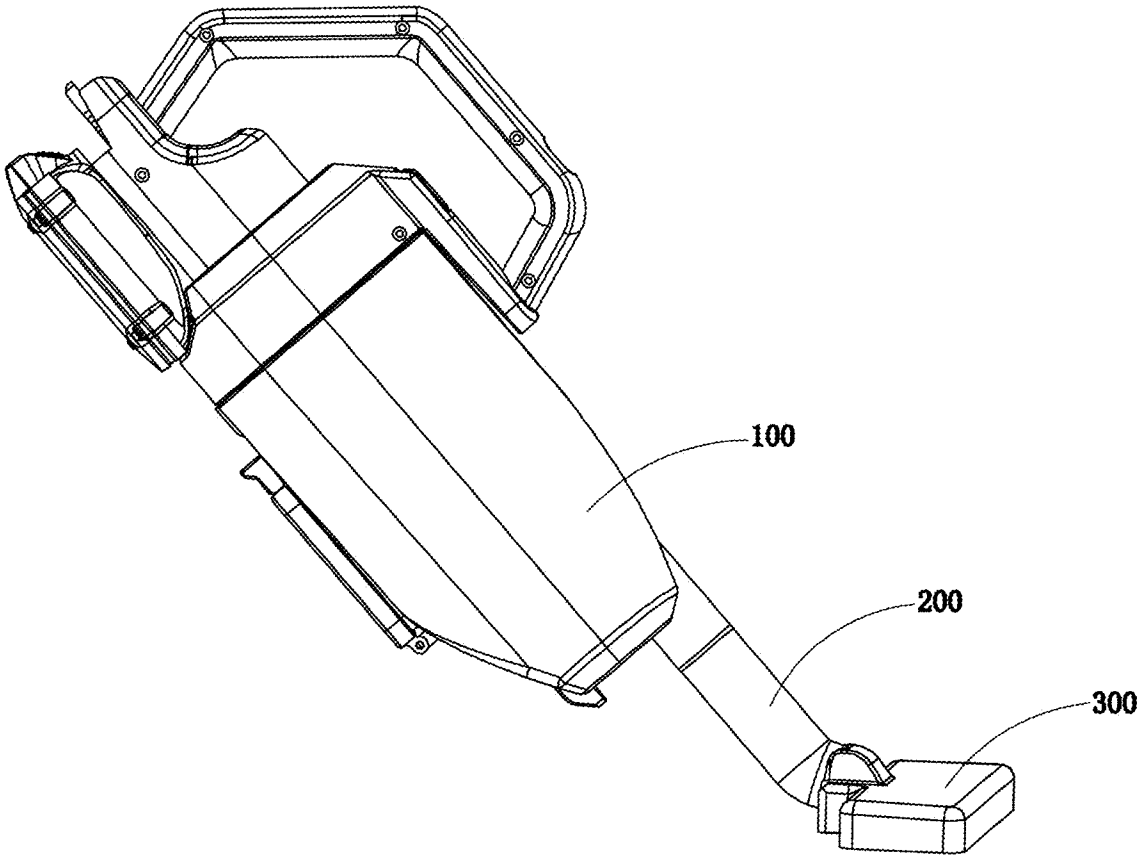
FIG. 10 is a schematic diagram of a working state of the handheld vacuum cleaner according to the first embodiment of the present invention.
Figure 11:
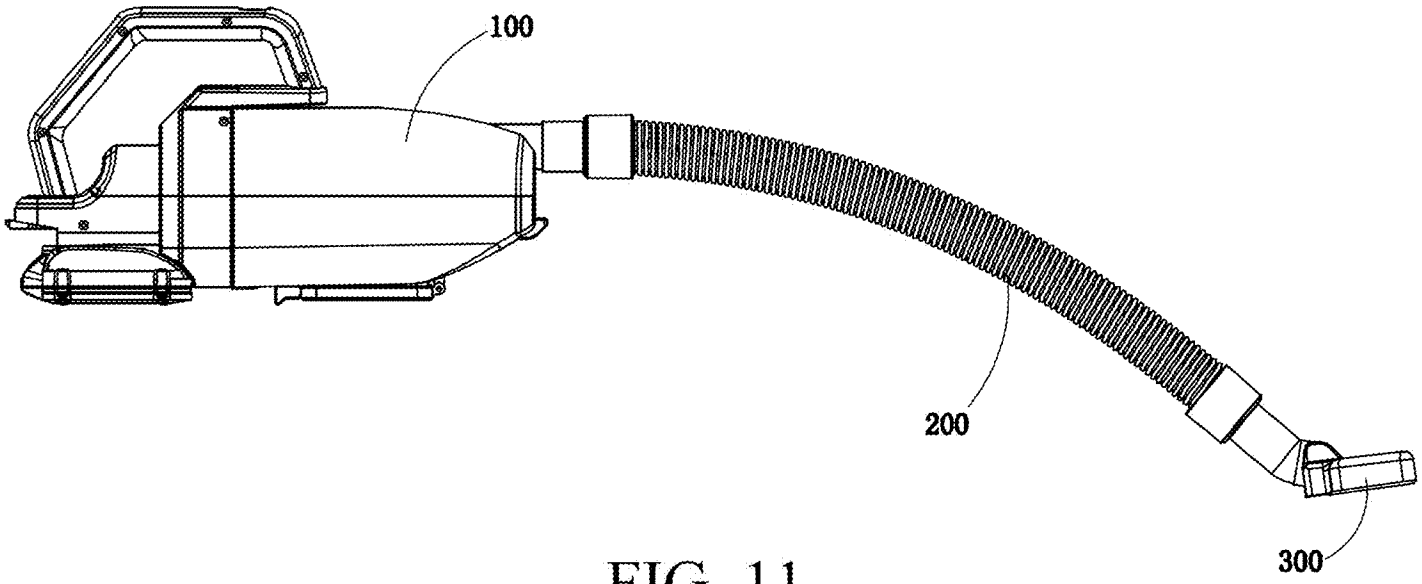
FIG. 11 is a schematic diagram of another working state of the handheld vacuum cleaner according to the first embodiment of the present invention.

As shown in FIG. 10 and FIG. 11, when the handheld vacuum cleaner in the first embodiment of the present invention is working, the handheld vacuum cleaner may be connected to the extension pipe 200 and the cleaner head 300. The extension pipe 200 may be a rigid pipe, a flexible pipe, a combination of a flexible pipe and a rigid pipe, or a telescopic pipe. In a specific work application, the user can select an accessory according to an actual application scenario. The extension pipe 200 in FIG. 10 is a rigid pipe, and the extension pipe 200 in FIG. 11 is a flexible pipe.

Figure 12:
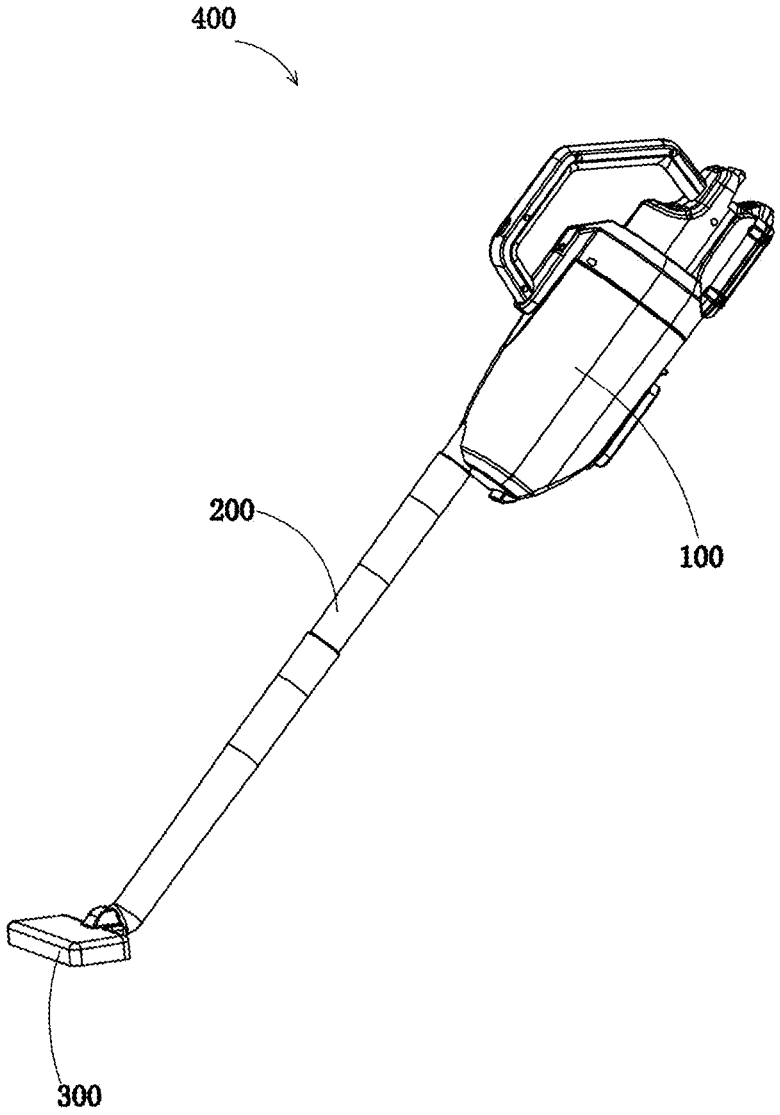
FIG. 12 is a schematic diagram of a stick vacuum cleaner according to a first embodiment of the present invention.

As shown in FIG. 12, the present embodiment further discloses a stick vacuum cleaner 400 in the first embodiment. The stick vacuum cleaner 400 includes the handheld vacuum cleaner 100, the extension pipe 200, and the cleaner head 300 in the foregoing embodiment in which the filter apparatus is disposed obliquely, one end of the extension pipe 200 is connected to the dust suction inlet of the handheld vacuum cleaner 100, and the other end of the extension pipe 200 is connected to the cleaner head 300. The cleaner head 300 is provided with a suction passage (not shown in the figure) in communication with the inside of the extension pipe 200, to allow dust to enter the extension pipe 200 through the suction passage and then enter the handheld vacuum cleaner 100 along the extension pipe 200. The extension pipe 200 may be a rigid pipe, a flexible pipe, a combination of a flexible pipe and a rigid pipe or a telescopic pipe. In a specific work application, the user can select an accessory according to an actual application scenario. The extension pipe 200 in FIG. 12 is a rigid pipe.

In the stick vacuum cleaner 400 in the first embodiment of the present invention, when the handheld vacuum cleaner 100 does not require the extension pipe 200 to perform vacuuming, for example, when the handheld vacuum cleaner 100 requires another accessory such as a slit suction head or a mite suction head to perform vacuuming, the extension pipe 200 may be detached from the dust suction inlet of the handheld vacuum cleaner 100, and an actually required accessory may be assembled to the dust suction inlet of the handheld vacuum cleaner 100. An end of the extension pipe 200 is directly detachably connected to the dust suction inlet of the handheld vacuum cleaner 100. For example, the extension pipe 200 may be mounted on the dust suction inlet or detached from the dust suction inlet by a quick removal buckle structure. Therefore, it is convenient to disassemble and assemble the extension pipe 200.

The present embodiment discloses a dust bin 7 that is airtightly combined with a dust suction apparatus, and the dust bin 7 includes a dust chamber 71 and a dust inlet 72 that is in communication with the dust chamber 71 and used for receiving garbage passing through the dust suction apparatus.

The dust suction apparatus may be airtightly combined with the dust bin 7 through shape matching. That is, the shapes of the dust suction apparatus and the dust bin 7 match to implement sealing without a sealing element. Another way of airtightly combining the dust suction apparatus with the dust bin 7 may be elastic shape matching. That is, at least one of the dust suction apparatus and the dust bin 7 is provided with a sealing element, and the dust suction apparatus is airtightly joined to the dust bin 7 by the sealing element. Certainly, a separate sealing element may be disposed between the dust suction apparatus and the dust bin 7, so that the dust suction apparatus can be airtightly joined to the dust bin 7. The separate sealing element is specifically a first sealing member that is provided in the dust bin 7 and is used for implementing the sealing performance of a joint between the dust outlet and the dust inlet. As shown in FIG. 13 to FIG. 17, in an embodiment, the dust bin 7 is combined with a handheld vacuum cleaner. The handheld vacuum cleaner is usually provided with a dedicated dust outlet, and the dust outlet is located opposite and combined with the dust inlet 72. The dust bin 7 includes a dust chamber 71, a dust inlet 72 joined to the handheld vacuum cleaner, and a first sealing member 73 for implementing the sealing between the handheld vacuum cleaner and the dust bin 7. The first sealing member 73 is disposed at the dust inlet 72. When the handheld vacuum cleaner is joined to the dust bin 7 and the dust bin 7 works, the dust inlet 72 is in communication with the dust chamber 71, and the dust inlet 72 is opposite and in communication with the dust outlet. The first sealing member 73 is disposed, so that after the vacuum cleaner and the dust bin 7 have been mounted, the sealing performance of a dust collection environment can be ensured, and dust can be prevented from flying out. In addition, after the dust bin 7 is mounted, the space of the dust bin 7 is in communication with the dust collection space of the handheld vacuum cleaner, so that the sealing element is disposed to ensure the sealing effect, thereby ensuring the internal negative pressure and the cleaning efficiency.

The first sealing member 73 is combined with an outermost ring of the dust outlet to form sealing. It can be learned from the foregoing description of the handheld vacuum cleaner in the first embodiment that the handheld vacuum cleaner 100 further includes a second sealing member for implementing the sealing between the dust outlet and the dust cup cover. The second sealing member and the dust cup cover are located in the first sealing member 73. That is, the first sealing member 73 circumferentially surrounds the second sealing member and the dust cup cover. The dust bin 7 has an abutting portion for controlling the dust cup cover of the handheld vacuum cleaner to automatically open. The abutting portion is located in the first sealing member 73.

In the present embodiment, the separate dust bin 7 is disposed, so that when the dust collection space in the handheld vacuum cleaner needs to be increased, the handheld vacuum cleaner may be joined to the dust bin 7, and the dust chamber 71 of the dust bin 7 may be utilized to increase the dust collection space of the handheld vacuum cleaner. That is, after the dust bin 7 is mounted, the dust chamber 71 of the dust bin 7 may be directly used to collect dust. After the dust bin 7 is mounted on the handheld vacuum cleaner, dust in the handheld vacuum cleaner may be dumped into the dust chamber 71. That is, when the handheld vacuum cleaner is working, the dust bin 7 may be used as a dust collection element. When the handheld vacuum cleaner is not working, the dust bin 7 may be used as a dust collection space. The dust bin 7 has a simple structure and is flexible to use.

When the handheld vacuum cleaner is working, the dust bin 7 is mounted in combination with the handheld vacuum cleaner. In this case, the handle assembly 4 may be used as a handle assembly for a combined structure.

To ensure the sealing performance, the circumferential range of the first sealing member 73 is greater than or equal to the circumferential range of the dust outlet of the handheld vacuum cleaner. For example, if the dust outlet is circular, the radius of the first sealing member 73 is greater than or equal to the radius of the dust outlet. If the dust outlet is not circular, the structure of the first sealing member 73 needs to correspond to the shape of the dust outlet, and the size of the first sealing member 73 is greater than or equal to the size of the dust outlet. In this way, the sealing performance at the entire circumference can be ensured. Considering that there are often other structural designs around the dust outlet, the structure of the first sealing member 73 may be different from the shape of the dust outlet. However, the shape of the first sealing member 73 should surround the dust outlet from the outside to ensure the sealing effect. The surrounding range may cover other structural designs around the dust outlet, for example, the latching portion of the dust cup cover.

Figure 13:
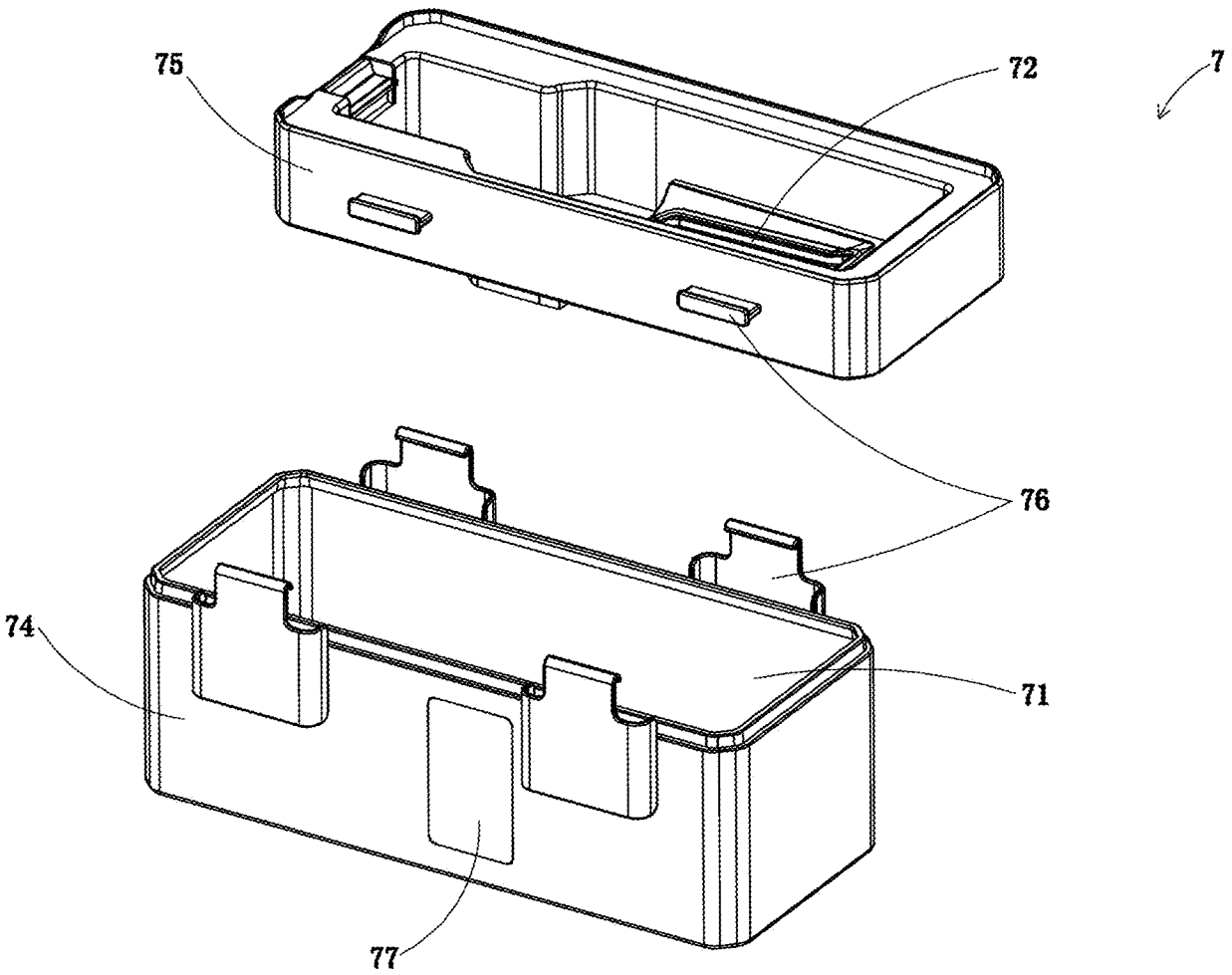
FIG. 13 is a schematic diagram of a dust bin according to a first embodiment of the present invention.
Figure 14:
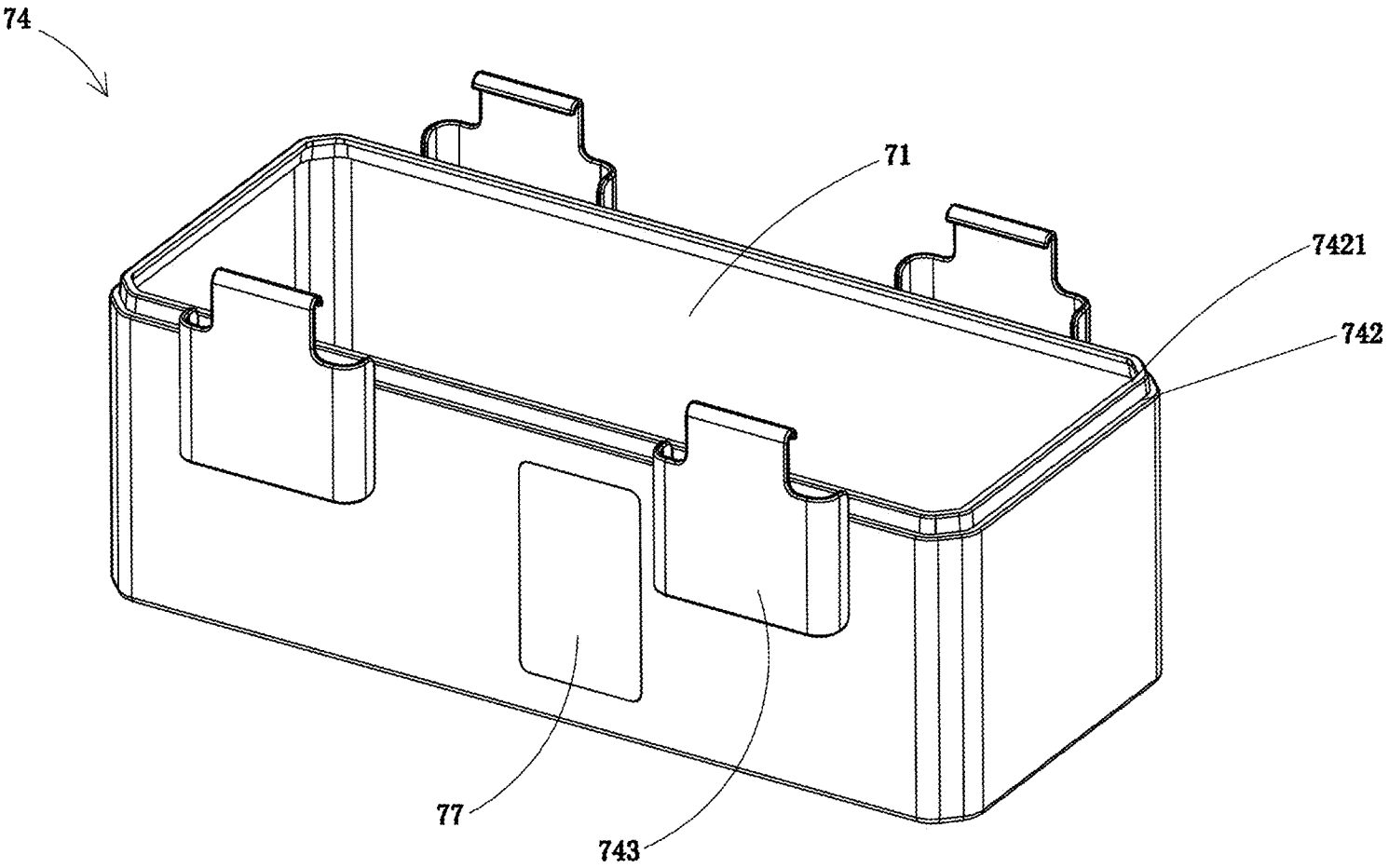
FIG. 14 is a schematic diagram of a base portion of the dust bin according to the first embodiment of the present invention.
Figure 15:
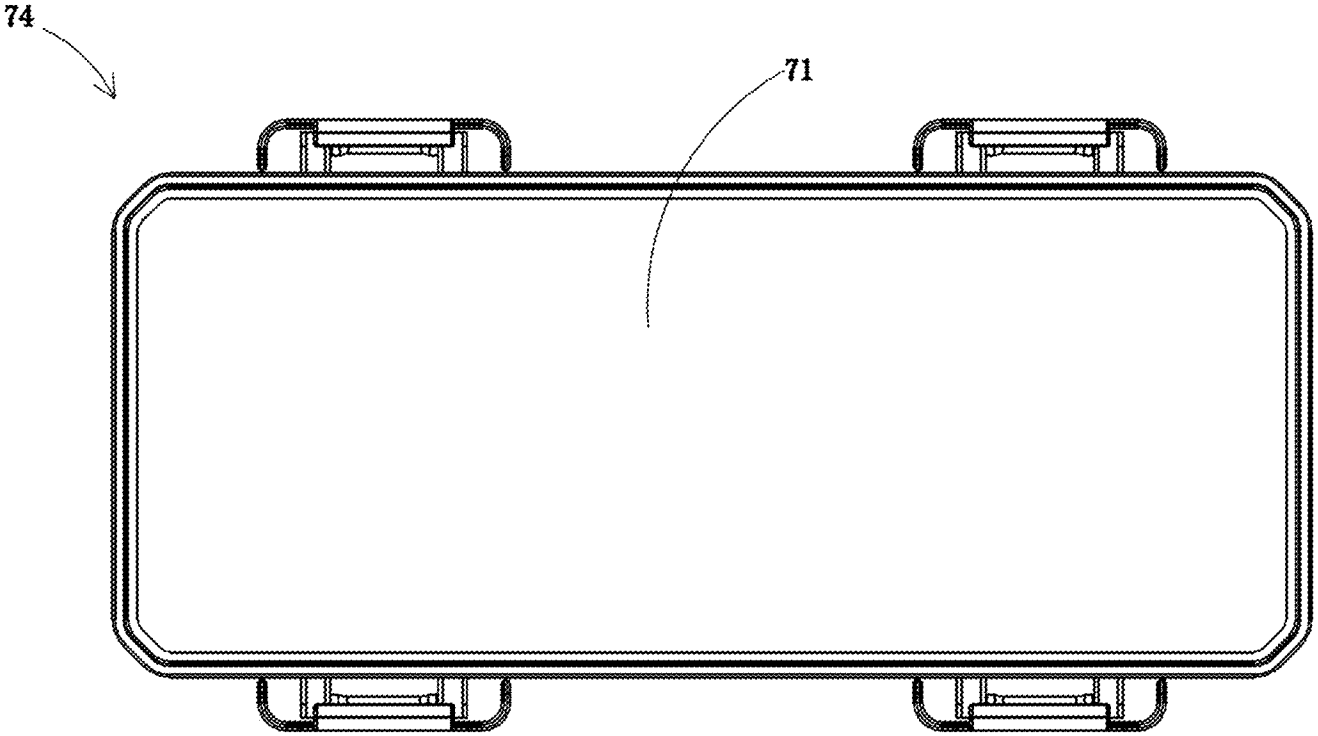
FIG. 15 is a top view of FIG. 14.
Figure 17:
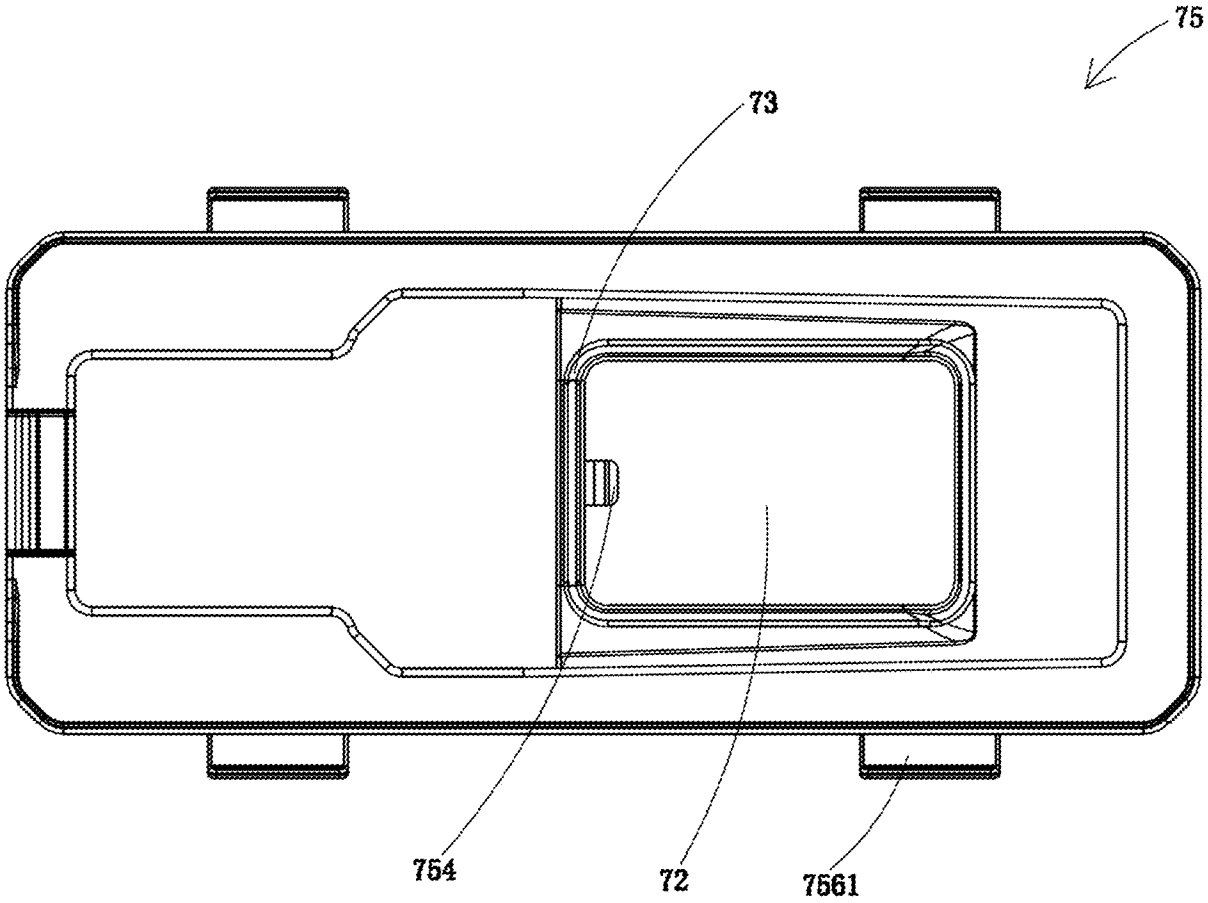
FIG. 17 is a top view of FIG. 16.

As shown in FIG. 13 and FIG. 17, the dust bin 7 includes a base portion 74 located below and a top portion 75 located above. The base portion 74 has the dust chamber 71. The top portion 75 has the dust inlet 72. The base portion 74 has a bottom surface 740 at the bottom and side surfaces 741 that are connected to the bottom surface 740 and define the dust chamber 71 together with the bottom surface 740. There is a transparent window 77 on the side surface 741.

As shown in FIG. 13 and FIG. 17, in the first embodiment of the dust bin 7 in the present invention, the dust bin 7 is a split structure. The dust bin 7 includes the top portion 75 and the base portion 74 that are combined with each other and a buckling structure 76 for fastening the top portion 75 and the base portion 74. The base portion 74 has the dust chamber 71 and the transparent window 77 for monitoring the filling state of dust. The top portion 75 has the dust inlet 72 and the first sealing member 73. The base portion 74 has the bottom surface 740 and the side surfaces 741 that are connected to the bottom surface 740 and define the dust chamber 71 together with the bottom surface 740. The transparent window 77 is disposed on the side surface 741. There may be a plurality of transparent windows 77, and the transparent windows 77 may be respectively disposed on different side surfaces 741.

As shown in FIG. 14 to FIG. 18, the side surface of the base portion 74 is provided with a first buckling portion 743. The side surface of the top portion 75 is provided with a second buckling portion 756. The second buckling portion 756 has a first buckling surface 7561 and a second buckling surface 7562 that are disposed opposite each other. The first buckling portion 743 is combined with the second buckling portion 756 to form the buckling structure 76. The first buckling portion 743 is combined with the second buckling portion 756 to fasten the base portion 74 to the top portion 75. In the embodiments shown in the accompanying drawings of the present invention, the first buckling portion 743 is disposed on the base portion 74 and is a movable buckle. The second buckling portion 756 is disposed on the top portion 75 and is a non-movable member. The base portion 74 and the top portion 75 can be fastened to each other in different combination states of the split dust bin 7.

As shown in FIG. 14 to FIG. 18, the base portion 74 has a main joint portion 742 in the circumferential direction. A main joint fastening edge 7421 is formed on the main joint portion 742. The top portion 75 is provided with a first joint portion 757 that is combined with the main joint portion 742 of the base portion 74 and a second joint portion 758 located opposite the first joint portion 757. A first joint fastening edge 759 is formed on the first joint portion 757. A second joint fastening edge 760 is formed on the second joint portion 758. There may be a plurality of preferred embodiments in the embodiments of the present invention. That is, both lateral fastening and circumferential fastening are not necessarily selected. One of lateral fastening and circumferential fastening may be selected.

In other implementations of the present embodiment, the arrangement positions of the first buckling portion 743 and the second buckling portion 756 may be interchanged, as long as the distances between the center of the second buckling portion 756 and the joint portions in two states are equal. In this way, the fastening can be implemented in both mounting states. That is, in the embodiments in the accompanying drawings of the present embodiment, the distance between the first buckling surface 7561 of the second buckling portion 756 and the first joint portion 757 is equal to the distance between the second buckling surface 7562 of the second buckling portion 756 and the second joint portion 758. Since the distance between the first buckling portion 743 and the joint portion is constant, the mutual fastening of the base portion 74 and the top portion 75 in two states can be implemented as long as it is ensured that varying distances are equal.

The mounting order of the dust bin 7 is that the top portion 75 and the base portion 74 are first mounted together through the guidance of a circumferential structure, and the top portion 75 is then fastened to the base portion 74 by the buckling structure 76. In this way, the dust bin 7 has a simple structure and is easy to mount.

In the dust bin 7 in the first embodiment, the main joint portion 742 may be separately combined with the first joint portion 757 and the second joint portion 758. Two functions of the dust bin 7 are implemented by using two combination modes. The two combination modes are described separately below. Different arrangement or combination modes between the dust bin and the dust suction apparatus enable the vacuum cleaner combination to switch between a working mode and a transport/storage mode.

Figure 19:
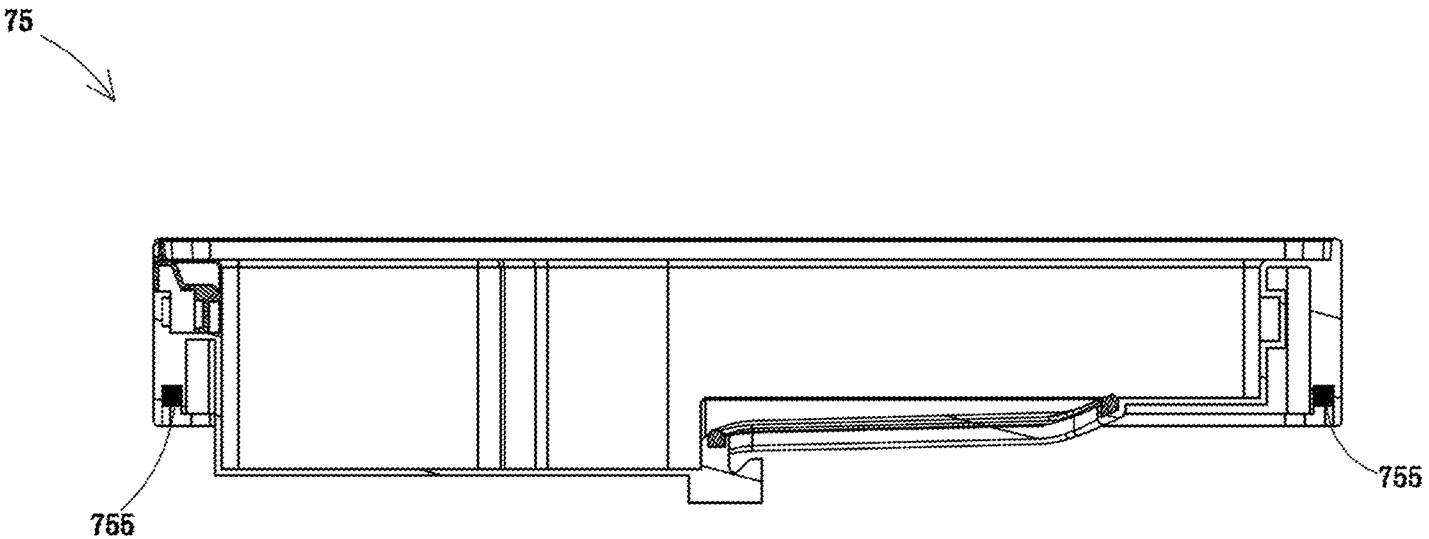
FIG. 19 is a front view of FIG. 16.
Figure 20:
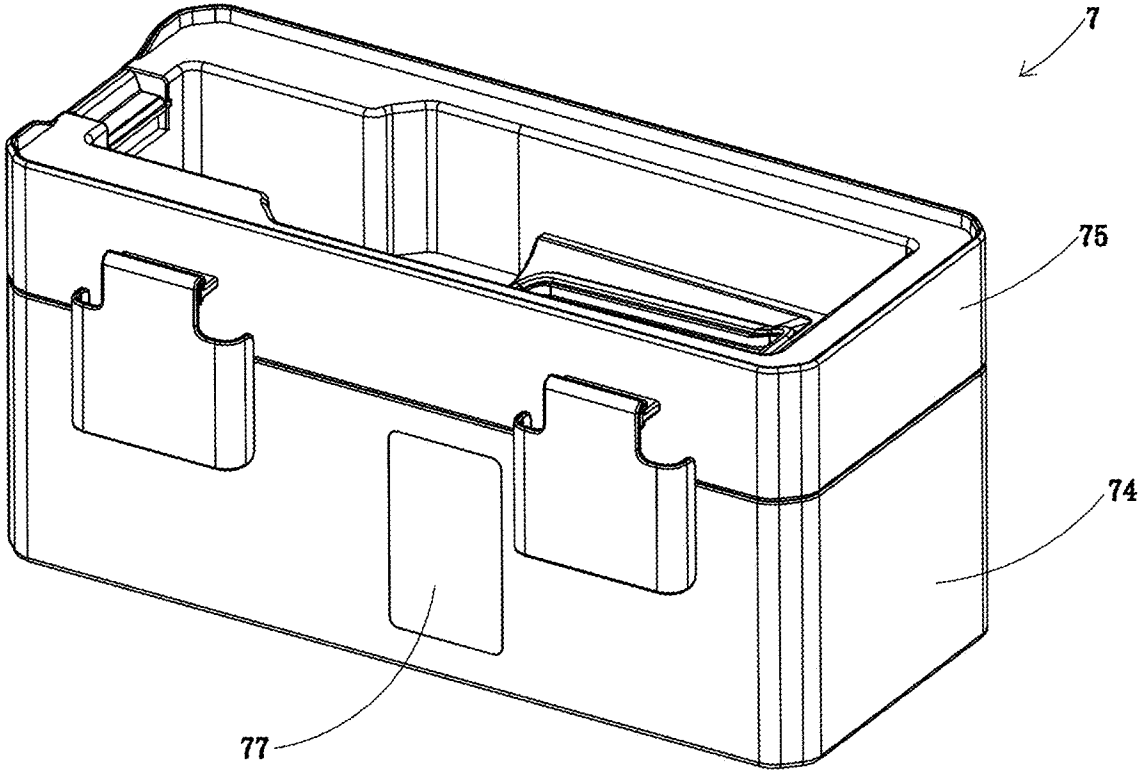
FIG. 20 is a schematic diagram of a first state of the dust bin according to the first embodiment of the present invention.
Figure 21:
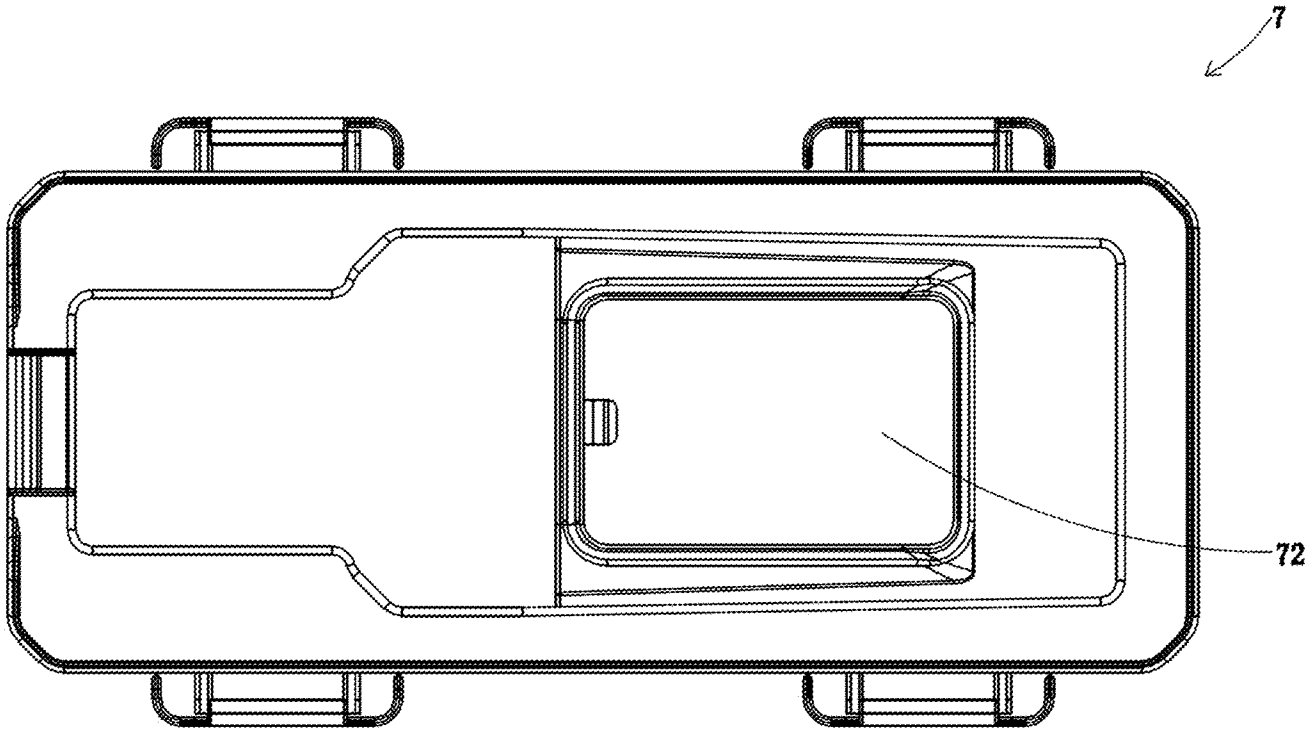
FIG. 21 is a top view of FIG. 20.

As shown in FIG. 19 to FIG. 21, the first combination mode in which the main joint portion 742 is joined to the first joint portion 757 is applicable to the working mode. The main joint fastening edge 7421 is combined with the first joint fastening edge 759 to fasten the base portion 74 and the top portion 75 in the circumferential direction, and the first buckling portion 743 is buckled with the first buckling surface 7561 to fasten the base portion 74 and the top portion 75 on the side surface. The first combination mode is a state in which the dust collection space of the handheld vacuum cleaner is increased. To enhance the sealing performance at the circumference, a circumferential sealing ring 755 is disposed between the base portion 74 and the top portion 75 in a circumferential direction in which the main joint portion 742 is joined to the first joint portion 757. In this way, based on the first sealing member 73, the circumferential sealing ring 755 further ensures the sealing effect after the handheld vacuum cleaner is combined with the dust bin 7.

Figure 22:
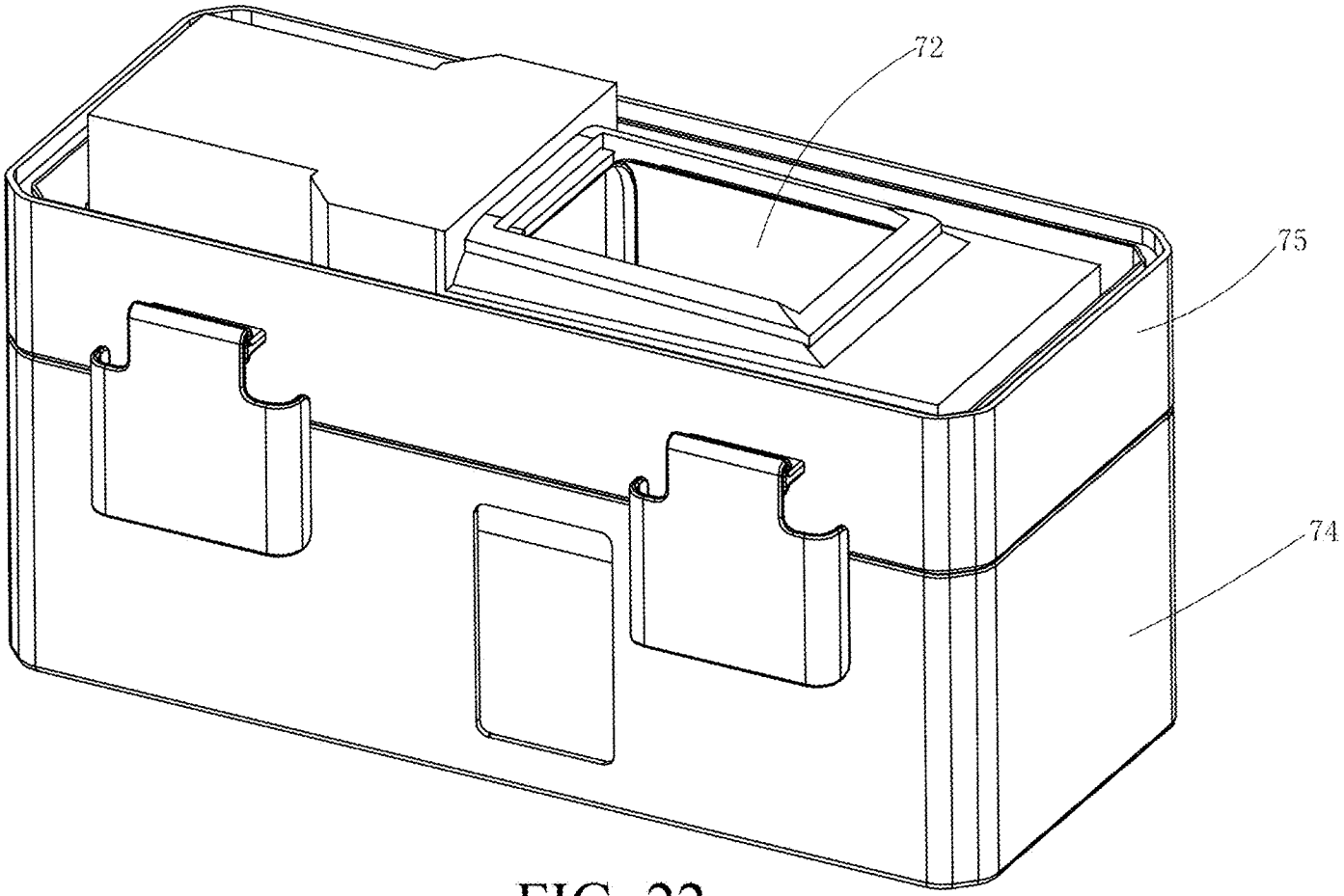
FIG. 22 is a schematic diagram of a second state of the dust bin according to the first embodiment of the present invention.

As shown in FIG. 22, the second combination mode is applicable to the transport/storage mode. In the second combination mode, the handheld vacuum cleaner is fastened to the top portion 75 on the side on which the second joint portion 758 is located, and the handheld vacuum cleaner is received upside down in the dust chamber 71 of the dust bin 7. That is, when the main joint portion 742 is joined to the second joint portion 758, the main joint fastening edge 7421 is combined with the second joint fastening edge 760 to fasten the base portion 74 and the top portion 75 in the circumferential direction, and the first buckling portion 743 is buckled with the second buckling surface 7562 to fasten the base portion 74 and the top portion 75 on the side surface. The second state is a receiving state in which the handheld vacuum cleaner is received. In the second combination mode, there are two ways to place the handheld vacuum cleaner. In the first way, the handheld vacuum cleaner is fastened on the top portion 75 and received in a storage space defined by the base portion 74 and the top portion 75. In the second way, the handheld vacuum cleaner is not fastened on the top portion 75, and is placed in the base portion 74 and received in the storage space defined by the base portion 74 and the top portion 75. In the first case, the dust cup cover of the handheld vacuum cleaner may be open or not. In the second case, when the handheld vacuum cleaner is placed, a handle of the handheld vacuum cleaner may be close to the dust inlet 72, so that a user can grip the handle with the space provided by the dust inlet 72 to move the device. Two cases of receiving the handheld vacuum cleaner are described in detail below in the description of a handheld vacuum cleaner combination.

It can be learned from the description of the foregoing two states that a separate dust bin can be used for both fastening and receiving when combined with the handheld vacuum cleaner, to prevent the handheld vacuum cleaner from shaking in the dust bin. Moreover, the dust bin is disposed to be detachable, have a variety of assembly states and a simple structure, and be flexible to use, thereby increasing the dust collection chamber of the handheld vacuum cleaner. In addition, the dust bin may be used to receive the handheld vacuum cleaner, thereby saving the storage space and providing a pleasant storage environment.

Figure 16:
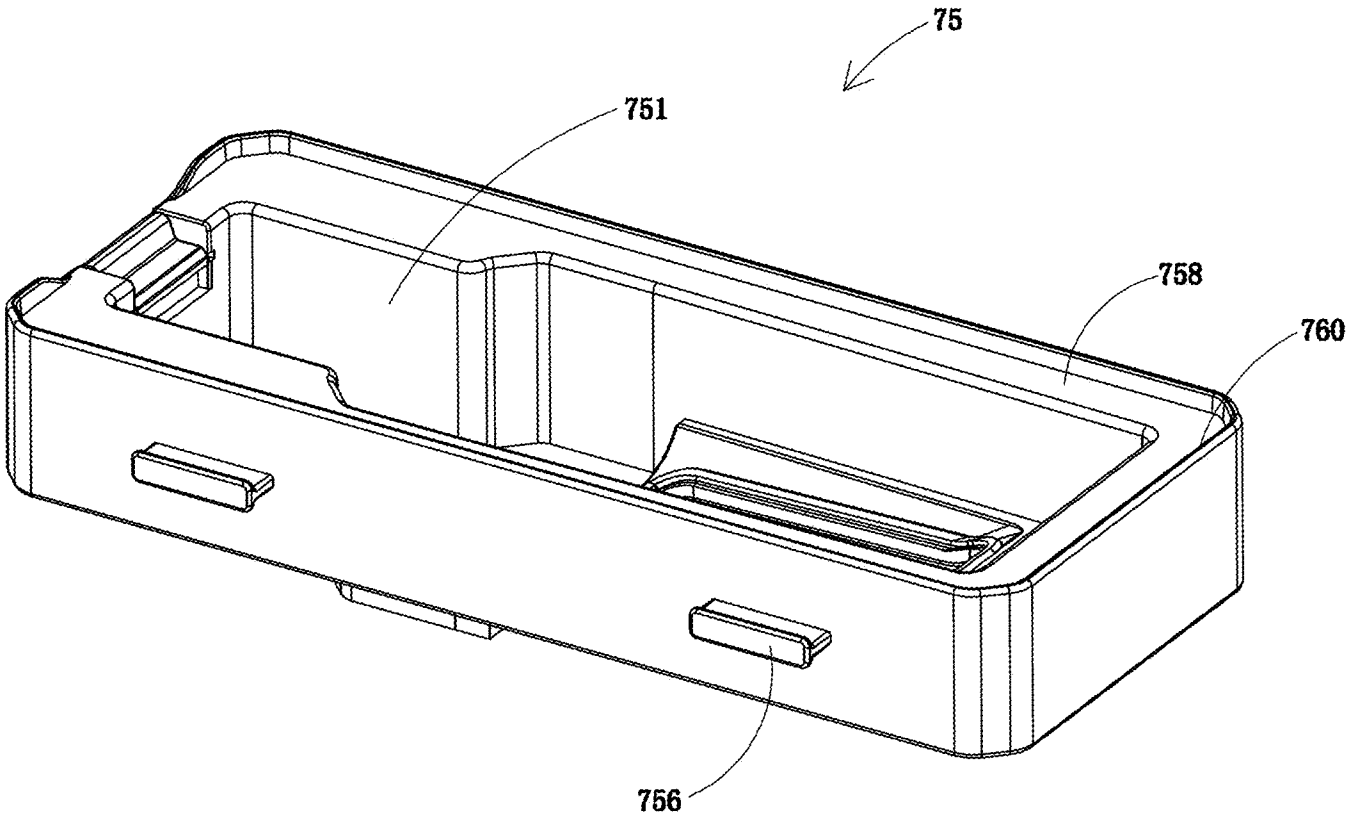
FIG. 16 is a schematic diagram of a top portion of the dust bin according to the first embodiment of the present invention.

As shown in FIG. 16, in a preferred embodiment of the first embodiment of the dust bin 7 in the present invention, an accommodating cavity 751 for accommodating a part of the handheld vacuum cleaner is formed on the top portion 75. The accommodating cavity 751 can partially accommodate the handheld vacuum cleaner, so that a combination of the handheld vacuum cleaner and the dust bin 7 has a small size, thereby saving a space.

Figure 18:
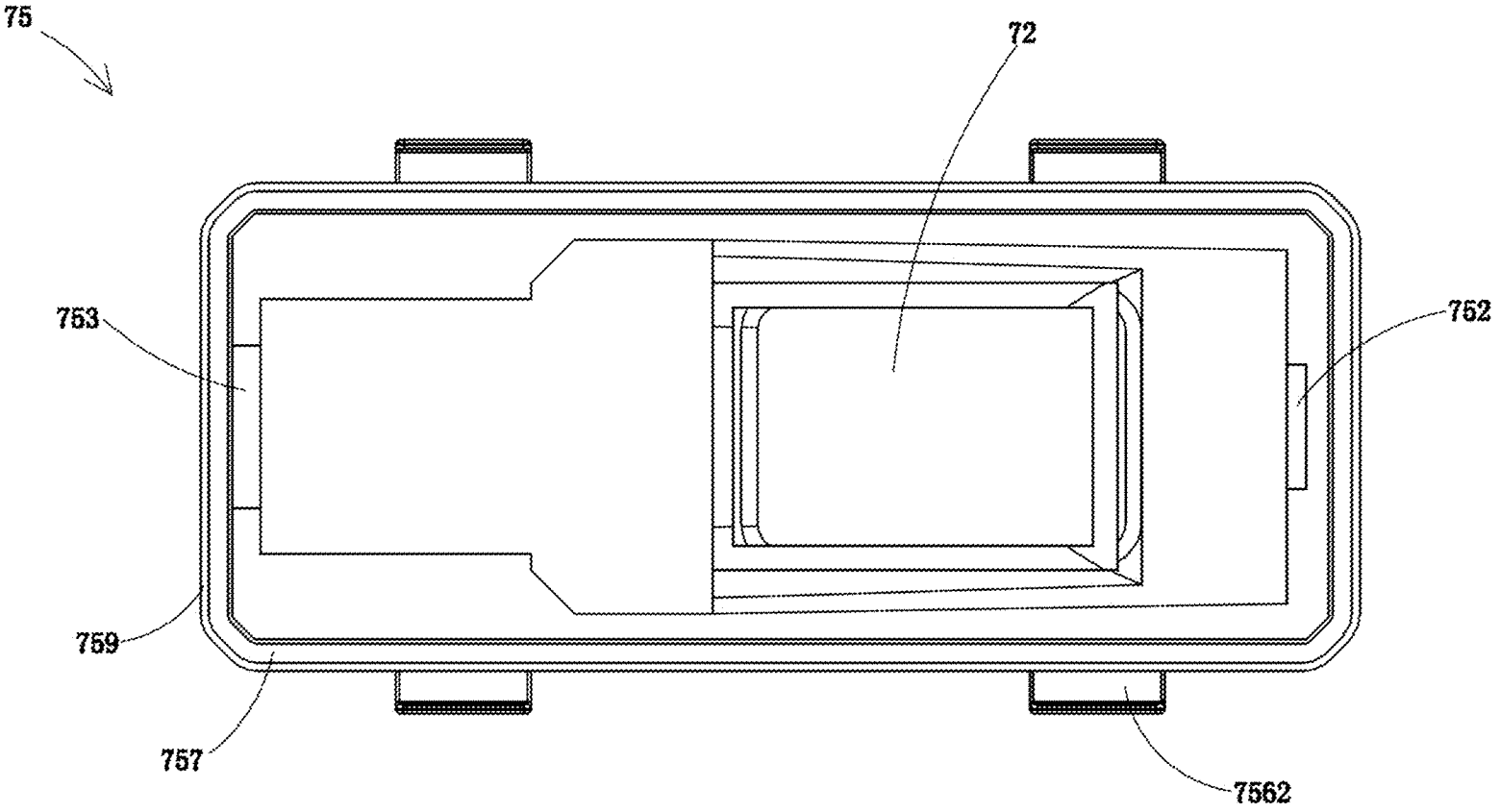
FIG. 18 is a bottom view of FIG. 16.

As shown in FIG. 18, a first fastening structure 752 and a second fastening structure 753 may be respectively disposed at two ends of the top portion 75. When the handheld vacuum cleaner is mounted in the dust bin 7, the first fastening structure 752 and the second fastening structure 753 are respectively buckled with the first positioning buckle 20 and the second positioning buckle 21 to fasten the handheld vacuum cleaner to the dust bin 7. The positions of the first fastening structure 752 and the second fastening structure 753 may be adjusted, so that the first fastening structure 752 and the second fastening structure 753 adapt to the handheld vacuum cleaners with different sizes. Certainly, in other preferred embodiments of the present invention, other fastening structures may be disposed to fasten the handheld vacuum cleaner to the dust bin 7, for example, the fastening of an elastic band in the circumferential direction or the design of a tension rope.

As shown in FIG. 17, in a preferred embodiment of the first embodiment of the dust bin 7 in the present invention, the dust bin 7 may be provided with an abutting portion 754. When the handheld vacuum cleaner is combined with the dust bin 7, the abutting portion 754 can assist in abutting against the latching portion of the dust cup cover of the handheld vacuum cleaner, to enable the dust cup cover to automatically open. Certainly, in other implementation plans, the abutting portion 754 may be omitted, and the dust cup cover of the handheld vacuum cleaner may be manually opened. The abutting portion 754 is located in the first sealing member 73.

In a preferred embodiment of the first embodiment of the dust bin 7 in the present invention, if the abutting portion 754 is disposed, a position regulator (not shown in the figure) for adjusting the position of the abutting portion 754 may further be disposed to provide the abutting portion 754 with at least two working positions, that is, a first position applicable to the working mode and a second position applicable to the transport/storage mode. When the abutting portion 754 is in the first position, the abutting portion 754 abuts against the dust cup cover to control the dust cup cover to open. When the abutting portion 754 is in the second position and the handheld vacuum cleaner is mounted in the dust bin 7, the abutting portion 754 does not abut against the dust cup cover and the dust cup cover does not open. The abutting portion 754 is disposed in such a way because the dust bin 7 has two application scenarios. In one scenario, the dust storage space of the handheld vacuum cleaner is increased. In the other scenario, the handheld vacuum cleaner is received. When the dust bin 7 is used to increase the dust storage space of the handheld vacuum cleaner, the abutting portion 754 needs to abut against the dust cup cover to enable the dust cup cover to open. However, when the dust bin 7 is used to receive the handheld vacuum cleaner, sometimes it is not necessary to open the dust cup cover to prevent residual dust in the handheld vacuum cleaner from flying out. Therefore, a position regulator is disposed to adjust the position of the abutting portion 754 according to an actual requirement, so that it can be flexibly chosen whether the abutting portion 754 needs to abut against the dust cup cover to enable the dust cup cover to open. The position regulator may be a rotating position regulator or a sliding position regulator in the conventional art. Details are not described herein again.

In a preferred embodiment of the first embodiment of the dust bin 7 in the present invention, when the abutting portion 754 is in the first position to abut against the dust cup cover 15 to enable the dust cup cover 15 to open, the dust cup cover 15 automatically opens outward at an angle ranging from 110 degrees to 190 degrees.

Figure 23:
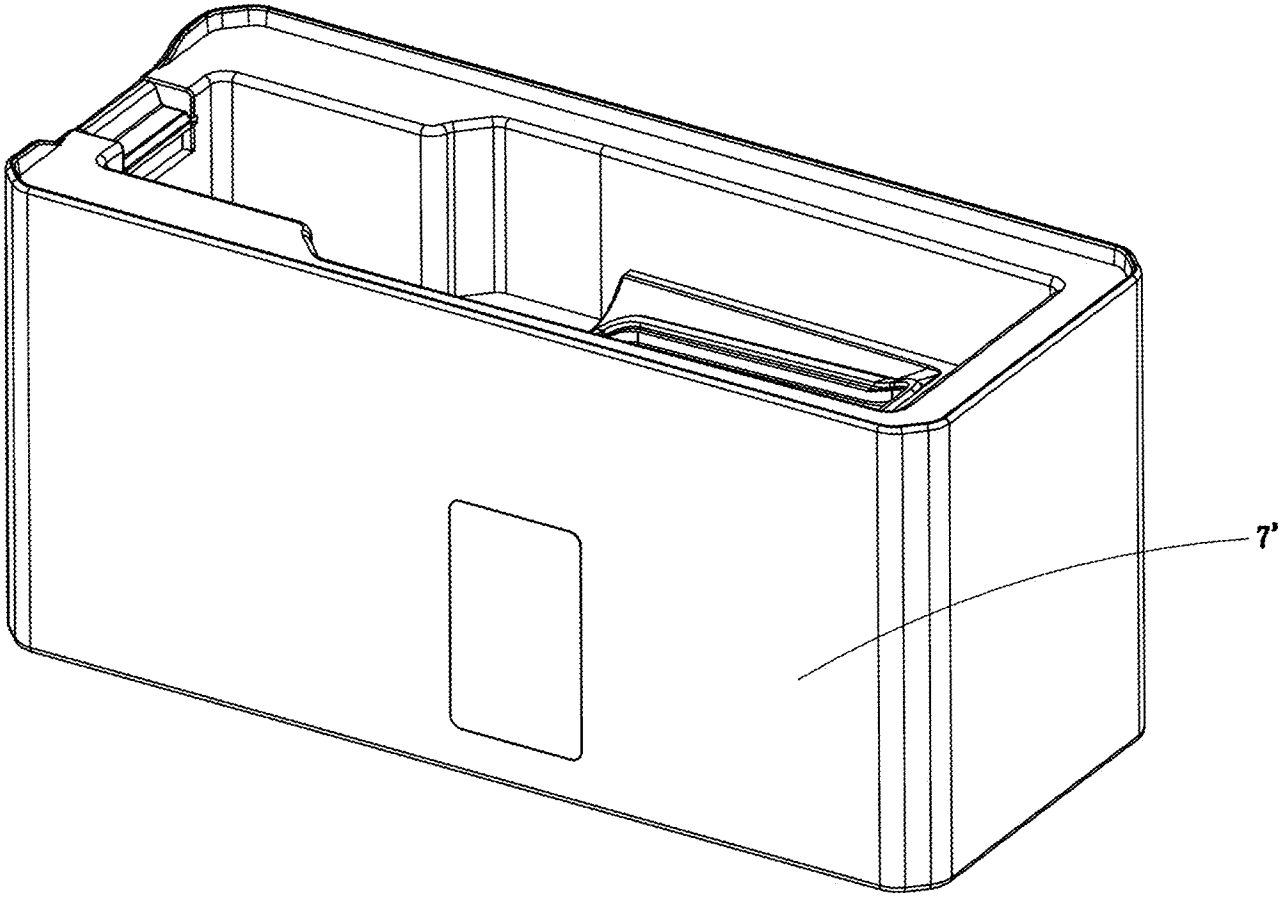
FIG. 23 is a three-dimensional schematic diagram of a dust bin according to a second embodiment of the present invention.
Figure 24:
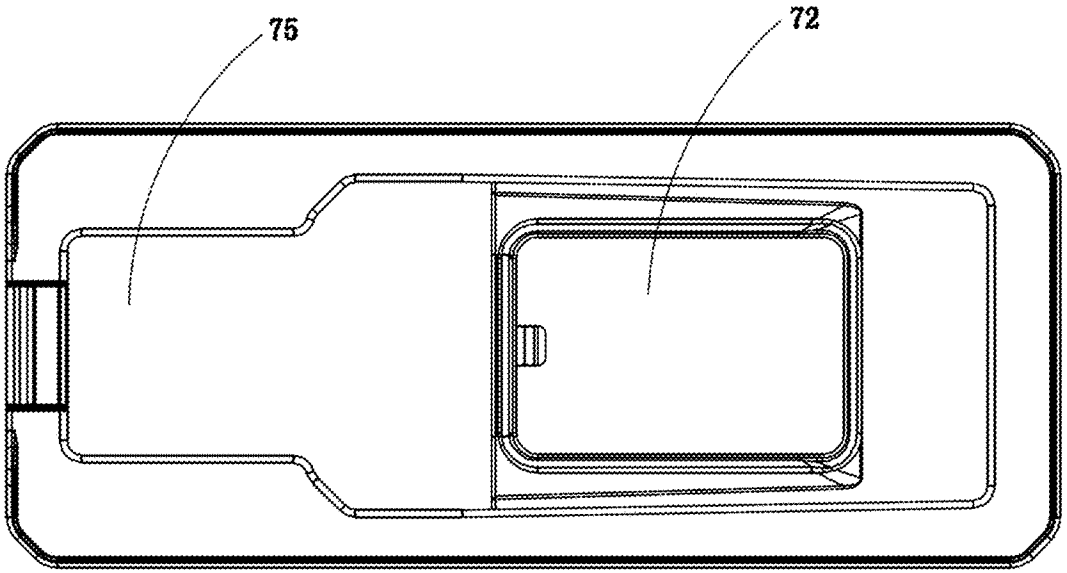
FIG. 24 is a top view of FIG. 23.

As shown in FIG. 23 and FIG. 24, a dust bin 7' in a second embodiment is further provided in the present invention. The dust bin 7' is an integral structure. A difference between the second embodiment and the first embodiment is that, the dust bin 7' has a whole structure instead of a split structure. The dust bin 7' in the second embodiment has the same internal structure as the dust bin 7 in the first embodiment, and the internal structure of the dust bin 7' is disposed with reference to that of the dust bin 7 in the first embodiment. Details are not described herein again. In the preferred embodiments of the second embodiment, since the dust bin 7' is an integral structure, dust may be dumped from the dust inlet 72 in the first embodiment, or a top portion (not shown in the figure) for emptying debris easily may be separately disposed, facilitating in dumping dust collected in the dust bin 7'. The top portion is not shown in the accompanying drawings of the present embodiment, and is a conventional technical means. A person skilled in the art can design the top portion according to an actual requirement of a product.

Figure 25:
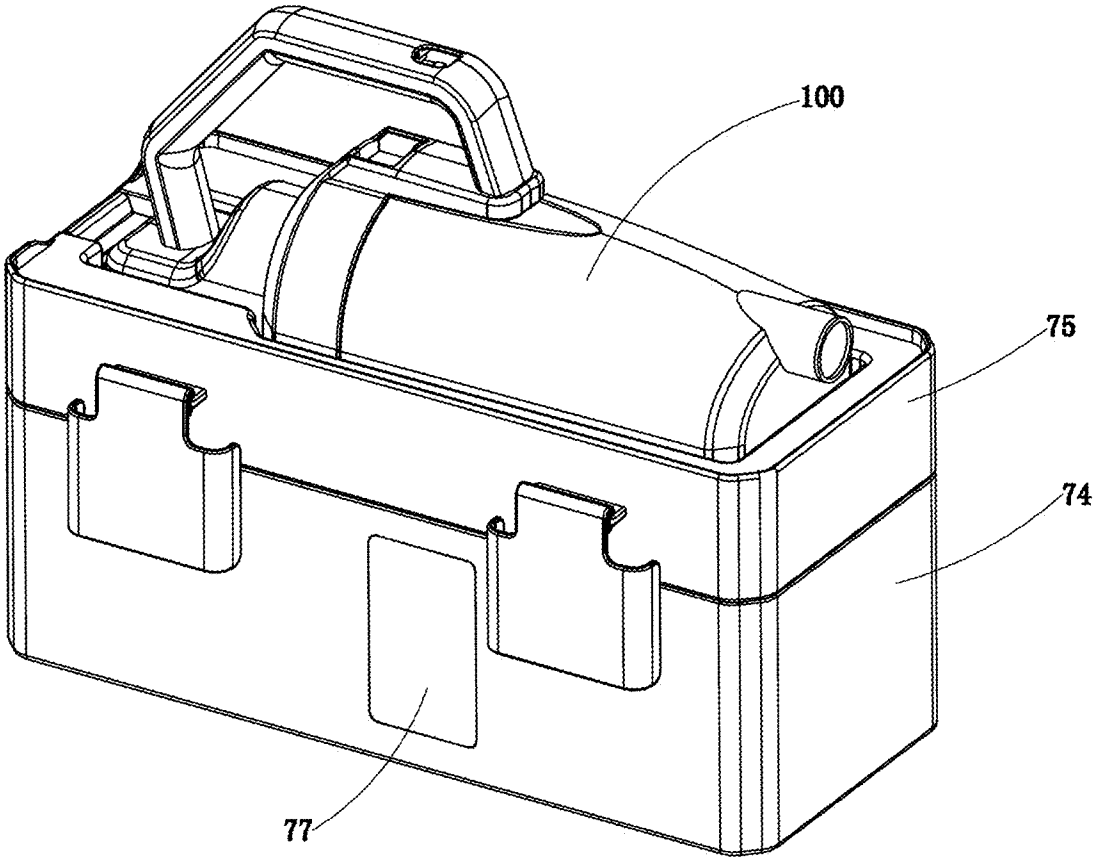
FIG. 25 is a three-dimensional schematic diagram of the first state of the dust bin in the first embodiment in a vacuum cleaner combination according to a first embodiment of the present invention.
Figure 26:
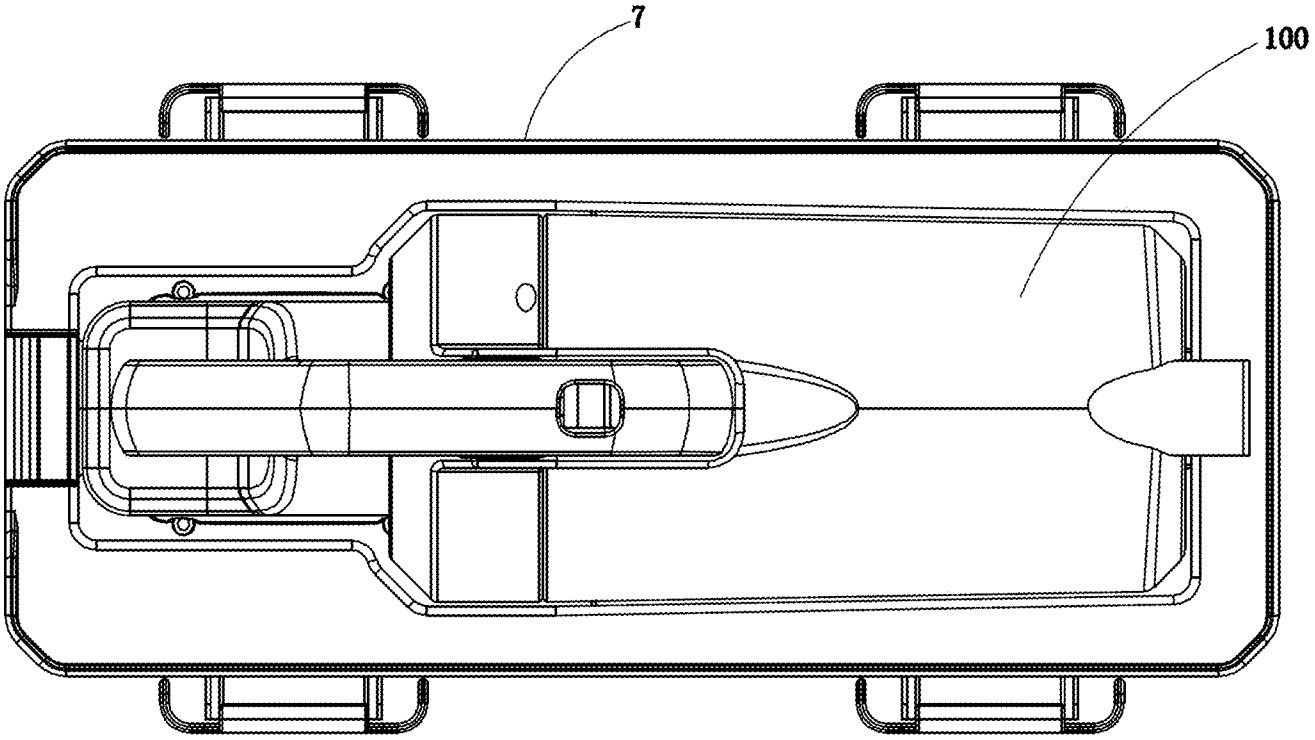
FIG. 26 is a top view of FIG. 25.
Figure 27:
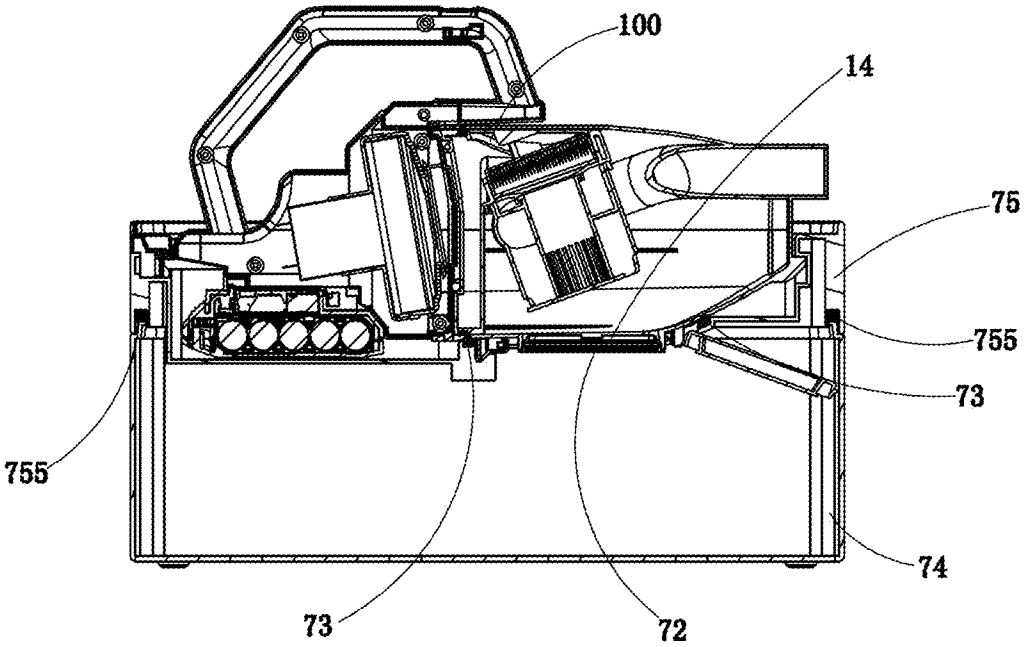
FIG. 27 is a sectional view of FIG. 25.

As shown in FIG. 25 to FIG. 27, the present embodiment discloses a handheld vacuum cleaner combination in a first embodiment. The handheld vacuum cleaner combination includes a dust bin 7 and a handheld vacuum cleaner 100. The handheld vacuum cleaner 100 is the foregoing handheld vacuum cleaner 100 in which the filter apparatus is disposed obliquely. The specific structures of the dust bin 7 and the handheld vacuum cleaner 100 in the first embodiment have been clearly described in the foregoing corresponding embodiment. Details are not described herein again. The joint relationship between the handheld vacuum cleaner 100 and the dust bin 7 is described in detail below by using the handheld vacuum cleaner 100 in the first embodiment as an example. When the handheld vacuum cleaner is mounted on the dust bin 7, the dust cup assembly 1 is at least partially located below an upper surface of the dust bin 7 and is in communication with the dust bin 7. When the handheld vacuum cleaner is joined to the dust bin 7, the dust cup assembly 1 is partially inserted into the dust inlet 72, and a buckle structure is used to fasten the dust cup assembly 1. The dust inlet 72 is recessed inward relative to the dust bin 7, and is in communication with the dust chamber 71 formed inward in the dust bin 7. When the handheld vacuum cleaner is assembled with the dust bin 7, a portion, extending into the dust inlet 72, of the dust cup assembly 1 is disposed in contact with the dust inlet 72. A top contour of the dust bin 7 matches a bottom contour of the handheld vacuum cleaner.

After the dust bin 7 with a split structure is joined to the handheld vacuum cleaner 100, the dust bin 7 has two functions of increasing the dust collection space of the handheld vacuum cleaner 100 and receiving the handheld vacuum cleaner 100. The handheld vacuum cleaner combination in the first embodiment includes three states. The three states differ in the placement position of the handheld vacuum cleaner 100. The three states of the handheld vacuum cleaner combination in the first embodiment are described in detail below. In the different states, the handheld vacuum cleaner 100 has a working state in which the dust cup cover 15 is open and a non-working state in which the dust cup cover 15 is closed.

As shown in FIG. 25 to FIG. 27, a first state is the embodiment in which the dust collection space of the handheld vacuum cleaner 100 is increased. The top portion 75 is located above the base portion 74. The handheld vacuum cleaner 100 is mounted on the top portion 75. The top portion 75 is fastened to the base portion 74 by the buckling structure 76. A space of the base portion 74 is responsible for dust collection. In this case, the base portion 74 may be used to collect dust dumped from the dust outlet 14 of the handheld vacuum cleaner 100, so as to collect all the dust and dump the dust. After the handheld vacuum cleaner 100 is mounted in the dust bin 7, the dust inlet 72 is disposed opposite the dust outlet 14. The first sealing member 73 is mounted on the top portion 75.

In the first state, when the main joint portion 742 is joined to the first joint portion 757, the main joint fastening edge 7421 is combined with the first joint fastening edge 759 to fasten the base portion 74 and the top portion 75 in the circumferential direction, and the first buckling portion 743 is buckled with the first buckling surface 7561 to fasten the base portion 74 and the top portion 75 on the side surface. The first state is a state in which the dust collection space of the handheld vacuum cleaner is increased. To enhance the sealing performance at the circumference, a circumferential sealing ring 755 is disposed between the base portion 74 and the top portion 75 in a circumferential direction in which the main joint portion 742 is joined to the first joint portion 757. In this way, based on the first sealing member 73, the circumferential sealing ring 755 further ensures the sealing effect after the handheld vacuum cleaner is combined with the dust bin 7. Both lateral fastening and circumferential fastening are described in the description of this state. This is only the description of a preferred embodiment of the present embodiment. In other embodiments, as described above, both lateral fastening and circumferential fastening are not necessarily selected. One of the fastening methods may be selected.

In the first state, when the dust bin 7 is buckled with the handheld vacuum cleaner 100 and the abutting portion 53 abuts against and is combined with the latching portion 16 to control the dust cup cover 15 to open. The dust cup cover 15 is driven by a reset structure 20 to automatically open outwards. The dust cup cover 15 automatically opens outward at an angle ranging from 110 degrees to 190 degrees. In this case, the handheld vacuum cleaner 100 is working, and the dust bin 7 is used to increase the dust collection space.

In the first state, a method for mounting the handheld vacuum cleaner 100 may be that one end is first buckled and the other end is then buckled through pressing. Certainly, two ends may be buckled at the same time. As to when the abutting portion 53 abuts against the dust cup cover 15 to enable the dust cup cover 15 to open, in the preferred embodiments of the present embodiment, as soon as the handheld vacuum cleaner 100 is buckled with the dust bin 7 through pressing, the abutting portion 53 is triggered to abut against the dust cup cover 15 to enable the dust cup cover 15 to open. Certainly, in other embodiments, the abutting portion 53 may be triggered a while after or before the handheld vacuum cleaner 100 is buckled. Preferably, the abutting portion 53 is triggered as soon as or a while after the handheld vacuum cleaner 100 is buckled. If the abutting portion 53 is triggered a while before the handheld vacuum cleaner 100 is buckled, dust in the handheld vacuum cleaner 100 tend to fly out through a gap formed due to incomplete combination.

In the first state, when the handheld vacuum cleaner 100 is working, the dust bin 7 is mounted in combination with the handheld vacuum cleaner. In this case, the handle assembly 4 may be used as a handle assembly for a combined structure.

Figure 28:
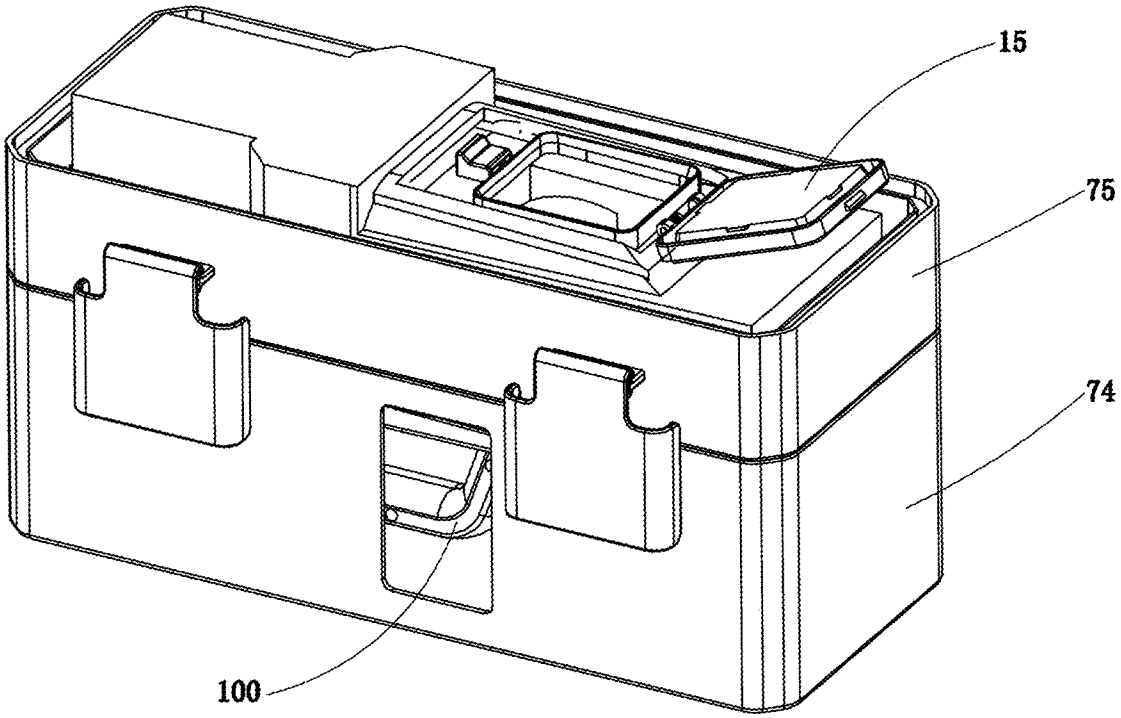
FIG. 28 is a three-dimensional schematic diagram showing that the dust cup cover is open in the second state of the dust bin in the first embodiment in the vacuum cleaner combination according to the first embodiment of the present invention.
Figure 29:
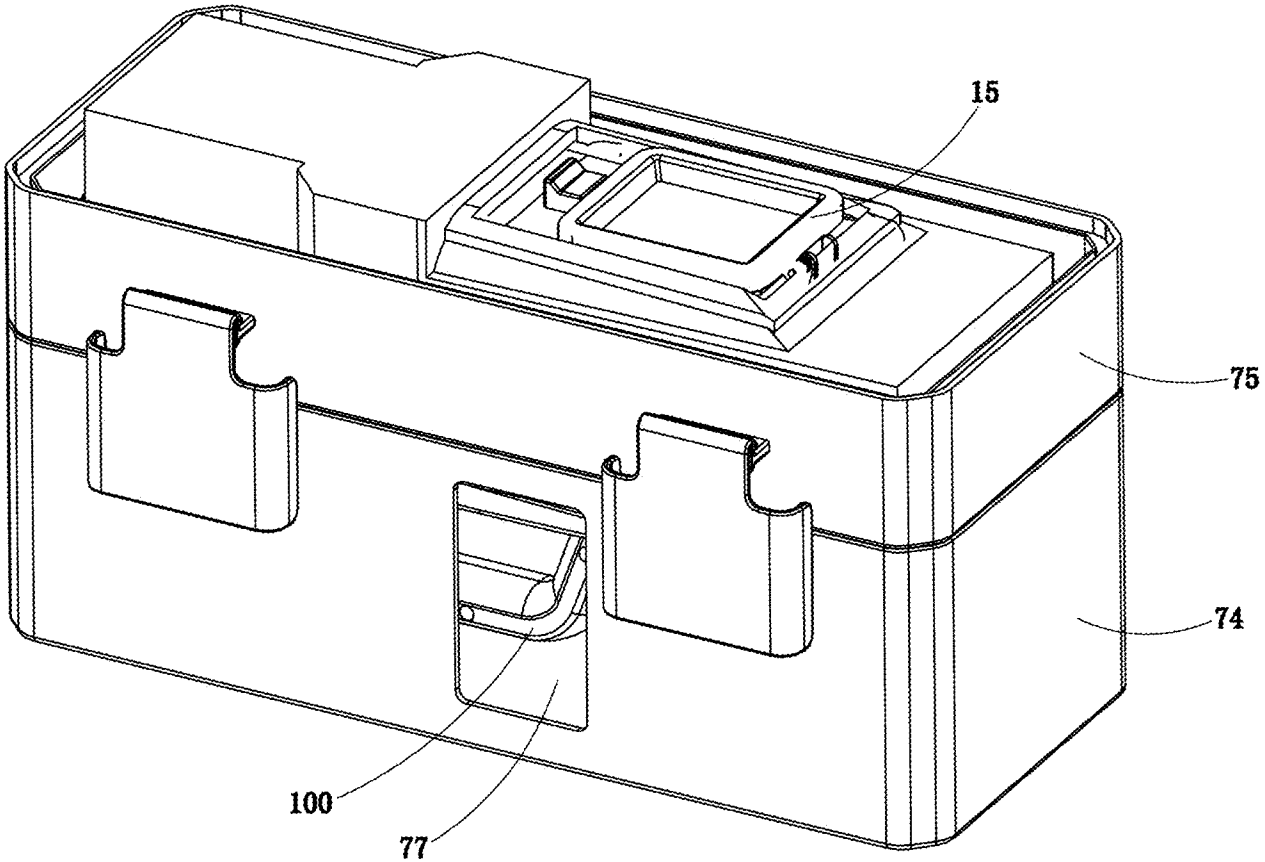
FIG. 29 is a three-dimensional schematic diagram showing that the dust cup cover is closed in the second state of the dust bin in the first embodiment in the vacuum cleaner combination according to the first embodiment of the present invention.
Figure 30:
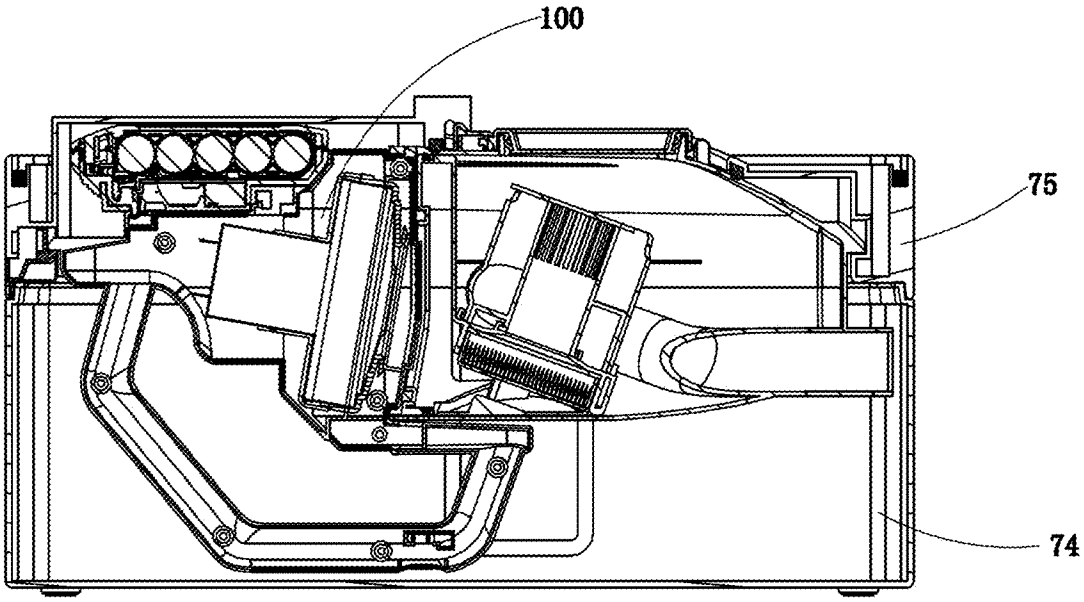
FIG. 30 is a sectional view of FIG. 29.

As shown in FIG. 28 to FIG. 30, a second state is the first embodiment in which the handheld vacuum cleaner 100 is received. In this state, the handheld vacuum cleaner 100 is fastened on the top portion 75. Compared with the first state, the top portion 75 is inverted to enable the handheld vacuum cleaner 100 to be received in the space defined by the base portion 74 and the top portion 75, thereby implementing the receiving of the handheld vacuum cleaner 100.

In the second state, when the main joint portion 742 is joined to the second joint portion 758, the main joint fastening edge 7421 is combined with the second joint fastening edge 760 to fasten the base portion 74 and the top portion 75 in the circumferential direction, and the first buckling portion 743 is buckled with the second buckling surface 7562 to fasten the base portion 74 and the top portion 75 on the side surface. In other embodiments, as described above, both lateral fastening and circumferential fastening are not necessarily selected. One of lateral fastening and circumferential fastening may be selected.

In the second state, the handheld vacuum cleaner 100 is not working, the dust bin 7 is used for storage, but the abutting portion 53 still abuts against and is combined with the latching portion 16 to control the dust cup cover 15 to open. The dust cup cover 15 is driven by a reset structure 20 to automatically open outwards. The dust cup cover 15 automatically opens outward at an angle ranging from 110 degrees to 190 degrees. Certainly, for a better receiving effect, the position regulator as described above may be added in the preferred embodiments, to perform adjustment to control whether the dust cup cover 15 is open. In the preferred embodiments of the present embodiment, when the handheld vacuum cleaner 100 is not working, the dust cup cover 15 is not open.

In the second state, a method for mounting the handheld vacuum cleaner 100 may be that, one end is first buckled, and the other end is then buckled through pressing. Certainly, two ends may be buckled at the same time. As to when the abutting portion 53 abuts against the dust cup cover 15 to enable the dust cup cover 15 to open, in the preferred embodiments of the present embodiment, when the handheld vacuum cleaner 100 is buckled with the dust bin 7 through pressing, the abutting portion 53 is triggered to abut against the dust cup cover 15 to enable the dust cup cover 15 to open. Certainly, in other embodiments, the abutting portion 53 may be triggered a while after or before the handheld vacuum cleaner 100 is buckled. Preferably, the abutting portion 53 is triggered as soon as or a while after the handheld vacuum cleaner 100 is buckled. If the abutting portion 53 is triggered a while before the handheld vacuum cleaner 100 is buckled, dust in the handheld vacuum cleaner 100 tend to fly out through a gap formed due to incomplete combination.

Figure 31:
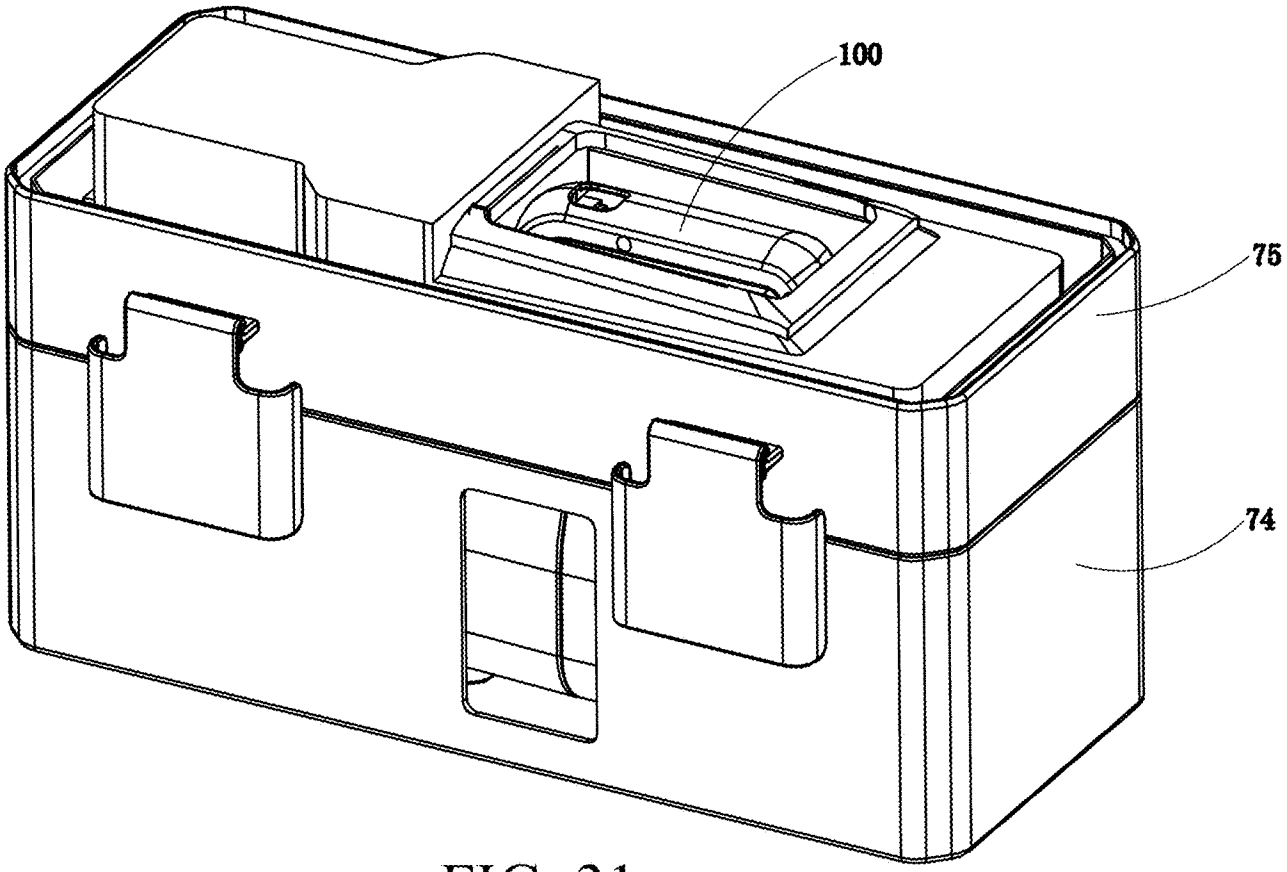
FIG. 31 is a three-dimensional schematic diagram of a third state of the dust bin in the first embodiment in the vacuum cleaner combination according to the first embodiment of the present invention.
Figure 32:
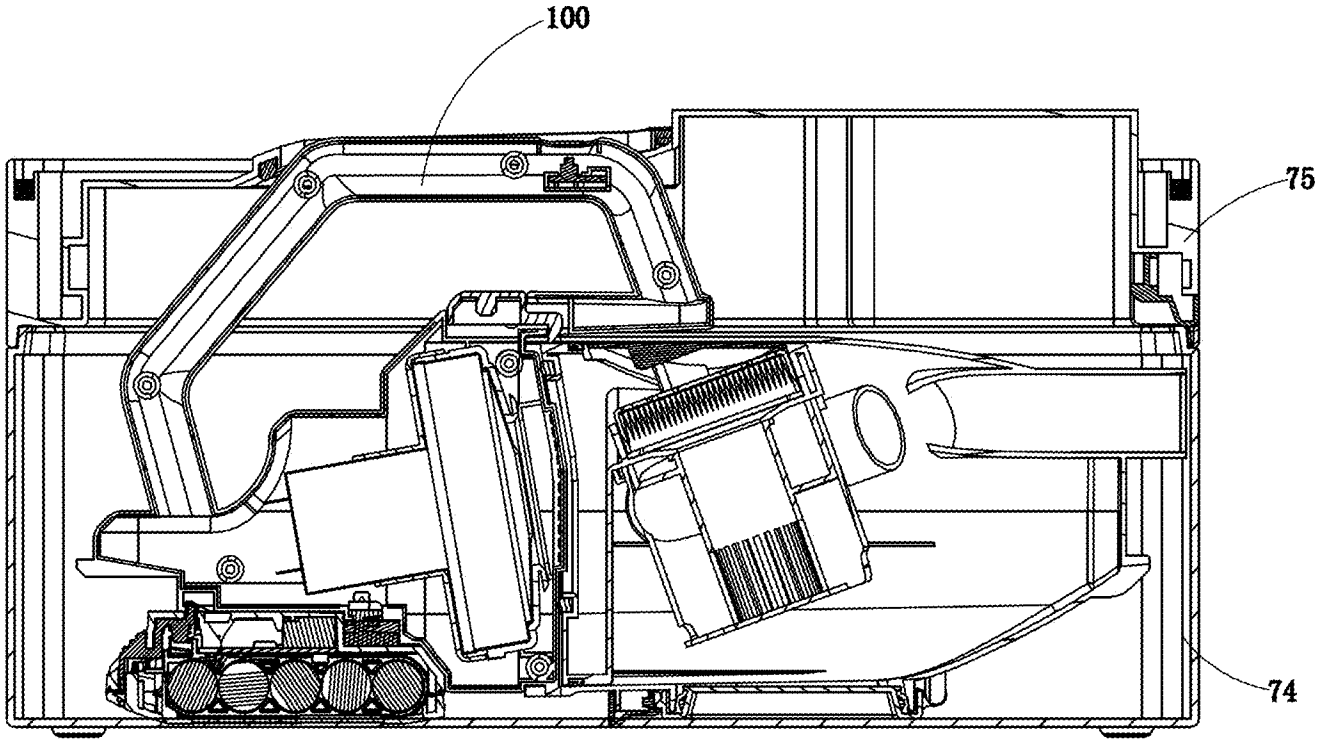
FIG. 32 is a sectional view of FIG. 31.

As shown in FIG. 31 and FIG. 32, a third state is the second embodiment in which the handheld vacuum cleaner 100 is received. In this state, the handheld vacuum cleaner 100 is not fastened on the top portion 75, but is directly placed in the base portion 74 to enable the handheld vacuum cleaner 100 to be received in the space defined by the base portion 74 and the top portion 75, thereby implementing the receiving of the handheld vacuum cleaner 100. If the space of the base portion 74 is enough to receive the handheld vacuum cleaner 100, compared with the first state, the top portion 75 may be not inverted as in the second state. Certainly, if the top portion 75 is inverted as in the second state, the formed space is relatively large. In the case of the receiving mode in the third state, a user may freely select, according to an actual case, the way in which the top portion 75 is joined to the base portion 74. In this state, after the handheld vacuum cleaner 100 is placed in the base portion 74, the handle assembly 4 of the handheld vacuum cleaner 100 is just located on the dust inlet 72, so that a user can grip the handheld vacuum cleaner 100 with the space of the dust inlet 72, to move the handheld vacuum cleaner combination. That is, in the third state, the handheld vacuum cleaner 100 is working, the dust bin 7 is mounted in combination with the handheld vacuum cleaner. In this case, the handle assembly 4 may be used as a handle assembly for a combined structure.

In the third state, the handheld vacuum cleaner 100 is not working, and the dust bin 7 is used for storage. In this case, the handheld vacuum cleaner 100 is just placed in the base portion 74 and is not in contact with the abutting portion 53, so that the dust cup cover 15 is not open. In the preferred embodiments of the present embodiment, when the handheld vacuum cleaner 100 is not working, the dust cup cover 15 is not open.

Figure 33:
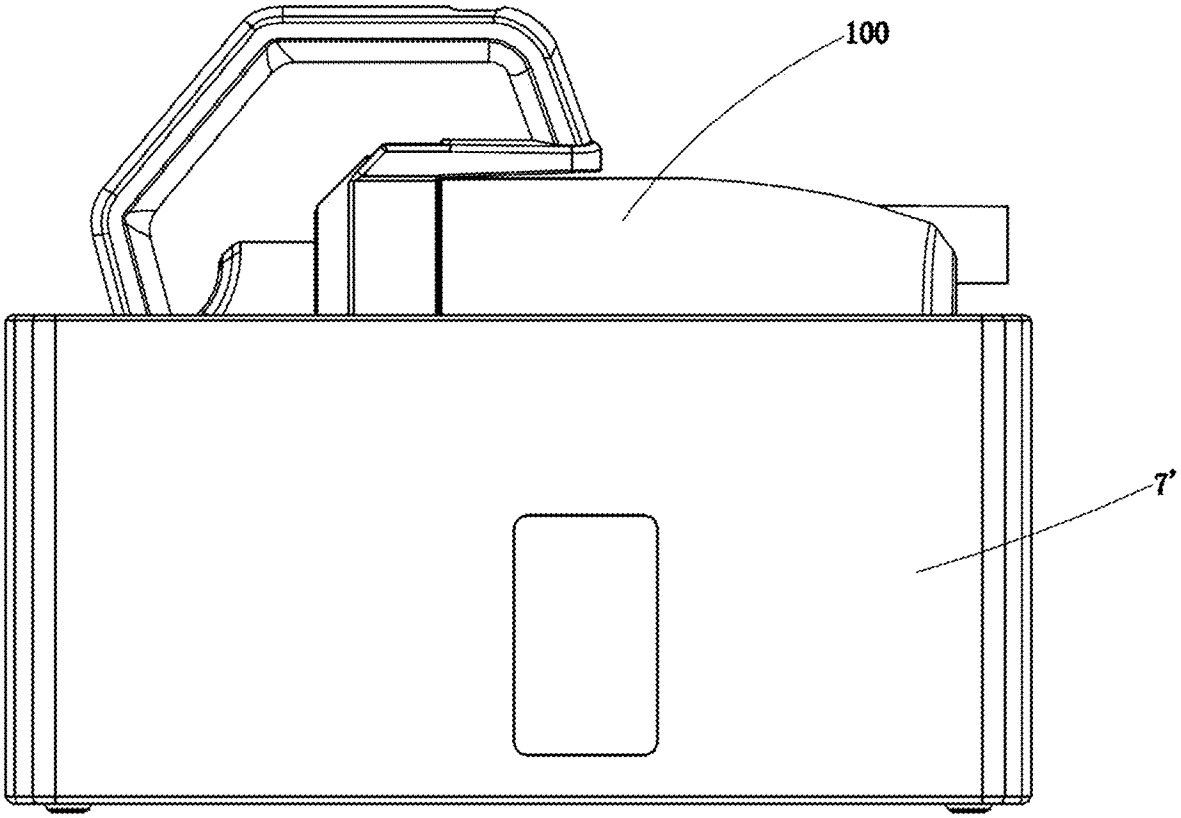
FIG. 33 is a three-dimensional schematic diagram of the dust bin in the second embodiment in a vacuum cleaner combination according to a second embodiment of the present invention.
Figure 34:
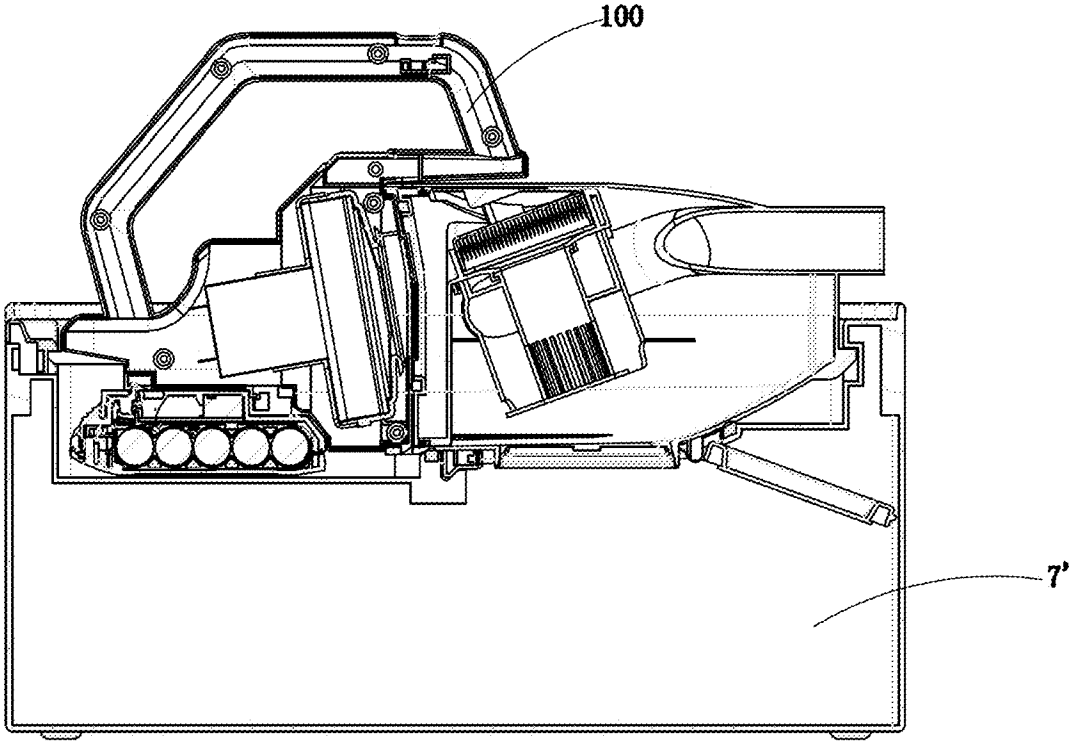
FIG. 34 is a sectional view of FIG. 33.

As shown in FIG. 33 and FIG. 34, the present embodiment discloses a handheld vacuum cleaner combination in a second embodiment. A difference between the handheld vacuum cleaner combination in the second embodiment and the handheld vacuum cleaner combination in the first embodiment is that a dust bin is the dust bin 7' with an integral structure, and other structures are the same as those of the handheld vacuum cleaner combination in the first embodiment. That is, in this embodiment, the filter apparatus is disposed obliquely. Since the dust bin 7' is an integral structure, the handheld vacuum cleaner combination in this embodiment is mainly used to increase the dust collection space of the handheld vacuum cleaner.

Figure 35:
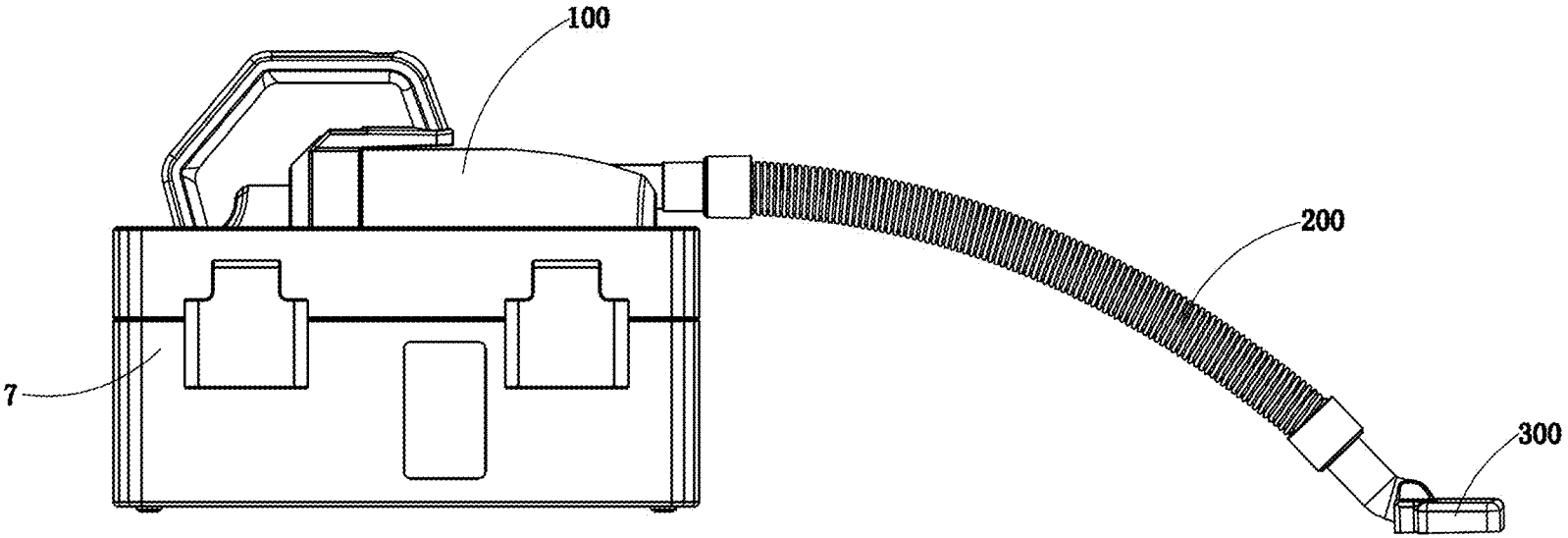
FIG. 35 is a schematic diagram of a working state of the vacuum cleaner combination according to the first embodiment of the present invention.
Figure 36:
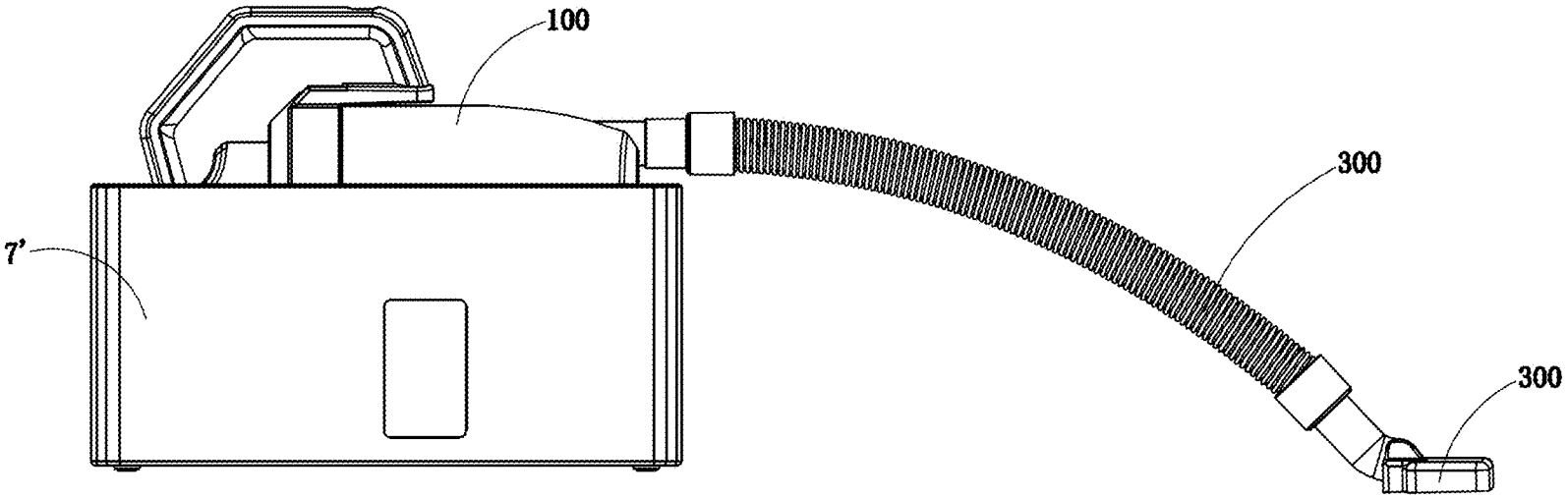
FIG. 36 is a schematic diagram of a working state of the vacuum cleaner combination according to the second embodiment of the present invention.

FIG. 35 and FIG. 36 are respectively a schematic diagram of a working state of the vacuum cleaner combination according to the first embodiment of the present invention and a schematic diagram of a working state of the vacuum cleaner combination according to the second embodiment of the present invention. In this case, the dust bin is used to increase the dust collection space, and the handheld vacuum cleaner is working. The handheld vacuum cleaner combination is connected to the extension pipe 200 and the cleaner head 300. One end of the extension pipe 200 is connected to the dust suction inlet of the handheld vacuum cleaner 100. The other end of the extension pipe 200 is connected to the cleaner head 300. The cleaner head 300 is provided with a suction passage (not shown in the figure) in communication with the inside of the extension pipe 200, to allow dust to enter the extension pipe 200 through the suction passage and then enter the handheld vacuum cleaner 100 along the extension pipe 200. The extension pipe 200 may be a rigid pipe, a flexible pipe, a combination of a flexible pipe and a rigid pipe or a telescopic pipe. In a specific work application, the user can select an accessory according to an actual application scenario. The extension pipe 200 in FIG. 12 is a rigid pipe.

Figure 37:
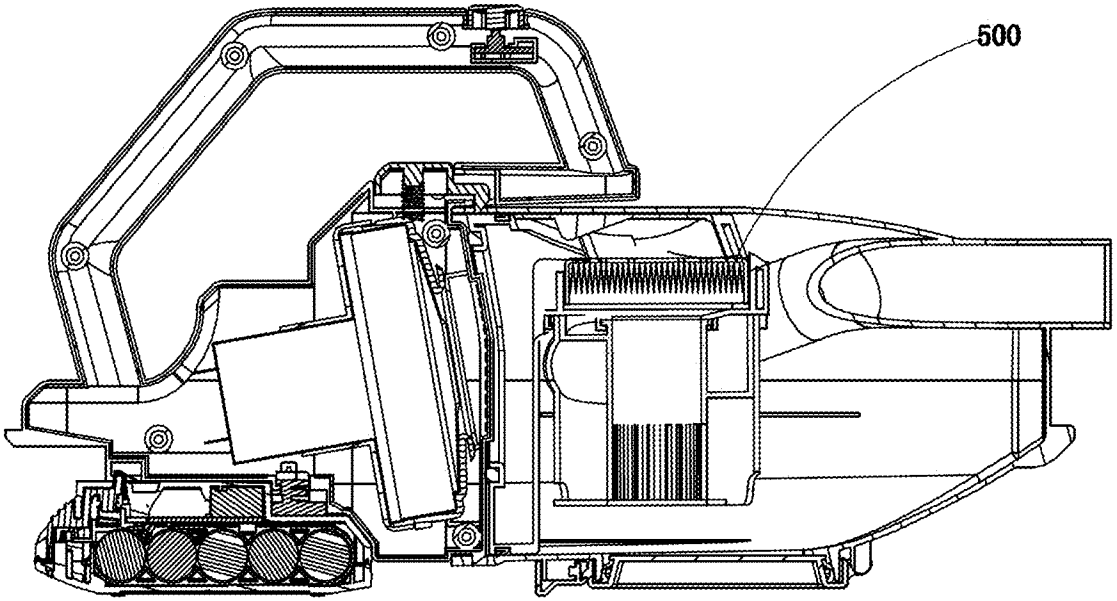
FIG. 37 is a schematic diagram of a handheld vacuum cleaner according to a second embodiment of the present invention.
Figure 38:
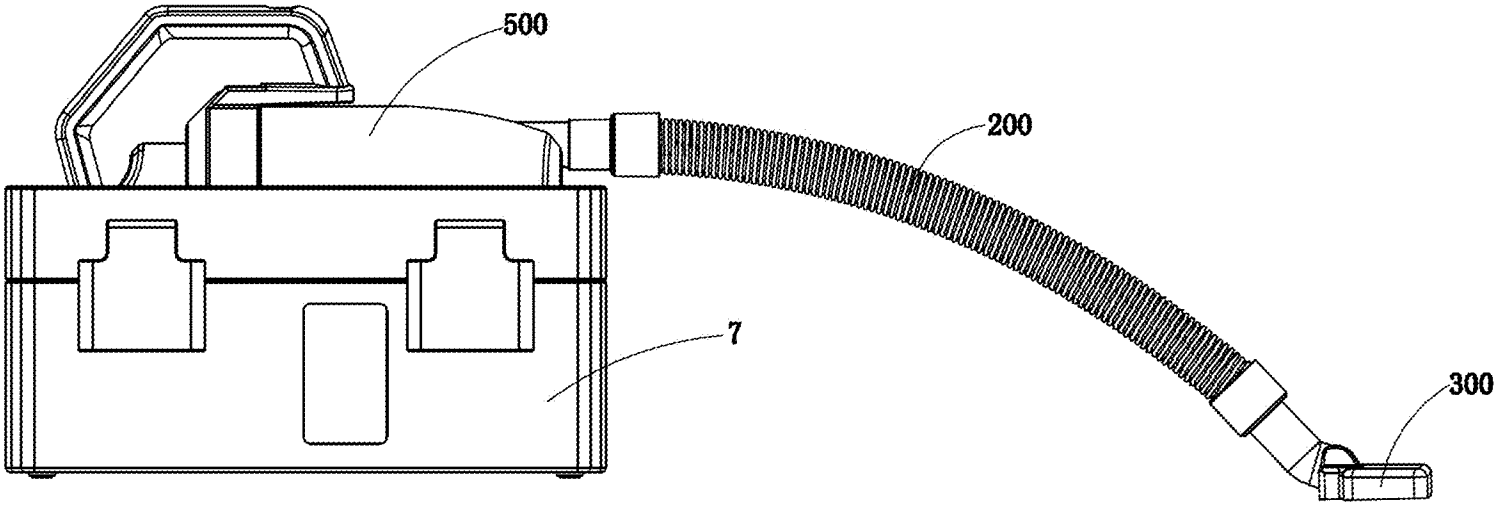
FIG. 38 is a schematic diagram of a working state of a vacuum cleaner combination according to a third embodiment of the present invention.

As shown in FIG. 37 and FIG. 38, the present embodiment discloses a handheld vacuum cleaner combination in a third embodiment. The structure of the dust bin 7 of the handheld vacuum cleaner combination in the second embodiment is the same as that of the handheld vacuum cleaner combination in the first embodiment. That is, the dust bin is the foregoing dust bin with a split structure. A difference between the handheld vacuum cleaner combination in the third embodiment and the handheld vacuum cleaner combination in the first embodiment is that a filter apparatus of a handheld vacuum cleaner 500 is not disposed obliquely.

Figure 39:
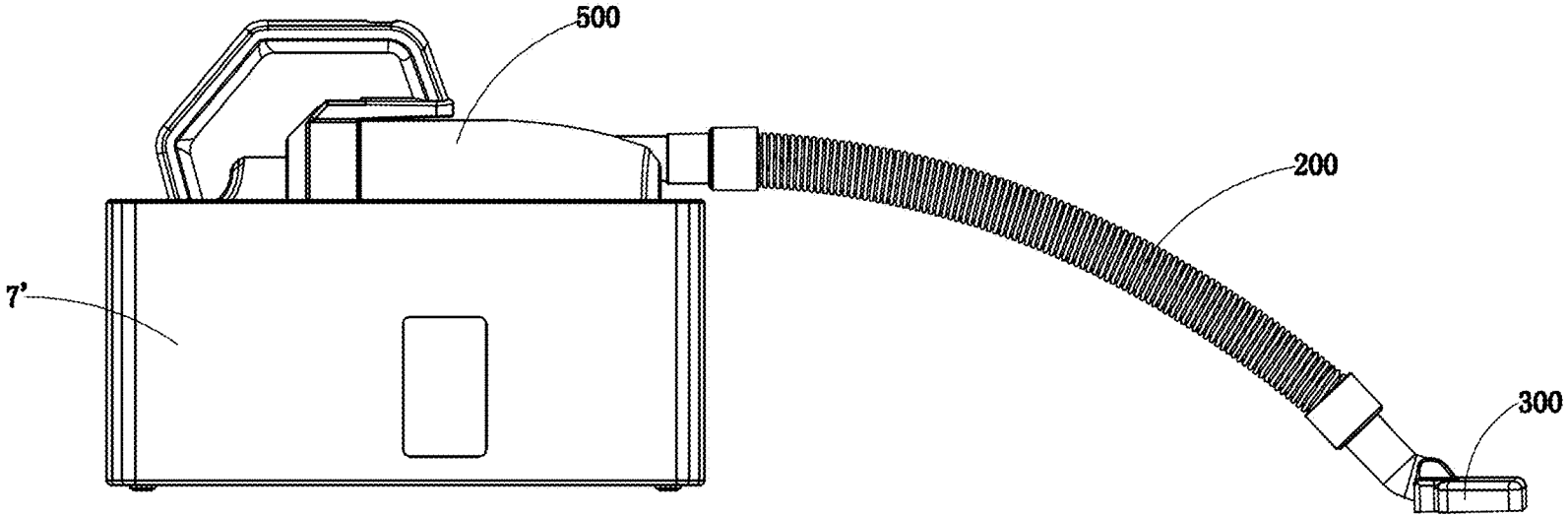
FIG. 39 is a schematic diagram of a working state of a vacuum cleaner combination according to a fourth embodiment of the present invention.

As shown in FIG. 39, the present embodiment discloses a handheld vacuum cleaner combination in a fourth embodiment. Differences between the handheld vacuum cleaner combination in the fourth embodiment and the handheld vacuum cleaner combination in the third embodiment are that a dust bin is the dust bin 7', that is, the dust bin is the foregoing dust bin with an integral structure, and the filter apparatus is not disposed obliquely. Since the dust bin 7' is an integral structure, the handheld vacuum cleaner combination in this embodiment is mainly used to increase the dust collection space of the handheld vacuum cleaner.

Figure 40:
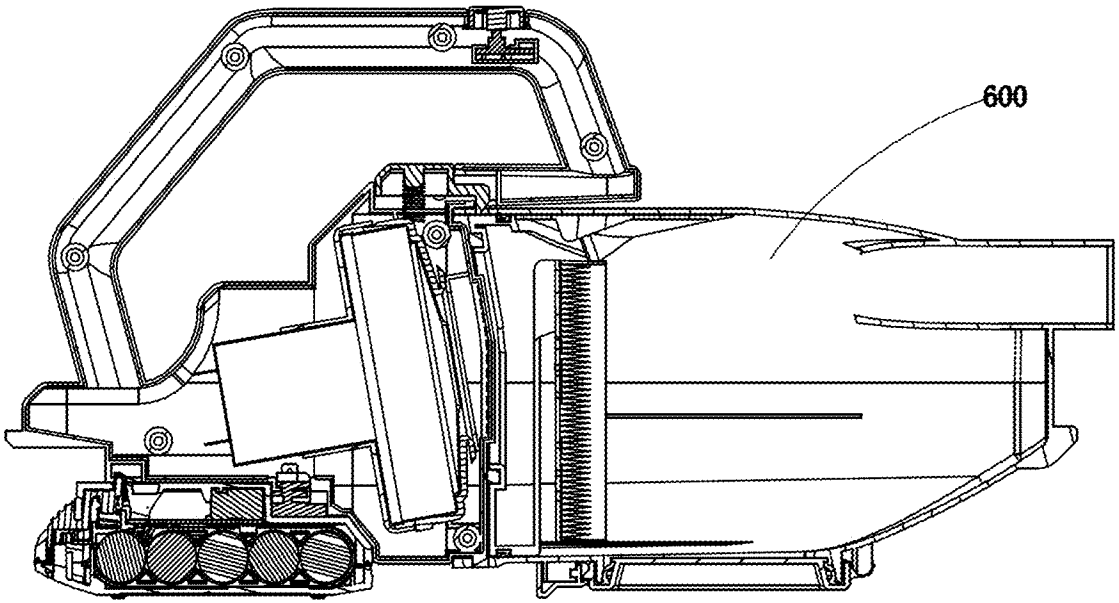
FIG. 40 is a schematic diagram of a handheld vacuum cleaner according to a third embodiment of the present invention.
Figure 41:
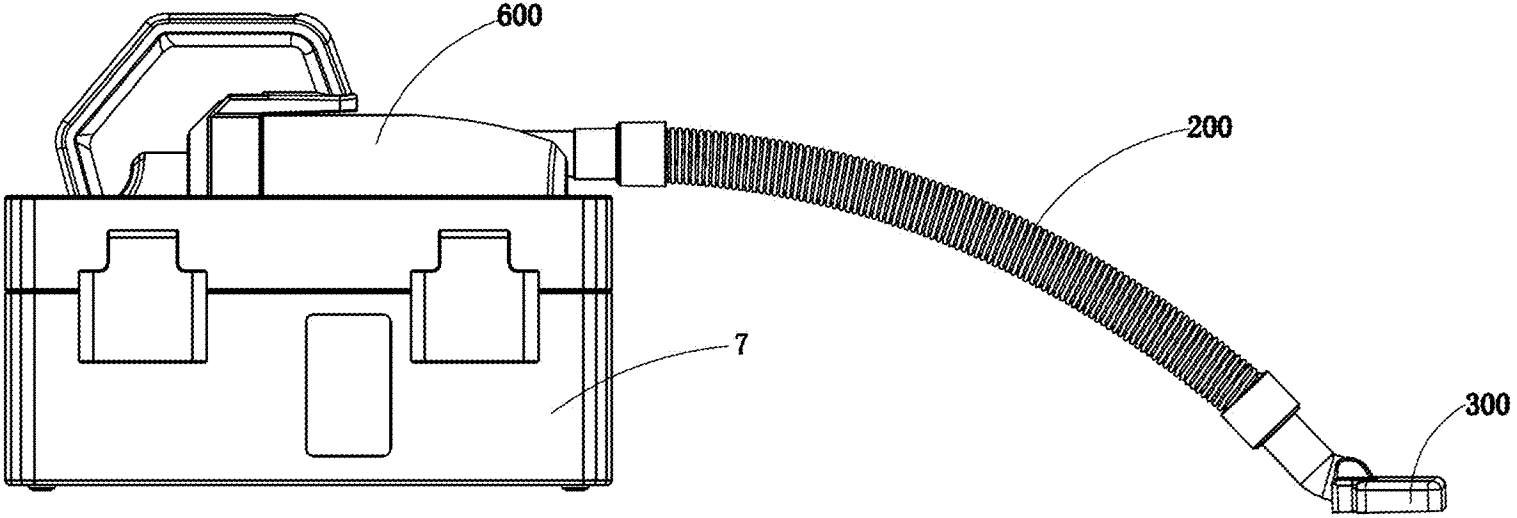
FIG. 41 is a schematic diagram of a working state of a vacuum cleaner combination according to a fifth embodiment of the present invention.

As shown in FIG. 40 and FIG. 41, the present embodiment discloses a handheld vacuum cleaner combination in a fifth embodiment. Differences between the handheld vacuum cleaner combination in the fifth embodiment and the handheld vacuum cleaner combination in the first embodiment are that there is no cyclonic separation structure inside the handheld vacuum cleaner and only a filter is disposed in the handheld vacuum cleaner. That is, in this embodiment, the dust bin is the foregoing dust bin with a split structure, and the filter apparatus is not a cyclonic separation structure but instead is only an ordinary filtering structure, for example, a HEPA filter.

Figure 42:
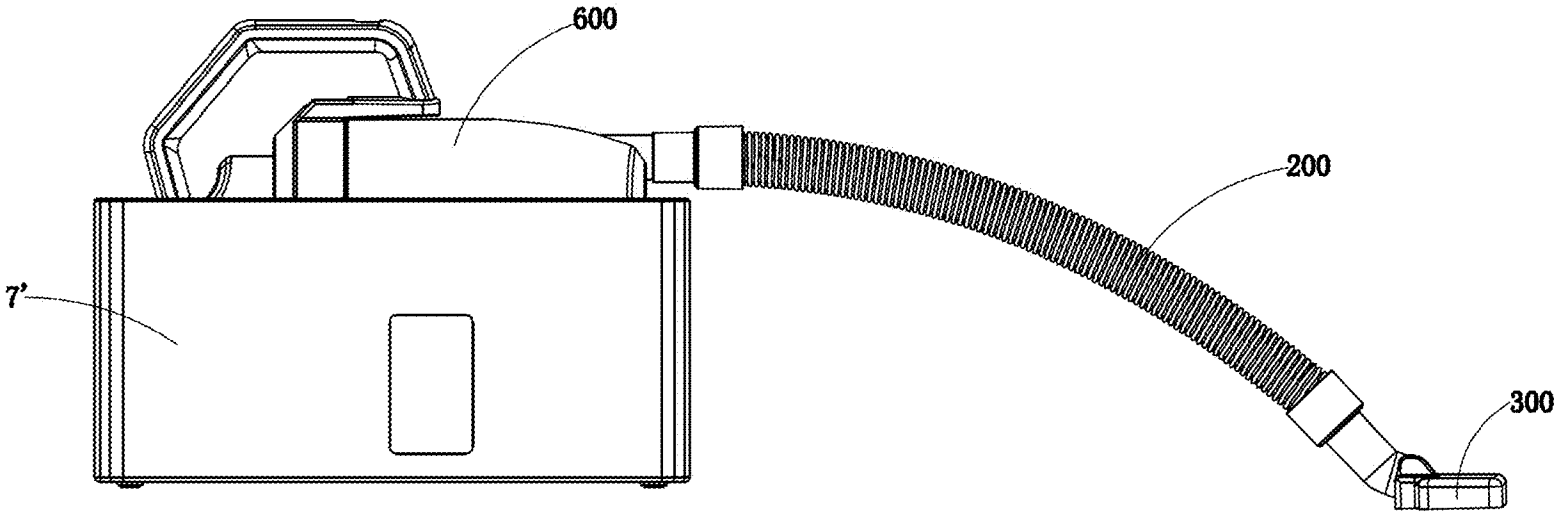
FIG. 42 is a schematic diagram of a working state of a vacuum cleaner combination according to a sixth embodiment of the present invention.

As shown in FIG. 42, the present embodiment discloses a handheld vacuum cleaner combination in a sixth embodiment. A difference between the handheld vacuum cleaner combination in the sixth embodiment and the handheld vacuum cleaner combination in the fifth embodiment is that a dust bin is the dust bin 7'. That is, in this embodiment, the dust bin is the foregoing dust bin with an integral structure, and the filter apparatus is not a cyclonic separation structure but instead is only an ordinary filtering structure, for example, a HEPA filter. The handheld vacuum cleaner combination in this embodiment is mainly used to increase the dust collection space of the handheld vacuum cleaner.

Figure 43:
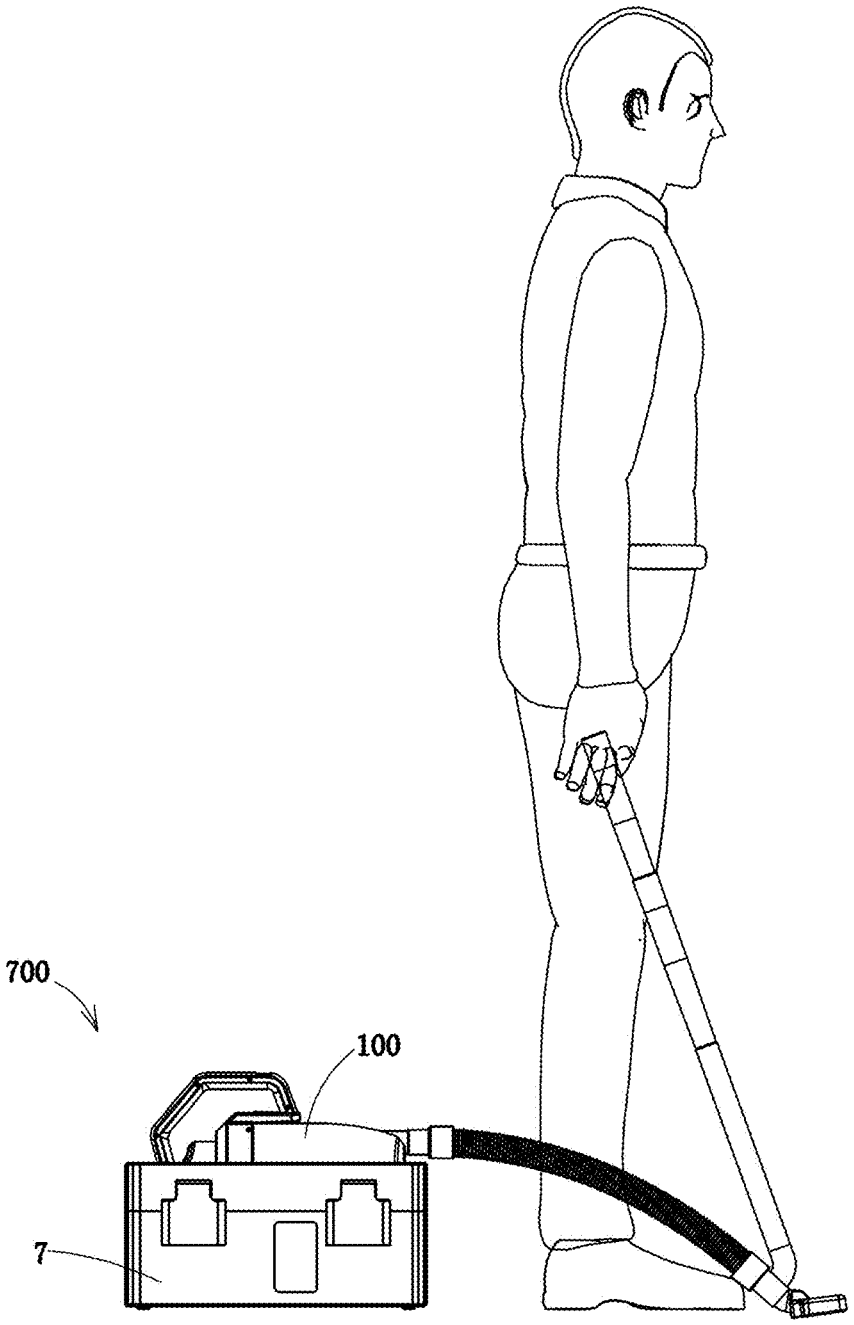
FIG. 43 is a working schematic diagram of a stick vacuum cleaner according to a second embodiment of the present invention.

As shown in FIG. 43, the present embodiment further discloses a stick vacuum cleaner 700 in a second embodiment. A difference between the stick vacuum cleaner 700 in the second embodiment and the stick vacuum cleaner 400 in the first embodiment is that the structure of the dust bin 7 is increased. The dust bin 7 is a split structure. The stick vacuum cleaner 700 in the second embodiment includes the handheld vacuum cleaner combination in the foregoing first embodiment. A handheld vacuum cleaner is the handheld vacuum cleaner 100 in the embodiment in which the filter apparatus is disposed obliquely.

Figure 44:
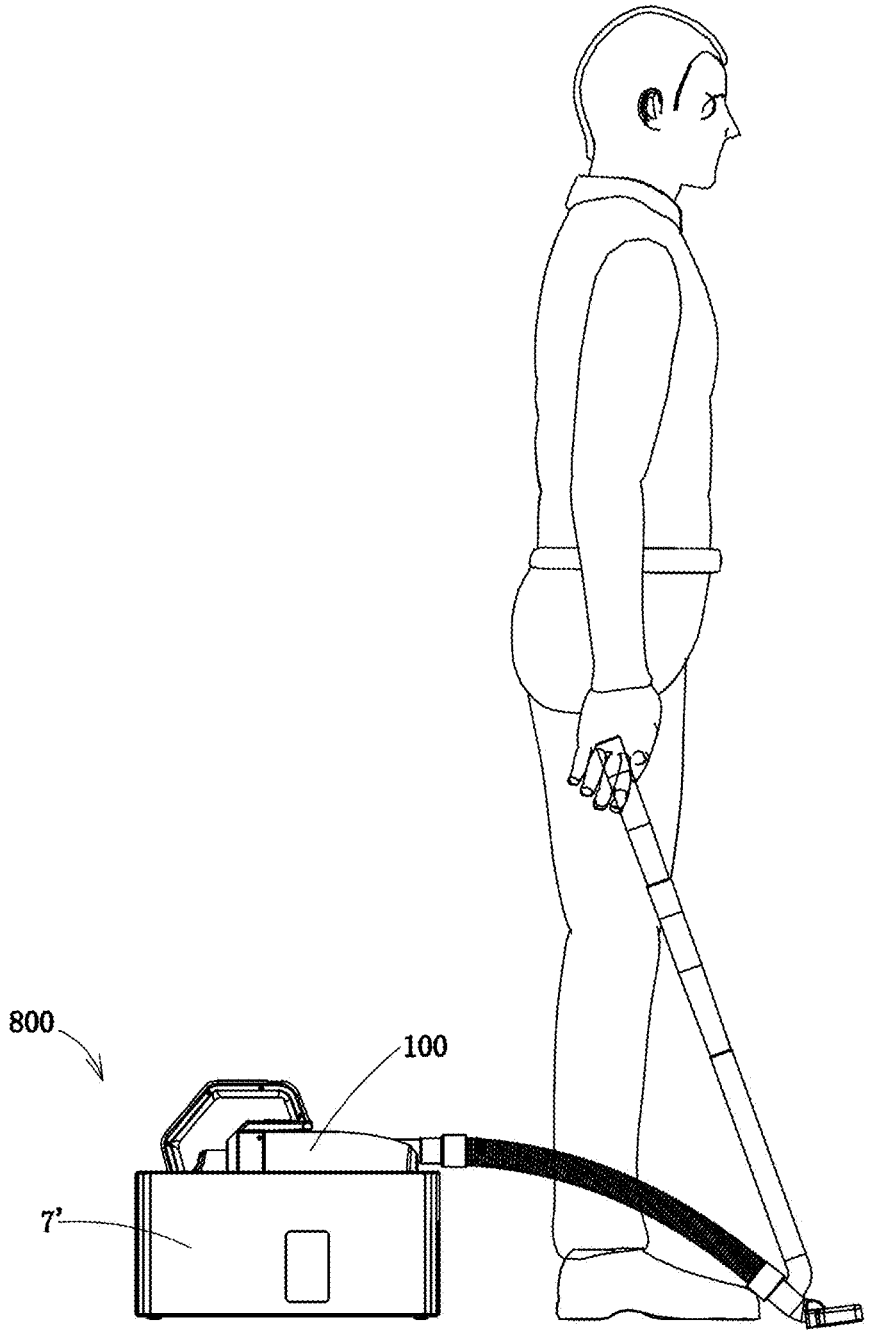
FIG. 44 is a working schematic diagram of a stick vacuum cleaner according to a third embodiment of the present invention.

As shown in FIG. 44, the present embodiment further discloses a stick vacuum cleaner 800 in a third embodiment. A difference between the stick vacuum cleaner 800 in the third embodiment and the stick vacuum cleaner 700 in the second embodiment is that a dust bin is the dust bin 7', that is, the dust bin 7' with an integral structure. The stick vacuum cleaner 800 in the third embodiment includes the handheld vacuum cleaner combination in the foregoing second embodiment. A handheld vacuum cleaner is the handheld vacuum cleaner 100 in the embodiment in which the filter apparatus is disposed obliquely.

Figure 45:
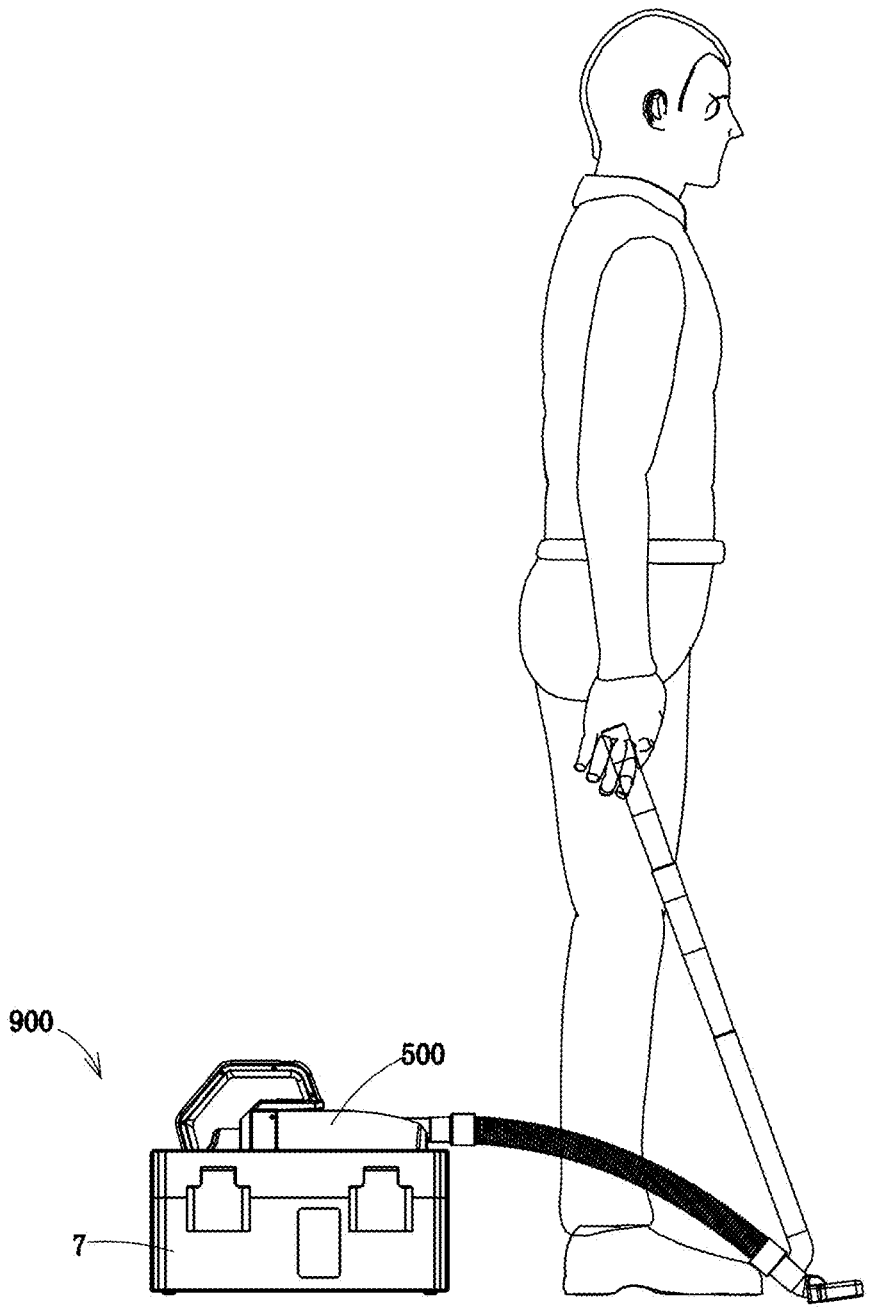
FIG. 45 is a working schematic diagram of a stick vacuum cleaner according to a fourth embodiment of the present invention.

As shown in FIG. 45, the present embodiment further discloses a stick vacuum cleaner 900 in a fourth embodiment. A difference between the stick vacuum cleaner 900 in the fourth embodiment and the stick vacuum cleaner 700 in the second embodiment is that a filter apparatus is not disposed obliquely. The stick vacuum cleaner 900 in the fourth embodiment includes the handheld vacuum cleaner combination in the foregoing third embodiment. A handheld vacuum cleaner is the handheld vacuum cleaner 500 in the embodiment in which the filter apparatus is not disposed obliquely. A dust bin is the dust bin 7 with a split structure.

Figure 46:
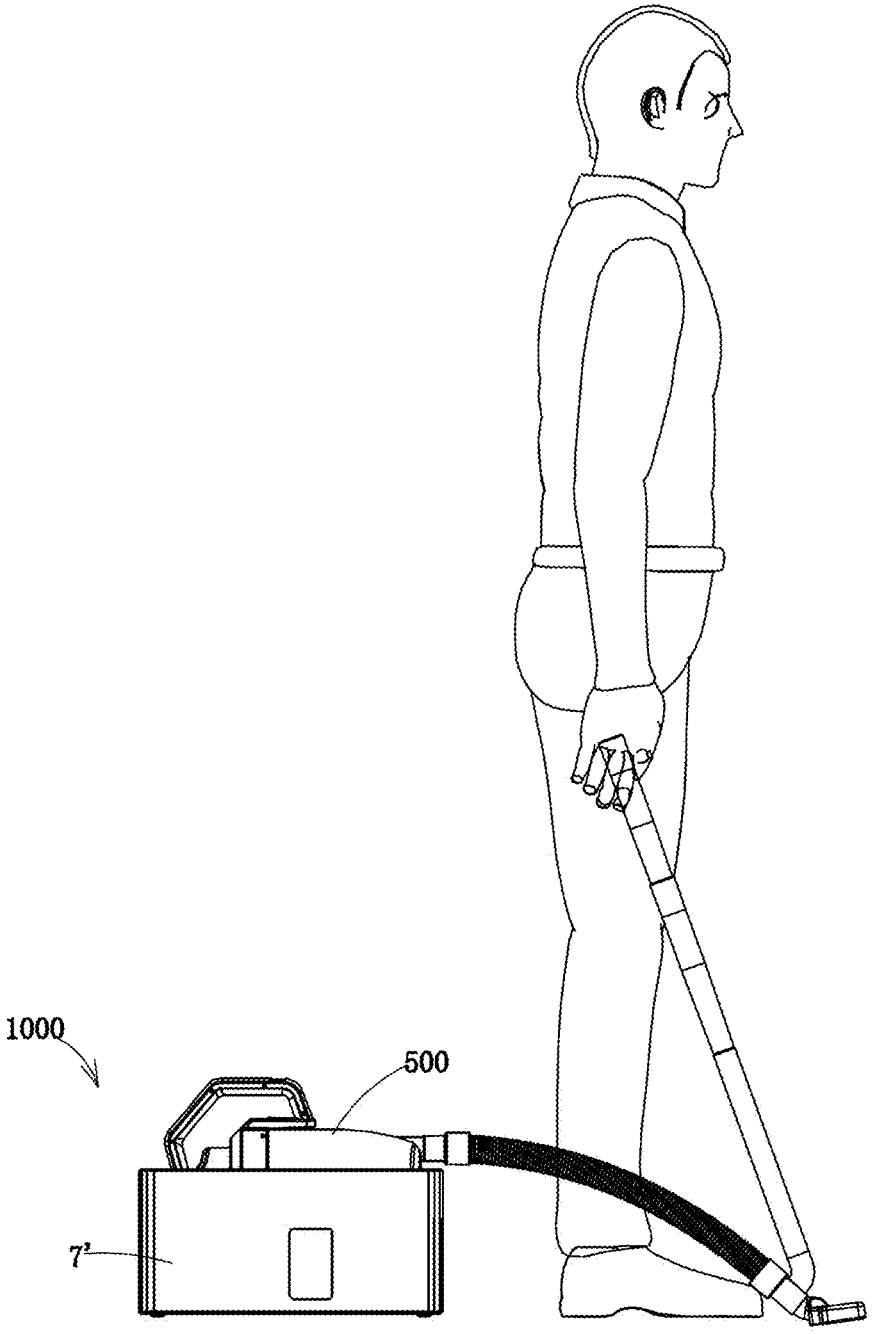
FIG. 46 is a working schematic diagram of a stick vacuum cleaner according to a fifth embodiment of the present invention.

As shown in FIG. 46, the present embodiment further discloses a stick vacuum cleaner 1000 in a fifth embodiment. A difference between the stick vacuum cleaner 1000 in the fifth embodiment and the stick vacuum cleaner 900 in the fourth embodiment is that a dust bin is the dust bin 7', that is, the dust bin 7' with an integral structure. The filter apparatus is not disposed obliquely, and the stick vacuum cleaner 1000 in the fifth embodiment includes the handheld vacuum cleaner combination in the foregoing fourth embodiment. A handheld vacuum cleaner is the handheld vacuum cleaner 500 in the embodiment in which the filter apparatus is not disposed obliquely.

Figure 47:
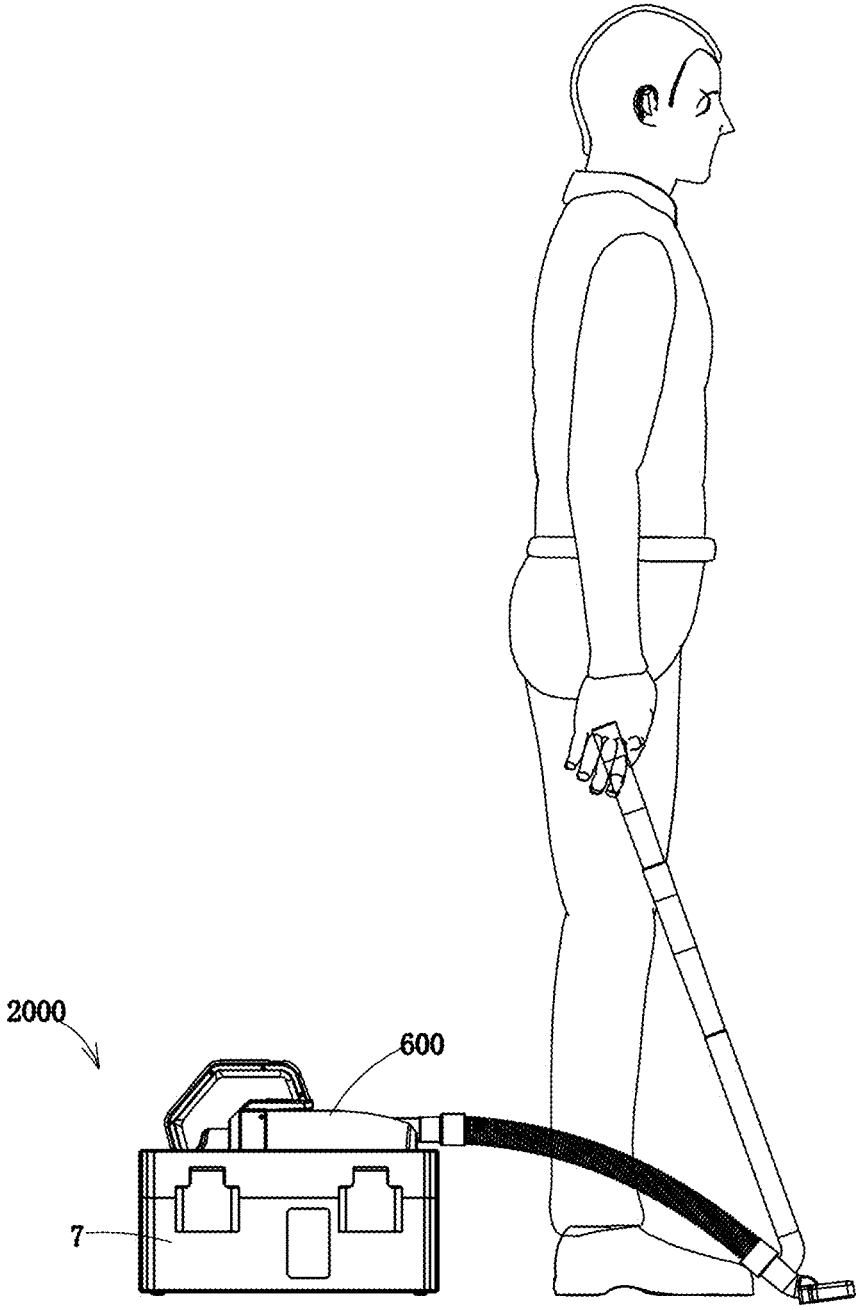
FIG. 47 is a working schematic diagram of a stick vacuum cleaner according to a sixth embodiment of the present invention.

As shown in FIG. 47, the present embodiment further discloses a stick vacuum cleaner 2000 in a sixth embodiment. A difference between the stick vacuum cleaner 2000 in the sixth embodiment and the stick vacuum cleaner 900 in the fourth embodiment is that there is no cyclonic separation structure, and only a filtering structure, for example, a HEPA filter or another filtering structure with a simple filtering function, is disposed. The stick vacuum cleaner 2000 in the sixth embodiment includes the handheld vacuum cleaner combination in the foregoing fifth embodiment. A handheld vacuum cleaner is a handheld vacuum cleaner 600 in which a filter apparatus is an ordinary filter apparatus. A dust bin is the dust bin 7 with a split structure.

Figure 48:
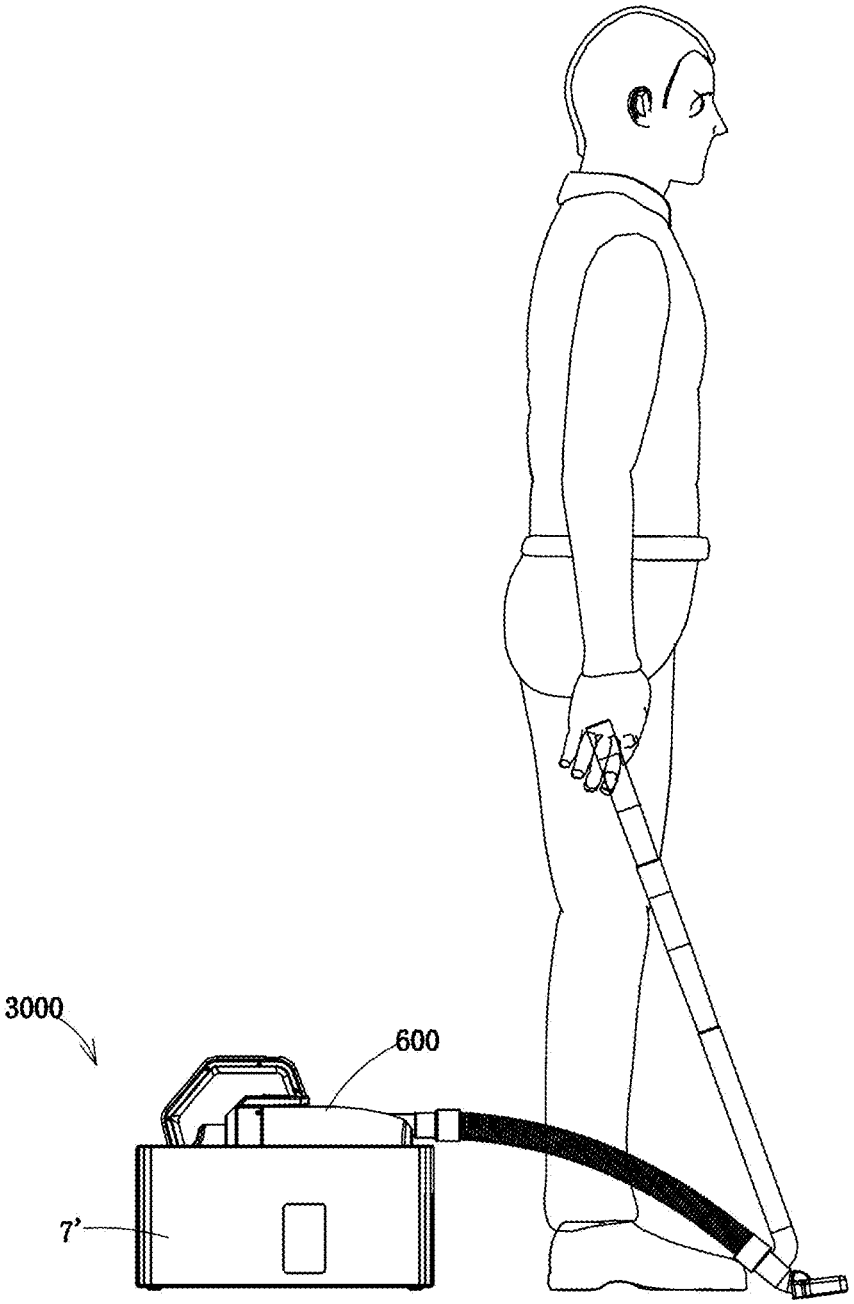
FIG. 48 is a working schematic diagram of a stick vacuum cleaner according to a seventh embodiment of the present invention.
Figure 49:
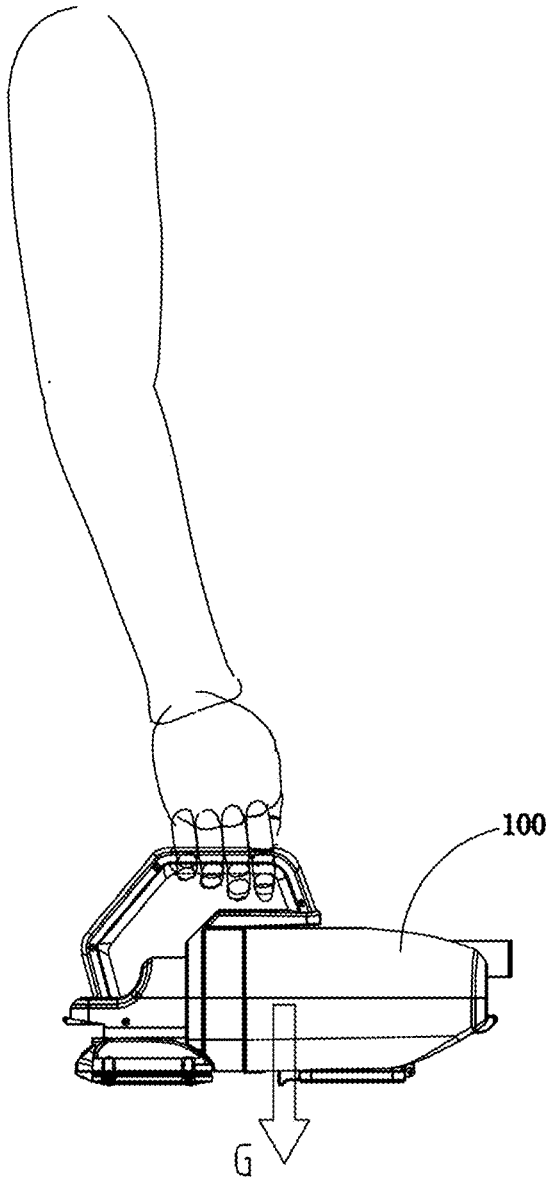
FIG. 49 is a schematic diagram of a first gripping scenario of a handle assembly of the handheld vacuum cleaner according to the first embodiment of the present invention.
Figure 50:
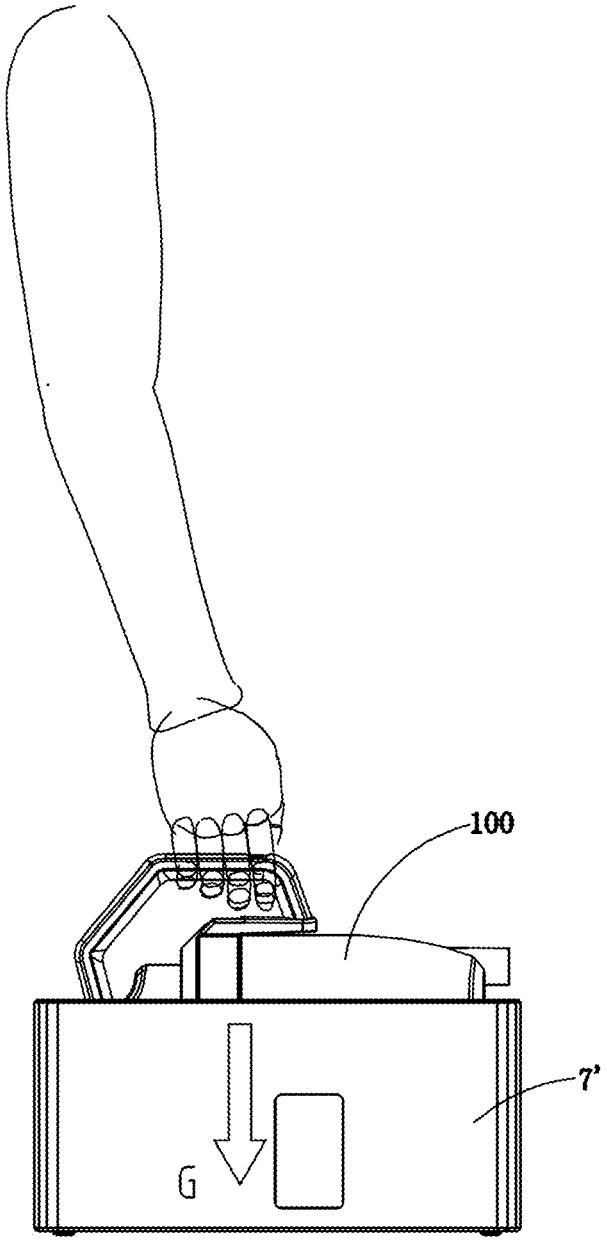
FIG. 50 is a schematic diagram of a second gripping scenario of a handle assembly of the handheld vacuum cleaner according to the first embodiment of the present invention.
Figure 51:
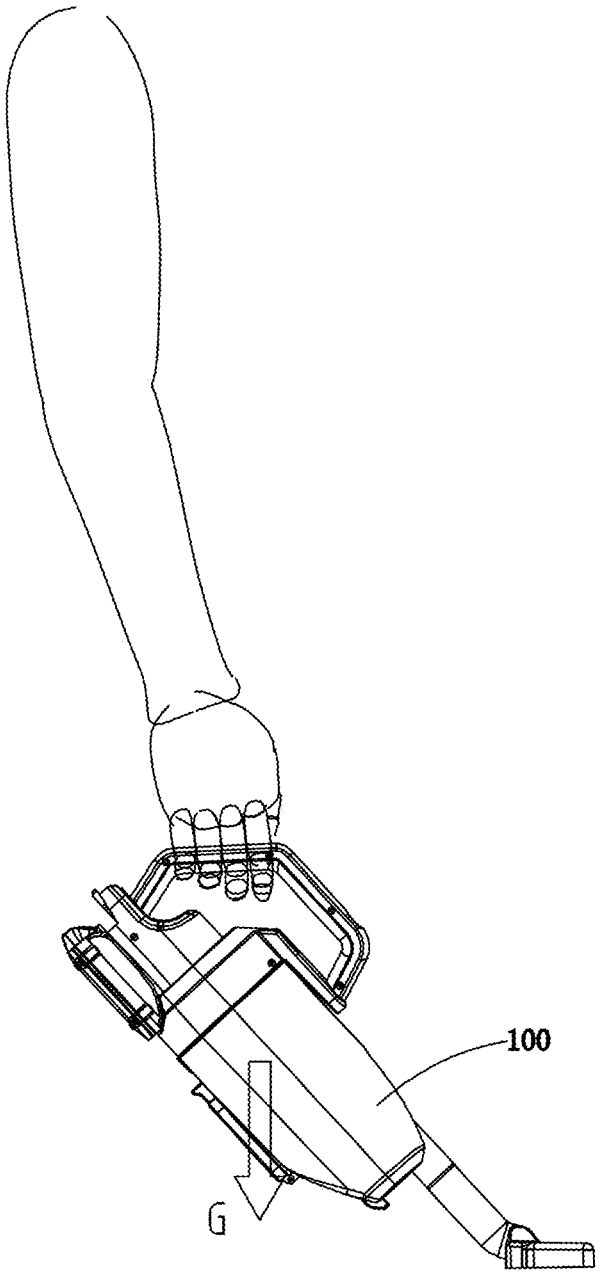
FIG. 51 is a schematic diagram of a third gripping scenario of a handle assembly of the handheld vacuum cleaner according to the first embodiment of the present invention.
Figure 52:
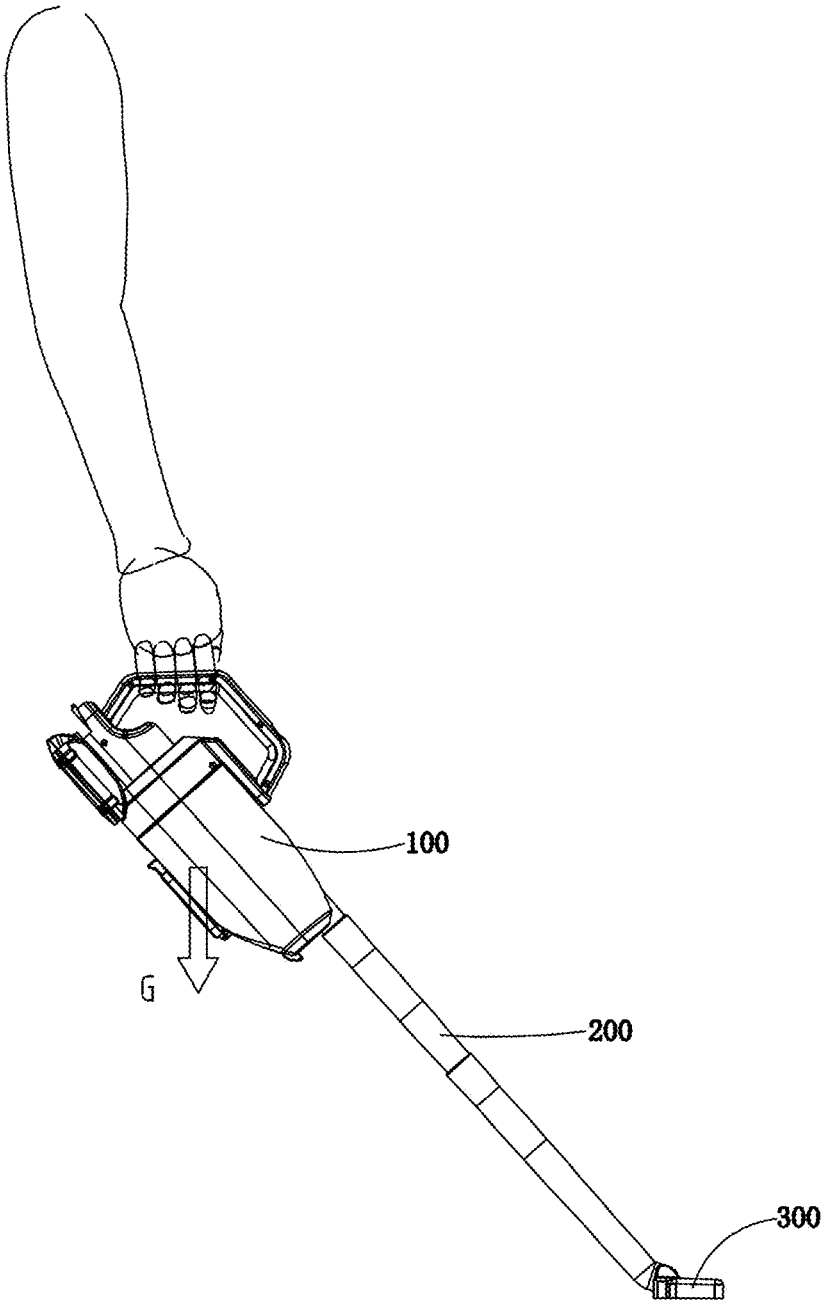
FIG. 52 is a schematic diagram of a fourth gripping scenario of a handle assembly of the handheld vacuum cleaner according to the first embodiment of the present invention.

As shown in FIG. 48, the present embodiment further discloses a stick vacuum cleaner 3000 in a seventh embodiment. A difference between the stick vacuum cleaner 3000 in the seventh embodiment and the stick vacuum cleaner 2000 in the sixth embodiment is that a dust bin is the dust bin 7', that is, the dust bin 7' with an integral structure. There is no cyclonic separation structure, and only a filtering structure, for example, a HEPA filter or another filtering structure with a simple filtering function, is disposed. The stick vacuum cleaner 3000 in the seventh embodiment includes the handheld vacuum cleaner combination in the foregoing sixth embodiment. The handheld vacuum cleaner is the handheld vacuum cleaner 600 in which the filter apparatus is an ordinary filter apparatus.

It needs to be noted that, in all the embodiments of the present invention, the direction "front" can be understood as a direction of the dust suction inlet of the handheld vacuum cleaner during actual use, and an opposite direction of "front" is defined as "rear". The direction "up" can be understood as a direction in which the dust outlet of the handheld vacuum cleaner is open during actual use, and an opposite direction of "above" is defined as "down".

Figure 53:
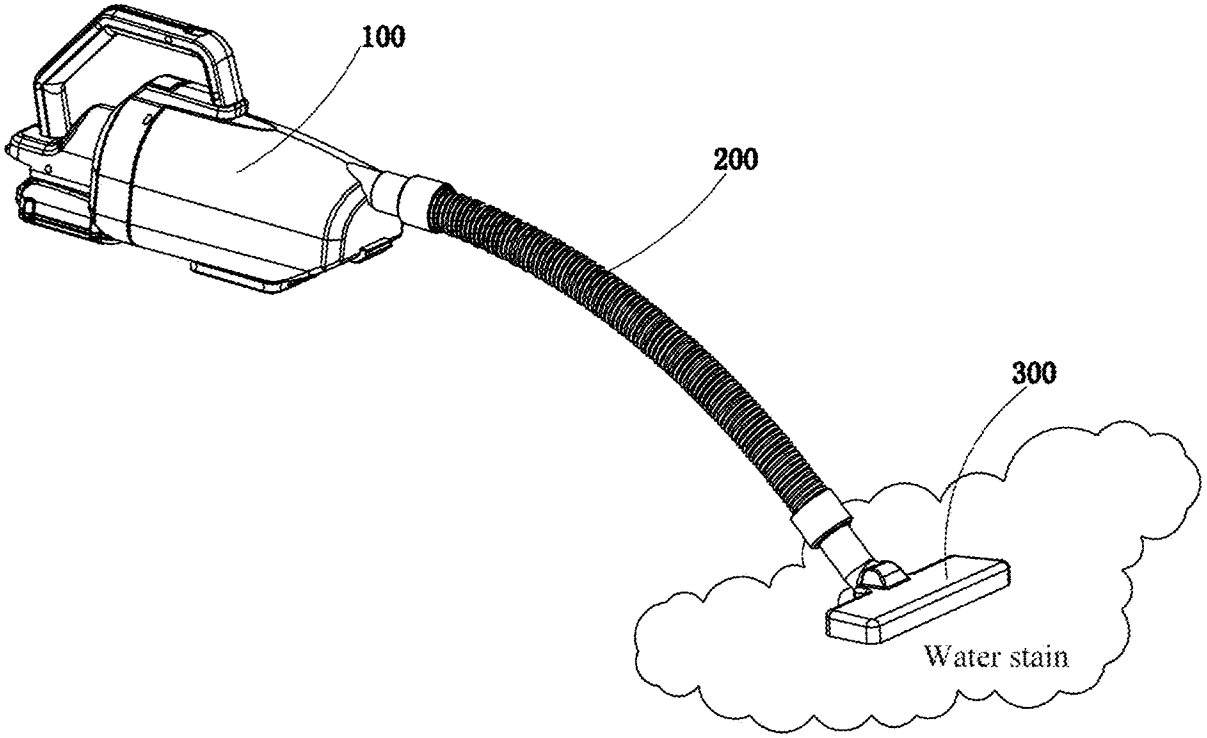
FIG. 53 is a schematic diagram of the handheld vacuum cleaner sucking water according to the first embodiment of the present invention.

As shown in FIG. 53, the handheld vacuum cleaner or the handheld vacuum cleaner combination or the stick vacuum cleaner in all the foregoing embodiments of the present invention is a vacuum cleaner for use in both a wet scenario and a dry scenario. That is, the vacuum cleaner can suck liquids such as water, and waterproof filters or other waterproof structures are disposed in the handheld vacuum cleaner, thereby preventing moisture from directly contacting electrical parts, to implement the use of the vacuum cleaner in both a wet scenario and a dry scenario.

In the handheld vacuum cleaner combination in all the foregoing embodiments of the present invention, the handheld vacuum cleaner has a working state in which the dust cup cover is open and a non-working state in which the dust cup cover is closed. That is, when the dust bin is used to collect dust, the handheld vacuum cleaner is in the working state, and the dust cup cover is open. When the dust bin is used for storage, the handheld vacuum cleaner is in the non-working state, and the dust cup cover is not open in the preferred embodiments, so as to prevent residual dust in the cup body from flying out during storage. Certainly, in other non-preferred embodiments, when the handheld vacuum cleaner is in the non-working state, the dust cup cover may be open. In the foregoing embodiments of the present invention, the position regulator is mainly used to perform adjustment during storage to keep the dust cup cover closed.

The handheld vacuum cleaner or the handheld vacuum cleaner combination or the stick vacuum cleaner in all the foregoing embodiments of the present invention includes the filter apparatus. When the filter apparatus is a cyclonic separation structure, the cyclonic separation structure may be a one-stage cyclone or a multi-stage cyclone. In the solution in which the handheld vacuum cleaner uses the cyclonic separation and that is shown in the accompanying drawings of the present invention, the cyclonic separation structure is a one-stage cyclonic separation structure. In other embodiments of the present invention that are not shown in the accompanying drawings, a multi-stage cyclonic separation structure may be used.

As shown in FIG. 49 to FIG. 52, the horizontal gripping area 43 and the oblique gripping area 44 are disposed in the handle assembly 4, providing two gripping methods in different use scenarios of a separate handheld vacuum cleaner and a handheld stick vacuum cleaner. Such a human-friendly design provides excellent user experience. Specifically, when a user needs to use the handheld vacuum cleaner 100 for vacuuming in the horizontal direction, the horizontal gripping area 43 is closer to the center of gravity of the entire machine, so that the user can grip the horizontal gripping area 43 to reduce the force to be applied. When the user needs to tilt the handheld vacuum cleaner 100 for cleaning, the center of gravity of the handheld vacuum cleaner 100 changes. If the center of gravity changes slightly, the user may freely choose the horizontal gripping area 43 or the oblique gripping area 44 because approximately the same forces are applied. However, if the stick vacuum cleaner is working, the center of gravity changes clearly. In this case, if the user grips the oblique gripping area 44, a small force is applied, and a direction of the oblique gripping area 44 is directly opposite the direction of force application, so that this is a better choice for the working state and is more convenient. A major factor to be considered in choosing a gripping area to be held in the present embodiment is the position of the center of gravity of the entire machine. If the user chooses to grip a gripping area closer to the center of gravity, the user needs to apply a smaller force. For example, if the center of gravity is closer to the horizontal gripping area 43, the user can choose to grip the horizontal gripping area 43. If the center of gravity is closer to the oblique gripping area 44, the user can choose to grip the oblique gripping area 44.

As shown in FIG. 12 and FIG. 43 to FIG. 52, in the stick vacuum cleaner in all the foregoing embodiments in the present invention, the handheld vacuum cleaner in the stick vacuum cleaner may be directly connected to the extension pipe 200 and the cleaner head 300 during actual vacuuming. One end of the extension pipe 200 is connected to the dust suction inlet of the handheld vacuum cleaner. The other end of the extension pipe 200 is connected to the cleaner head 300. The cleaner head 300 is provided with a suction passage (not shown in the figure) in communication with the inside of the extension pipe 200, to allow dust to enter the extension pipe 200 through the suction passage and then enter the handheld vacuum cleaner along the extension pipe 200. That is, when the handheld vacuum cleaner requires the extension pipe 200 to perform vacuuming, the extension pipe 200 may be assembled to the dust suction inlet of the handheld vacuum cleaner. When the handheld vacuum cleaner does not require the extension pipe 200 to perform vacuuming, for example, when the handheld vacuum cleaner requires another accessory such as a slit suction head or a mite suction head to perform vacuuming, the extension pipe 200 may be detached from the dust suction inlet of the handheld vacuum cleaner, and an actually required accessory may be assembled to the dust suction inlet of the handheld vacuum cleaner. An end of the extension pipe 200 is directly detachably connected to the dust suction inlet of the handheld vacuum cleaner. For example, the extension pipe 200 may be mounted on the dust suction inlet or detached from the dust suction inlet by a quick removal buckle structure. Therefore, it is convenient to disassemble and assemble the extension pipe 200.

As shown in FIG. 54 to FIG. 61, a structural diagram of a handheld vacuum cleaner according to another embodiment and a schematic diagram of a dust bin that is combined with the handheld vacuum cleaner are provided in the accompanying drawings. The structure and component layout of the handheld vacuum cleaner in this embodiment are different from those of the handheld vacuum cleaners in the other embodiments described above. The structure of the dust bin is basically the same as that of the dust bin in the first embodiment. Compared with the first embodiment, the guiding structure and the fastening structure that implement combination between the handheld vacuum cleaner and the dust bin are described more clearly in this embodiment. The structures of the handheld vacuum cleaner and the dust bin shown in FIG. 54 to FIG. 61 are described in detail below with reference to the specific accompanying drawings.

Figure 56:
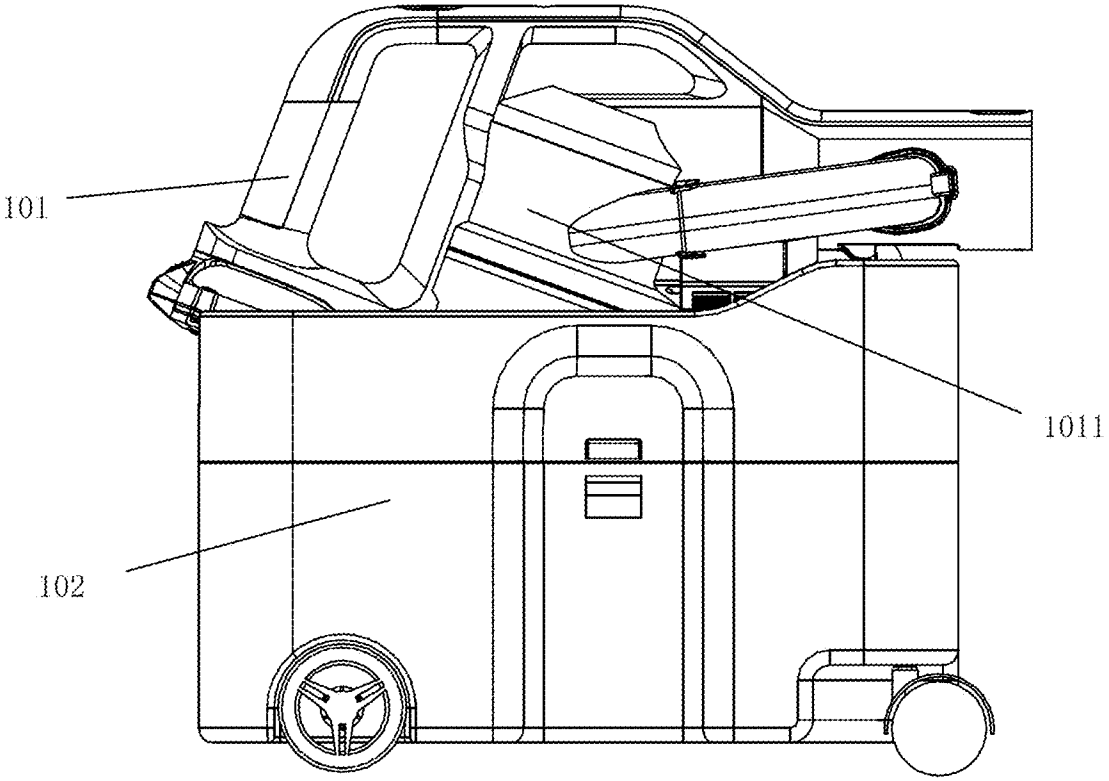
FIG. 56 is a schematic structural diagram of a vacuum cleaner combination according to another embodiment of the present invention.
Figure 57:
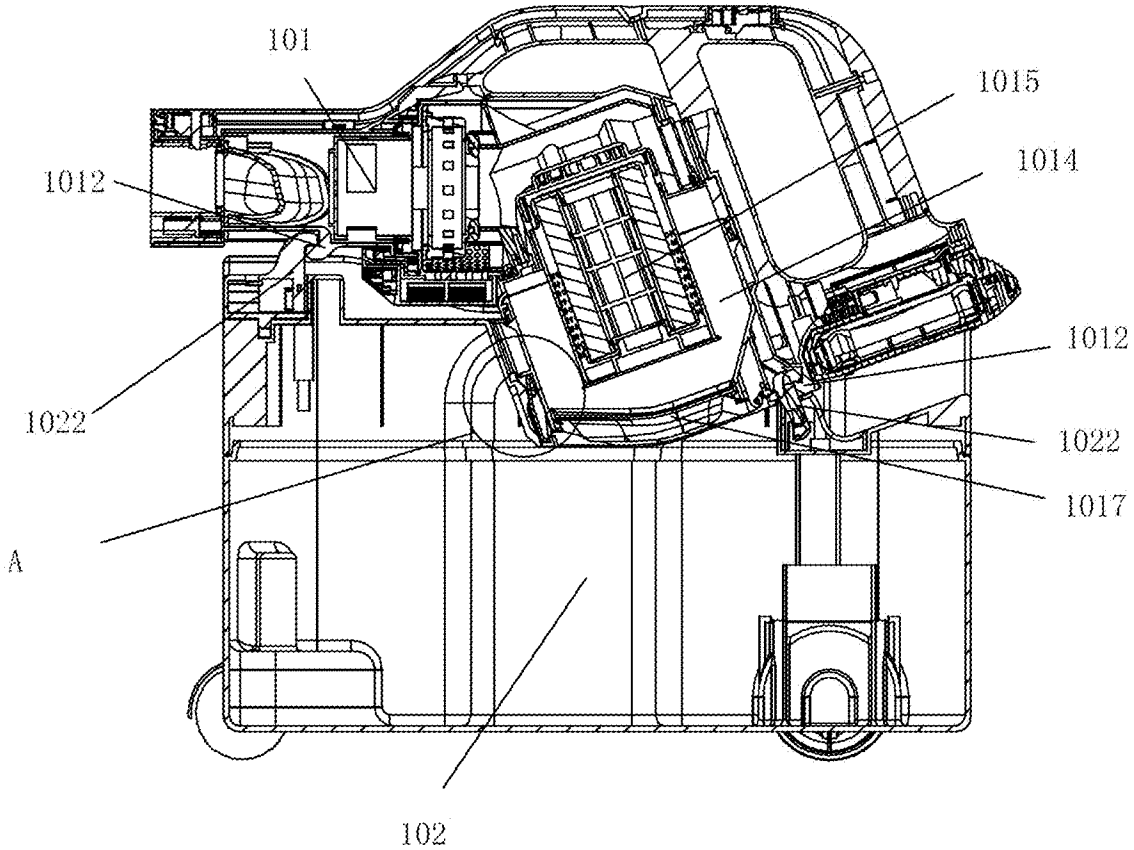
FIG. 57 is a sectional view of the vacuum cleaner combination in FIG. 56, where a cup bottom cover is closed.
Figure 58:
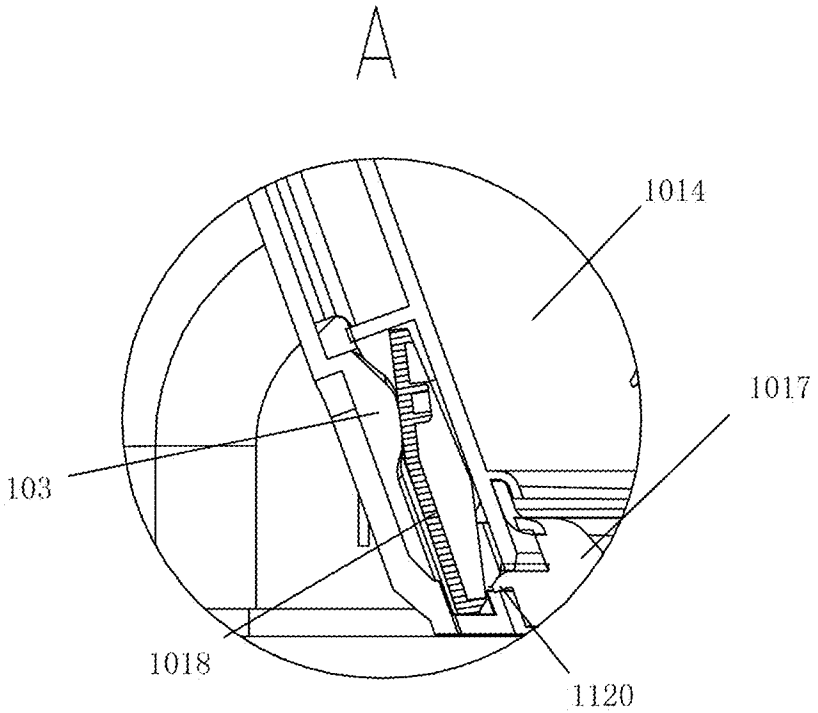
FIG. 58 is an enlarged view of a part A in FIG. 57.
Figure 59:
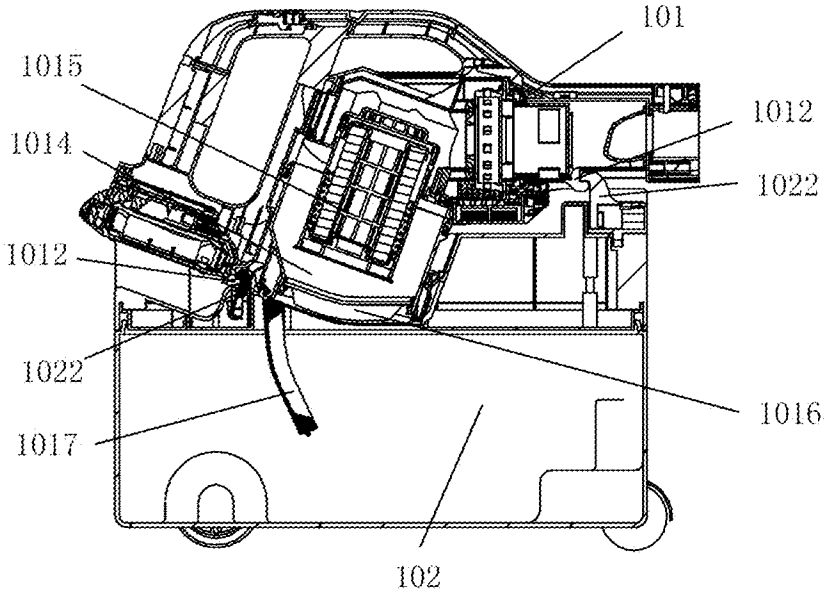
FIG. 59 is a sectional view of the vacuum cleaner combination in FIG. 56, where a cup bottom cover is open.
Figure 60:
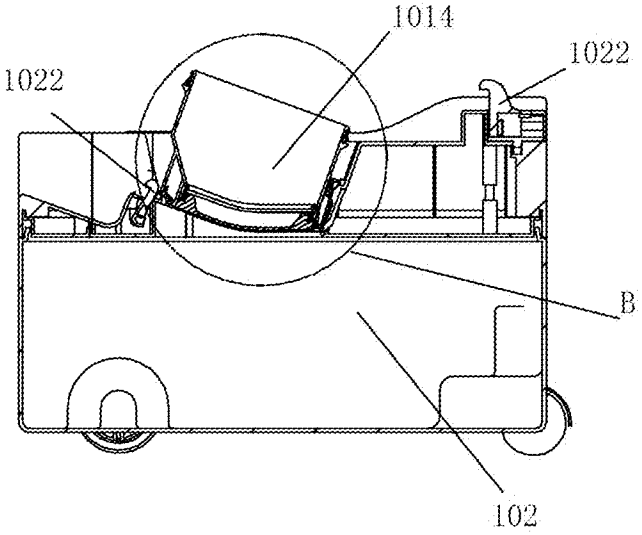
FIG. 60 is a sectional view showing that a dust cup assembly in the vacuum cleaner combination in FIG. 56 is assembled on the dust bin.
Figure 61:
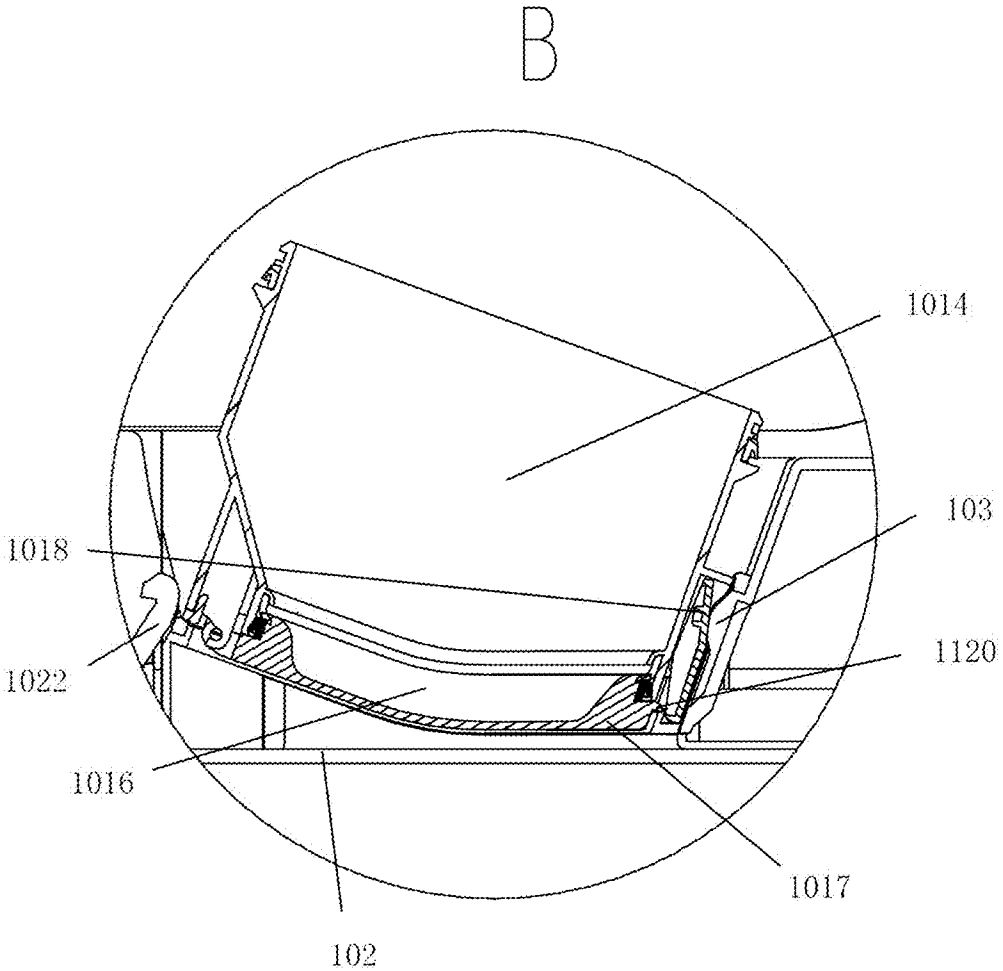
FIG. 61 is an enlarged view of a part B in FIG. 60.

As shown in FIG. 56 and FIG. 57, the vacuum cleaner combination claimed in the present embodiment includes a handheld vacuum cleaner 101 and a dust bin 102 that is detachably combined with the handheld vacuum cleaner 101. As a result, when the vacuum cleaner combination is working, the handheld vacuum cleaner 101 may be separately used as a blower or separately used as a vacuum cleaner. Alternatively, the handheld vacuum cleaner 101 may be combined with the dust bin 102 for use as a vacuum cleaner.

Figure 54:
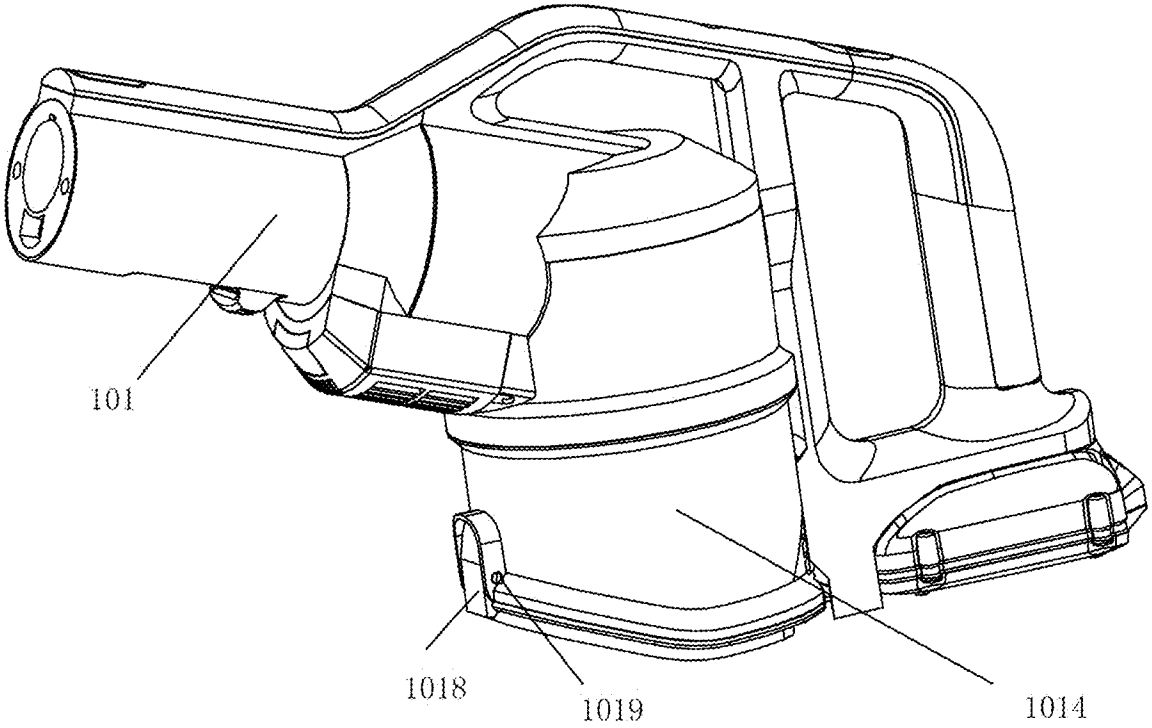
FIG. 54 is a schematic structural diagram of a handheld vacuum cleaner according to another embodiment of the present invention.

Referring to FIG. 54, the handheld vacuum cleaner 101 is provided with a dust cup assembly 1011 for collecting objects sucked in when the handheld vacuum cleaner 101 is working. The dust cup assembly 1011 protrudes downward relative to the handheld vacuum cleaner 101, so that when the handheld vacuum cleaner 101 is separately used, the dust cup assembly 1011 may be used to collect objects, for example, garbage and dust, sucked in by the handheld vacuum cleaner 101. Therefore, the handheld vacuum cleaner 101 can be used separately as a vacuum cleaner.

The top of the dust bin 102 is provided with a dust inlet 1021 for matching the dust cup assembly 1011. When the handheld vacuum cleaner 101 is assembled with the dust bin 102, the dust cup assembly 1011 is partially inserted into the dust inlet 1021, and a buckle structure is used to fasten the dust cup assembly 1011.

Specifically, the top of the dust bin 102 is provided with two fastening structures. The handheld vacuum cleaner 101 is provided with two positioning buckles 1012 for matching the two fastening structures on the dust bin 102. When the handheld vacuum cleaner 101 is joined to the dust bin 102, the dust cup assembly 1011 is inserted into the dust inlet 1021 and rotates around the dust inlet 1021 at a particular angle, to enable the two positioning buckles 1012 on the handheld vacuum cleaner 101 to be buckled with and combined with the two fastening structures on the dust bin 102. The two fastening structures on the top of the dust bin 102 are preferably clamping hooks 1022 for matching the two positioning buckles 1012 on the handheld vacuum cleaner 101.

In this embodiment, each of two outer sides of the dust inlet 1021 of the dust bin 102 is provided with a trench area 1023. The two clamping hooks 1022 are respectively disposed in the two trench areas 1023 of the dust bin 102. Further, the two trench areas 1023 are disposed in a length direction of the dust bin 102, and the two trench areas 1023 have different trench depths, so that when the handheld vacuum cleaner 101 is assembled with the dust bin 102, the trench area 1023 on the dust bin 102 may be used as a joint guide, thereby making it convenient to combine the handheld vacuum cleaner 101 and the dust bin 102. It needs to be noted that the handheld vacuum cleaner 101 in the vacuum cleaner combination in this embodiment may be detached from the dust bin 102 and used separately, so that the positioning buckles 1012 that are combined with the clamping hooks 1022 on the dust bin 102 are disposed on the handheld vacuum cleaner 101 in this embodiment. According to the structural characteristics of the handheld vacuum cleaner 101, the positioning buckles 1012 may be specifically convex extension structures of the handheld vacuum cleaner 101 and respectively disposed on two sides of the handheld vacuum cleaner 101. The two positioning buckles 1012 may have different bending angles and orientations. The two clamping hooks 1022 on the dust bin 102 are specifically disposed to be combined with the two positioning buckles 1012 on the handheld vacuum cleaner 101.

It can be understood that, it is convenient to disassemble and assemble the handheld vacuum cleaner 101 and the dust bin 102 with the foregoing structures, so that people can easily switch between the two modes of the overall vacuum cleaner combination.

It can be understood that, it is convenient to disassemble and assemble the handheld vacuum cleaner 101 and the dust bin 102 with the foregoing structures, so that people can easily switch between the two modes of the overall vacuum cleaner combination.

Figure 55:
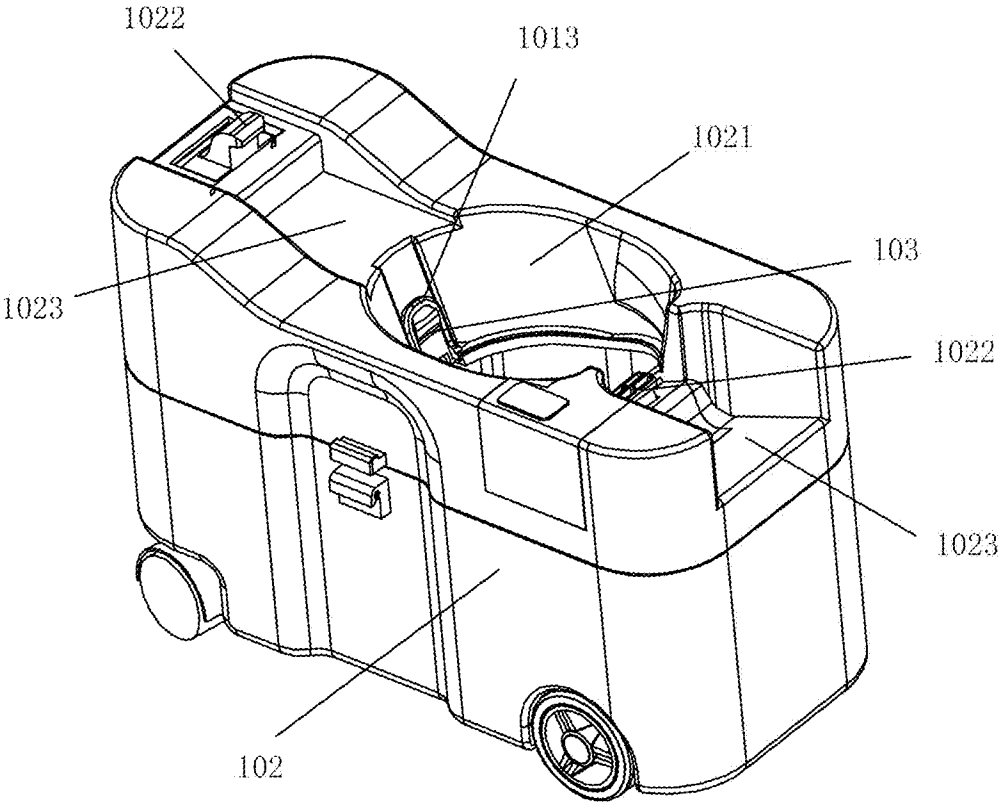
FIG. 55 is a schematic structural diagram of a dust bin combined with the handheld vacuum cleaner in FIG. 54 according to the present invention.

Referring to FIG. 55, the dust inlet 1021 on the dust bin 102 in this embodiment is recessed inward relative to the dust bin 102, and is in communication with the dust chamber (not shown in the figure) formed inward in the dust bin 102. In this way, when the handheld vacuum cleaner 101 is assembled on the dust bin 102, the handheld vacuum cleaner 101 can be in communication with the dust bin 102 through the dust inlet 1021 on the dust bin 102. Therefore, the dust bin 102 can collect dust sucked in when the handheld vacuum cleaner 101 is working.

In this embodiment, when the handheld vacuum cleaner 101 is assembled with the dust bin 102, a portion, extending into the dust inlet 1021, of the dust cup assembly 1011 is disposed in contact with the dust inlet 1021.

Further, a first sealing member 1013 is disposed between the dust cup assembly 1011 of the handheld vacuum cleaner 101 and the dust inlet 1021 of the dust bin 102, and is used for sealing the dust cup assembly 1011 and the dust bin 102, to prevent dust from scattering when the handheld vacuum cleaner 101 and the dust bin 102 on the vacuum cleaner combination are detached and assembled.

Specifically, the first sealing member 1013 is disposed on the dust inlet 1021 of the dust bin 102. When the handheld vacuum cleaner 101 is joined to the dust bin 102, the first sealing member 1013 is disposed in close contact with the peripheral wall of the dust cup assembly 1011. In this way, the dust cup assembly 1011 is airtightly connected to the dust inlet 1021.

As shown in FIG. 58 to FIG. 61, the dust cup assembly 1011 includes a cup body 1014 fastened on the handheld vacuum cleaner 101 and a filter apparatus 1015 disposed in the cup body 1014. The cup body 1014 includes a dust outlet 1016. The dust outlet 1016 is located opposite and combined with the dust inlet 1021 on the dust bin 102. That is, when the handheld vacuum cleaner 101 is assembled with the dust bin 102. The dust outlet 1016 on the cup body 1014 is in communication with the dust inlet on the dust bin 102. An outermost ring of the dust outlet 1016 on the cup body 1014 is combined with the first sealing member 1013 on the dust bin 102 to form sealing. In this way, the dust cup assembly 1011 is airtightly connected to the dust inlet 1021.

The cup body 1014 has a dust cover 1017 for sealing the dust outlet 1016 and a second sealing member (not shown in the figure) for implementing the sealing between the dust outlet 1016 and the dust cover 1017. That is, when the dust cover 1017 is assembled on the dust outlet 1016, specifically, the second sealing member on the dust cover 1017 is in close contact with the peripheral wall of the dust outlet 1016, so that the dust cover 1017 seals the dust outlet 1016. Moreover, when the handheld vacuum cleaner 101 is assembled with the dust bin 102, the dust cover 1017 and the second sealing member are located in the first sealing member 1013.

One side of the dust cover 1017 is hingedly connected to the cup body 1014. The other side of the dust cover 1017 is provided with a hook 1120. The cup body 1014 is provided with a latching portion 1018. When the dust cover 1017 seals the dust outlet 1016, the hook 1120 of the dust cover 1017 is locked with the latching portion 1018 on the cup body 1014. That is, the dust cover 1017 of the dust cup assembly 1011 on the handheld vacuum cleaner 101 in this embodiment may open relative to the dust outlet 1016 of the cup body 1014.

The latching portion 1018 is disposed on the cup body 1014 through a pin 1019, and can rotate around the pin 1019 on the cup body 1014. The latching portion 1018 may be driven to rotate around the pin 1019 to detach from the hook 1120 of the dust cover 1017, so that the dust cover 1017 can open relative to the dust outlet 1016.

To this end, the dust inlet 1021 of the dust bin 102 in this embodiment is provided with an abutting portion 103. When the handheld vacuum cleaner 101 is assembled on the dust bin 102, the abutting portion 103 on the dust inlet 1021 abuts against the latching portion 1018 and drives the latching portion 1018 to rotate around the pin 1019, to enable the latching portion 1018 to detach from the hook 1120 on the dust cover 1017, so that the dust cover 1017 opens from the dust outlet 1016 of the cup body 1014. That is, in this embodiment, when the handheld vacuum cleaner 101 is assembled on the dust bin 102, the abutting portion 103 on the dust inlet 1021 of the dust bin 102 may act on the latching portion 1018 of the dust cup assembly 1011 on the handheld vacuum cleaner 101, to enable the dust cover 1017 on the dust cup assembly 1011 to open from the dust outlet 1016, so that the dust cover 1017 on the dust cup assembly 1011 can automatically open.

The abutting portion 103 on the dust inlet 1021 of the dust bin 102 is specifically disposed in the first sealing member 1013, so that the dust cover 1017 of the dust cup assembly 1011 automatically opens based on the dust cup assembly 1011 being sealed with the dust inlet 1021, thereby ensuring the strict sealing between the handheld vacuum cleaner 101 and the dust bin 102 when the handheld vacuum cleaner 101 is joined to the dust bin 102, to prevent dust from scattering.

In this embodiment, the top contour of the dust bin 102 and the bottom contour of the handheld vacuum cleaner 101 are disposed to match each other, so that the handheld vacuum cleaner 101 and the dust bin 102 are integrally formed after the handheld vacuum cleaner 101 is assembled on the dust bin 102, and it is ensured that the handheld vacuum cleaner 101 and the dust bin 102 are mounted or detached smoothly without interference.

In summary, in the vacuum cleaner combination provided in the present embodiment, the dust cup assembly is disposed on the handheld vacuum cleaner, so that when the handheld vacuum cleaner is used separately, the dust cup assembly may be used to collect garbage sucked in by the handheld vacuum cleaner. Therefore, the handheld vacuum cleaner may be used as a blower or may be separately used as a vacuum cleaner. In addition, when the handheld vacuum cleaner is joined to the dust bin, the dust cup assembly is at least partially located below an upper surface of the dust bin and is in communication with the dust bin, thereby preventing dust from scattering when the handheld vacuum cleaner is detached from or mounted on the dust bin.

As shown in FIG. 62 to FIG. 68, instead of observation from outside, a method for monitoring the amount of collected objects in a dust bin is provided to avoid a misjudgment when a transparent window for observation is blocked or stained. The structure of the dust bin is the same as that of the dust bin in the first embodiment.

The technical solution of the present application is described in detail below by using a vacuum cleaner (vacuum cleaner combination) provided with a dust collection bin (dust bin) as an example. This embodiment is only used as an example for description, and does not limit the technical scope of the present application. Furthermore, in the drawings of the embodiments, unnecessary components are also omitted to clearly show the technical features of the present application. It can be understood that, in some other embodiments, the vacuum cleaner combination may be another device for recycling, for example, a blower-vacuum with a suction function. This is not limited herein.

Figure 62:
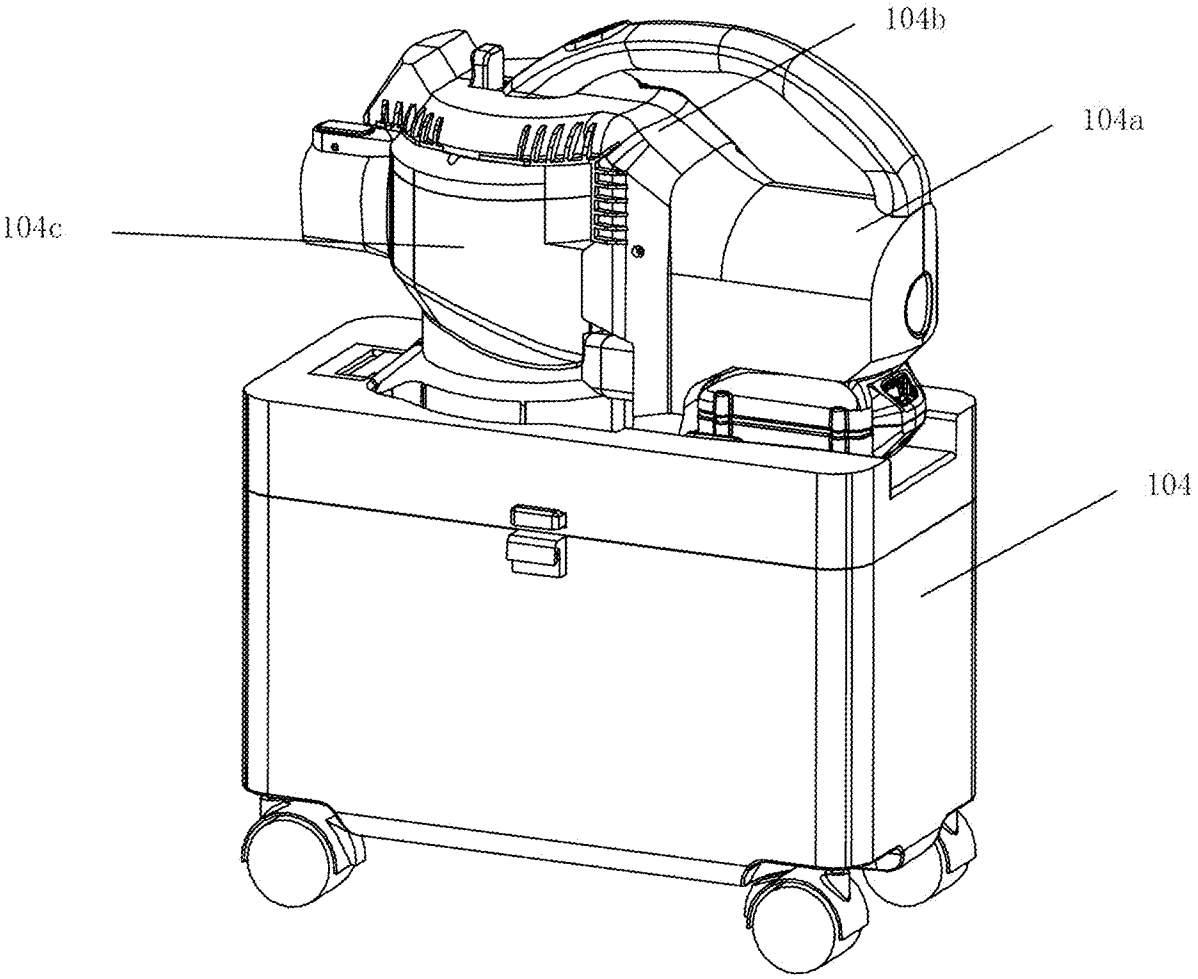
FIG. 62 is a schematic structural diagram of the vacuum cleaner combination according to the first embodiment of the present invention.
Figure 63:
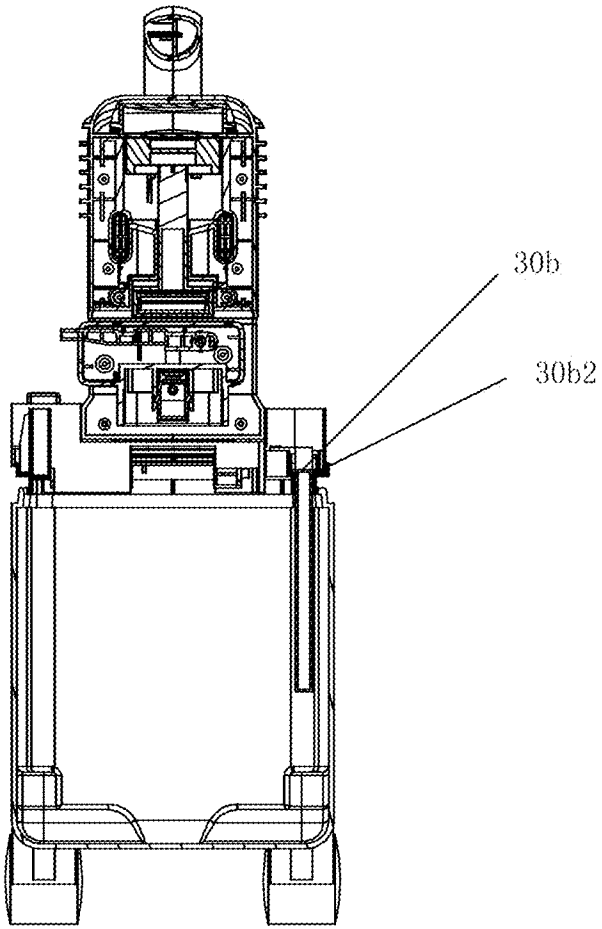
FIG. 63 is a sectional view of FIG. 62 from another angle.
Figure 64:
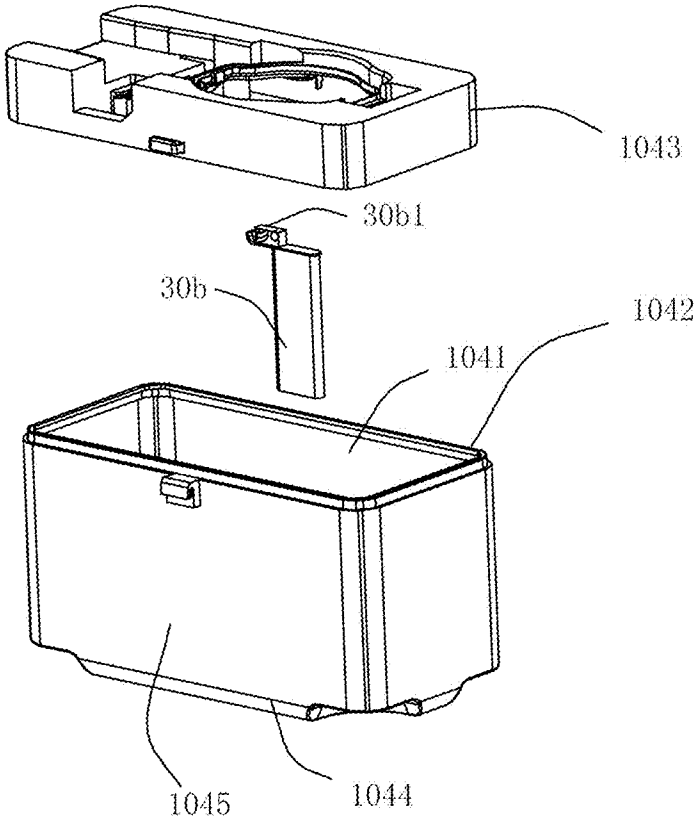
FIG. 64 is a schematic structural diagram of a dust bin in the vacuum cleaner combination in FIG. 62 in an embodiment.

As shown in FIG. 62 to FIG. 64, the vacuum cleaner combination in the first embodiment of the present invention includes a dust bin 104 and a dust suction apparatus 104A detachably joined to the dust bin 104. The dust bin 104 includes a dust chamber 1041 and a float member 30B floatingly disposed in the dust chamber 1041, and the dust suction apparatus 104A includes a housing 104B, a dust cup assembly 104C connected to the housing 104B, and a driving member. The driving member is disposed inside the housing 104B.

The driving member is used to provide the dust suction apparatus 104A with a collection driving force. A liquid collected by the dust suction apparatus 104A is temporarily stored in the dust bin 104. Since the vacuum cleaner combination may be used as a vacuum cleaner for use in both a wet scenario and a dry scenario, dust may be dust with the properties of a liquid. When the present invention is applied to wet treatment (for example, water absorption), the float member 30B may be floatingly disposed in the dust chamber 1041 according to the change in the volume of the liquid. That is, as the level of the liquid rises, the float member 30B moves in a direction in which the liquid moves. When the liquid stored in the dust bin 104 reaches a preset level, a trigger signal is generated, and a corresponding trigger operation is performed, thereby ensuring the normal use of the vacuum cleaner combination.

The preset level mentioned above is the maximum allowable level of the stored liquid in the dust collecting room 1041. The level of the stored liquid changes along with the volume of the liquid. The level of the stored liquid is the height of the surface (hereinafter referred to as a storage surface) of the liquid that is far from the bottom of the dust chamber 1041 relative to the bottom of the dust chamber. The storage surface of the liquid is a flat surface rather than an "A"-shaped surface. In this way, an actual level of the liquid can be accurately reflected. In addition, an end of the float member 30B is located on the storage surface of the liquid and floats in real time as the height of the storage surface of the liquid changes, so that when the storage surface of the liquid reaches the preset level, the end, located on the storage surface, of the float member 30B also reaches the preset level, thereby reflecting a current level of the liquid in real time.

Specifically, the dust bin 104 is usually a hollow structure, which includes a base portion 1042 and a top portion 1043 detachably assembled on the base portion 1042. The base portion 1042 includes a bottom wall 1044 and side walls 1045 formed by the outer edge around the bottom wall 1044 protruding in a same direction. The base portion 1042 is a hollow structure that has the bottom wall 1044 and is open at an end. The top portion 1043 detachably covers the open end of in the base portion 1042 to define the dust chamber 1041 together with the base portion 1042. In addition, when the liquid reaches the preset level, a user may open the top portion 1043 to remove the liquid in the base portion 1042 in time.

In addition, to enhance the firmness of the combination between the base portion 1042 and the top portion 1043, the dust bin 104 further includes a buckle structure (not shown in the figure) disposed between the base portion 1042 and the top portion 1043. The base portion 1042 and the top portion 1043 are fastened and detached by the buckle structure.

The dust cup assembly 104C includes a cup body for temporarily storing a liquid and a filter apparatus disposed in the cup body. The dust bin 104 includes a dust inlet that is in communication with the dust chamber 1041 and is used for receiving garbage passing through the dust suction apparatus 104A. The cup body is airtightly joined to the dust inlet. Therefore, the dust bin 104 may be combined with the dust suction apparatus 104A to form the vacuum cleaner combination. The dust suction apparatus has a first dust collection capacity. The dust bin has a second dust collection capacity. A dust collection capacity of the vacuum cleaner combination is the sum of the first dust collection capacity and the second dust collection capacity. That is, if the dust collection capacity of the dust suction apparatus 104A is A and the dust collection capacity of the dust bin 104 is B, the dust collection capacity of the vacuum cleaner combination is A+B.

In addition, when the dust bin 104 is joined to the dust suction apparatus 104A, dust in a dusty air flow sucked in by the dust suction apparatus 104A falls into the dust bin 104, and a part of the dusty air flow is discharged after being filtered by the filter apparatus.

The float member 30B is a hollow structure with a particular height and a light weight, and sensitively changes as the level of the stored liquid changes. The float member 30B is disposed in the base portion 1042. There is a spacing between the float member 30B and the bottom wall 1044 of the base portion 1042. When the liquid lowers on the bottom wall 1044 and is stored at a particular height, the liquid at the particular level is in contact with the float member 30B. As the liquid continues to be stored, the float member 30B is synchronously raised due to the buoyancy of the liquid. In this specific embodiment, the float member 30B is a hollow and strip-shaped plastic member. The plastic member has a light weight and a particular hardness, so that the float member 30B does not move around under the action of suction. It can be understood that, in some other embodiments, the float member 30B may be made of another lightweight material such as foam. This is not limited herein.

Figure 65:
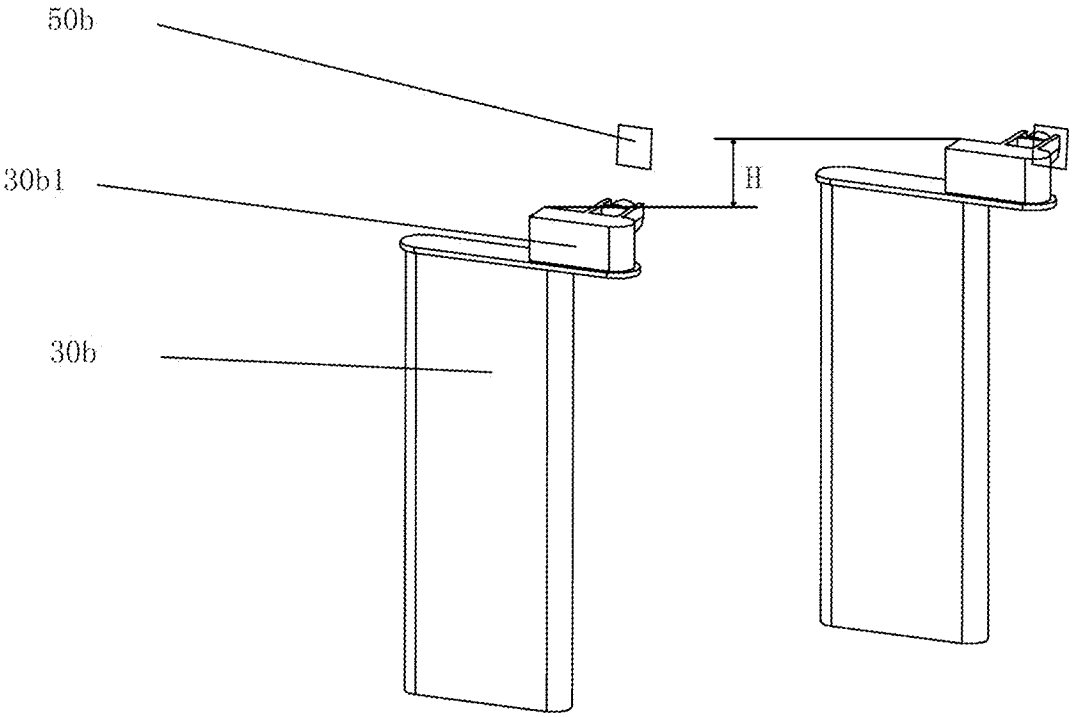
FIG. 65 is a schematic diagram of comparison before and after triggering in FIG. 63.

Referring to FIG. 65, the vacuum cleaner combination includes a joint member 50B3 and a control element (not shown in the figure) in communication with the joint member. Both the joint member and the control element are disposed on the dust suction apparatus 104A. The joint member 50B3 and the float member 30B constitute a switch assembly. The switch assembly is configured to generate a trigger signal when the float member 30B reaches the preset level (as shown in FIG. 65). The control element performs a corresponding action according to the trigger signal. FIG. 65 shows changes in a height H before and after the trigger. If the joint member 50B3 and the control element are non-contact sensors, as the float member 30B moves, information is triggered when sensing intensity reaches a preset trigger threshold. FIG. 65 shows changes in the height H before and after the movement.

The switch assembly constituted by the float member 30B and the joint member 50B3 may be triggered in a non-contact manner or a contact manner.

In the non-contact manner, one of the float member 30B and the joint member 50B3 in the switch assembly is a sensing member, and the other is a sensed member. When the float member 30B reaches the preset level, the sensing member senses the sensed member and generates the trigger signal.

Specifically, the float member 30B and the joint member 50B3 constitute a magnetic induction switch. That is, one of the float member 30B and the joint member 50B3 is a magnet, and the other is a magnetic sensor. When the vacuum cleaner combination is used to suck wastewater. The wastewater is collected at the bottom of the dust chamber 1041 and gradually rises. The float member 30B moves to the top portion 1043 under the action of buoyancy. When the magnet moves into the sensing range of the magnetic sensor, the magnetic sensor detects the magnet, and a trigger signal is generated. According to the trigger signal, the control element sends an alarm signal and/or controls the driving member to stop driving.

In this specific embodiment, the float member 30B is a magnetic member, and the joint member 50B3 is a magnetic sensor that generates an induced magnetic field. It can be understood that, in some other embodiments, the float member 30B may be a magnetic sensor and the joint member 50B3 may be a magnetic member. This is not limited herein. Non-contact sensors may be alternatively ultrasonic sensors, optical sensors or other sensor devices that can achieve signal interfacing. When the float member 30B and the joint member 50B3 are ultrasonic sensors, one is an ultrasonic transmitter and the other is an ultrasonic receiver. When the float member 30B and the joint member 50B3 are optical sensors, one is an optical transmitter and the other is an optical receiver.

Contact manner: One of the float member 30B and the joint member 50B3 in the switch assembly is a triggering member, and the other is a triggered member. When the float member 30B reaches the preset level, the triggering member contacts the triggered member and generates the trigger signal.

In an embodiment, one of the float member 30B and the joint member 50B3 is a trigger, and the other is a trigger switch. When the vacuum cleaner combination is used to suck wastewater, the wastewater is collected at the bottom of the dust chamber 1041 and gradually rises. The float member 30B moves to the top portion 1043 under the action of buoyancy. When the trigger triggers the trigger switch, a trigger signal is generated. According to the trigger signal, the control element sends an alarm signal and/or controls the driving member to stop driving.

In another embodiment, a circuit implementation is used. One of the float member 30B and the joint member 50B3 is a first electric connection terminal, and the other is a second electric connection terminal. When the vacuum cleaner combination is used to suck wastewater, the wastewater is collected at the bottom of the dust chamber 1041 and gradually rises. The float member 30B moves to the top portion 1043 under the action of buoyancy. When the first electric connection terminal is in contact with the second electric connection terminal, a trigger signal is generated. According to the trigger signal, the control element sends an alarm signal and/or controls the driving member to stop driving. The alarm signal includes sound information and/or warning light information. In addition, the control element may directly send a prompt message or may communicate with a user's mobile device carried by the user and remind the user by using the mobile device. This is not limited herein.

In the foregoing embodiments, in one manner, the float member 30B is floatingly disposed on the top portion 1043 in a direction in which the liquid rises, and the joint member 50B3 is disposed on the dust suction apparatus 104A and located above the float member 30B. In addition, one end of the float member 30B protrudes from the top portion 1043, so that when the top portion 1043 covers the base portion 1042, this end can project into the base portion 1042 to be combined with the storage surface of the liquid. A distance between the other end of the float member 30B and the joint member 50B3 remains the same as the preset level, so that when the end of the float member 30B that projects into the base portion 1042 reaches the preset level, the end of the float member 30B that is located on the top portion 1043 and the joint member 50B3 generate magnetic induction.

In another manner, the float member 30B is disposed on the base portion 1042. The joint member 50B3 is disposed on the dust suction apparatus 104A and located above the float member 30B. The float member 30B and the joint member 50B3 can generate magnetic induction when the float member reaches the preset level. This is not limited herein.

As shown in FIG. 64, in this specific embodiment, the float member 30B does not have a sensing function, but instead is provided with a sensing element 30B1 that senses with the joint member 50B3. It can be understood that, in some other embodiments, the sensing element 30B1 may be omitted, and the float member 30B has a sensing function. This is not limited herein.

As shown in FIG. 63, the dust bin 104 is provided with a limiting member 30B2. The limiting member 30B2 has a receiving space that can receive the float member 30B. The float member 30B is combined with the limiting member 30B2. In the embodiments in the accompanying drawings, the float member 30B is supported by the limiting member 30B2 when the float member 30B does not float with the liquid, to prevent the float member 30B from tilting or falling. When the float member 30B rises with the liquid, the limiting member 30B2 does not support the float member 30B, but the float member 30B is still limited to move in the receiving space of the limiting member 30B2, thereby ensuring that the float member 30B floats along a determined track and in an expected direction and the trigger signal is accurately triggered.

Figure 66:
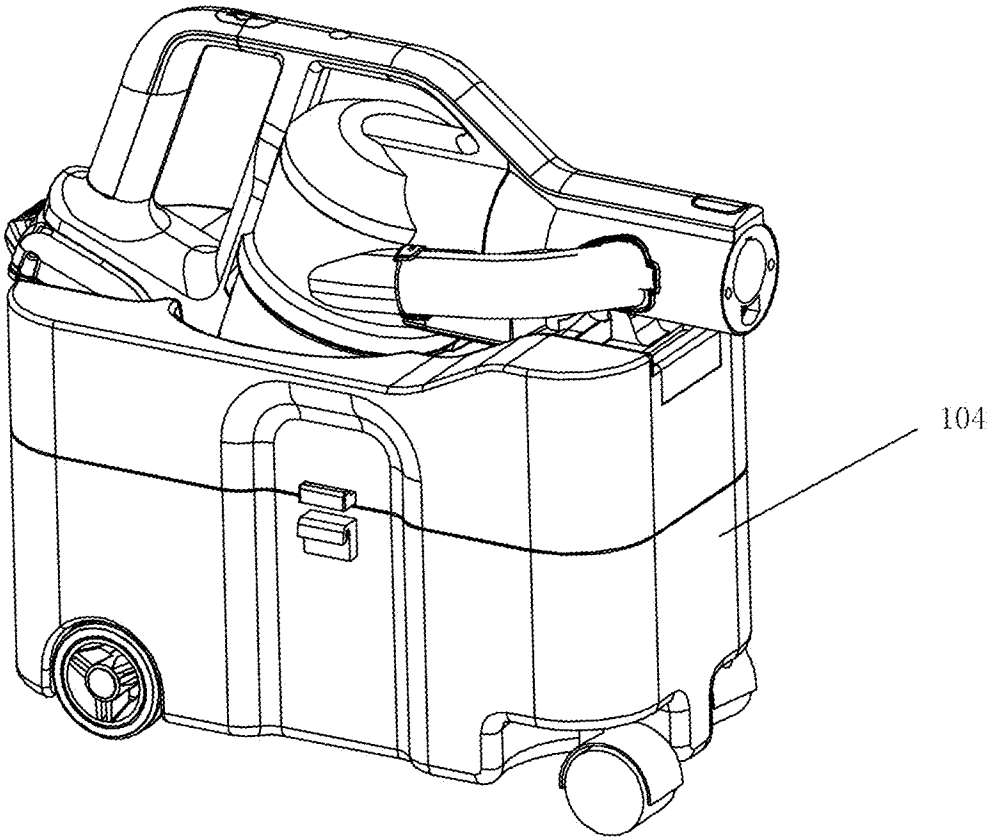
FIG. 66 is a schematic structural diagram of the vacuum cleaner combination according to the second embodiment of the present invention.

As shown in FIG. 66, a difference between the vacuum cleaner combination in the second embodiment of the present invention and the vacuum cleaner combination in the first embodiment is that the structures of trigger signals are different, and the specific description is as follows.

Figure 67:
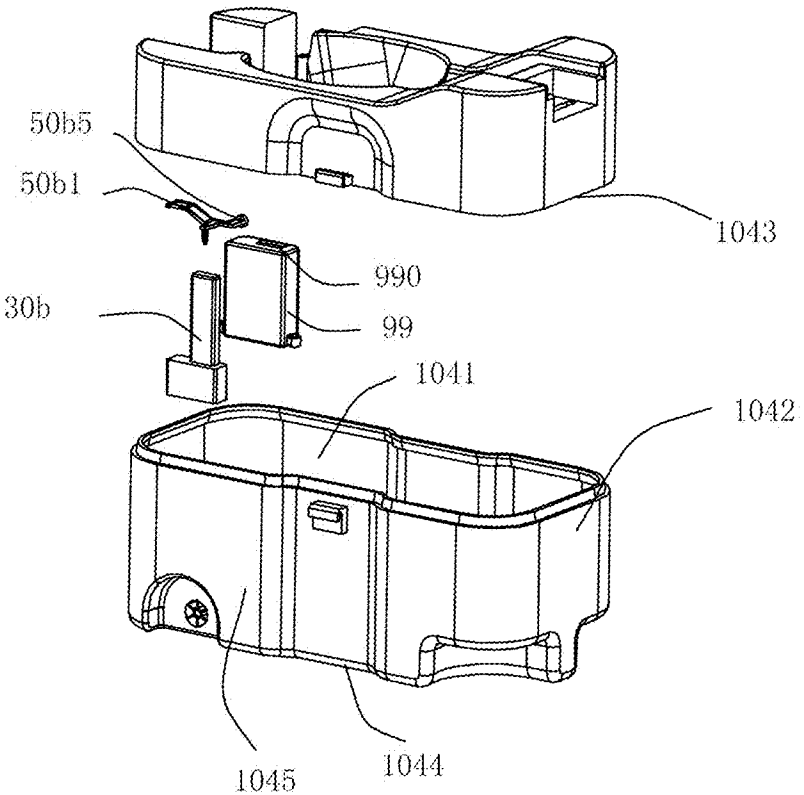
FIG. 67 is a schematic structural diagram of a dust bin in the vacuum cleaner combination in FIG. 66 in another embodiment.
Figure 68:
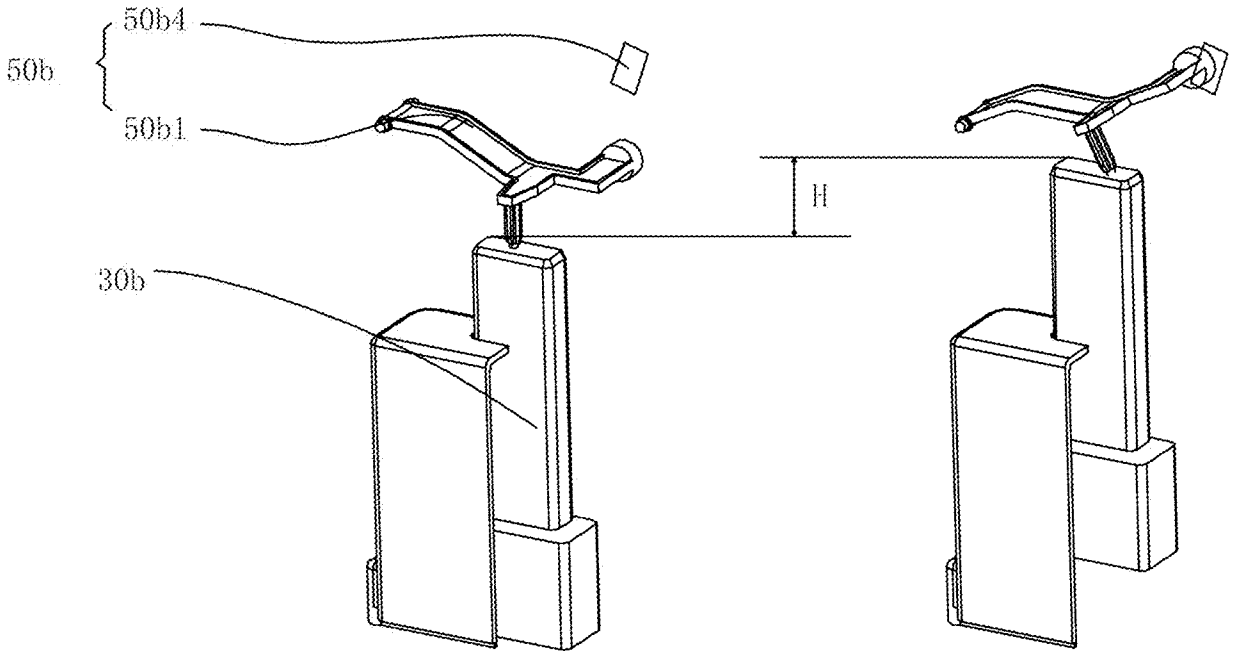
FIG. 68 is a schematic diagram of comparison before and after triggering in FIG. 66.

Referring to FIG. 67 and FIG. 68, in another embodiment, the vacuum cleaner combination includes a switch assembly 50B and a control element (not shown in the figure) disposed on the dust suction apparatus 104A. The switch assembly 50B is configured to generate a trigger signal when the float member 30B reaches a preset level. The control element performs a corresponding action according to the trigger signal. That is, the float member 30B is merely a driving member for driving the switch assembly 50B to be triggered, instead of being directly used as the switch assembly 50B to be directly triggered.

The switch assembly 50B includes a middle member 50B1 disposed in the dust bin 104 and a joint member 50B4 disposed on the dust suction apparatus 104A. The middle member 50B1 is movably disposed between the float member 30B and the joint member 50B4 and is driven by the float member 30B. The float member 30B drives the middle member 501 to move to make a successful trigger with the joint member 50B4 when the float member 30B reaches the preset level (as shown in FIG. 68). FIG. 68 shows states before and after the trigger. FIG. 68 shows changes in a height H before and after the trigger. If the middle member 501 and the joint member 50B4 are non-contact sensors, as the float member 30B moves, information is triggered when sensing intensity reaches a preset trigger threshold. In this specific embodiment, the float member 30B is disposed in the base portion 1042, and the middle member 501 is disposed on the top portion 1043, so that the float member 30B drives the middle member 501 located on the top portion 1043 to trigger the joint member 50B4 disposed on the dust suction apparatus 104A when the float member 30B reaches the preset level.

In this specific embodiment, the middle member 50B1 is rotatably disposed on the top portion 1043 around a rotating axis, and blocks the floating path on which the float member 30B reaches the preset level in a direction in which the liquid rises. In this way, when the float member 30B rises with the storage surface, the float member 30B pushes the middle member 50B1 to rotate around the rotating axis in a direction away from the float member 30B. The middle member 50B1 rotates to an appropriate position as soon as the float member 30B reaches the preset level to trigger the joint member 50B4 on the dust suction apparatus 104A, to enable the joint member 50B4 to generate a trigger signal.

The rotating axis of the middle member 50B1 is perpendicular to the direction in which the liquid rises, and the middle member 50B1 is placed above the floating path in a direction perpendicular to the direction in which the liquid rises, so that the middle member 50B1 rotates from the direction that is perpendicular to the direction in which the liquid rises to the direction away from the float member 30B under the push of the float member 30B and triggers the joint member 50B4.

The switch assembly 50B constituted by the middle member 50B1 and the joint member 50B4 may be triggered in a non-contact manner or a contact manner.

Non-contact manner: One of the middle member 501 and the joint member 50B4 is a sensing member, and the other is a sensed member. When the float member 30B reaches the preset level, the float member 30B drives the middle member 50B1 to rotate to sense with the joint member 50B4, to generate a trigger signal. Specifically, the middle member 501 and the joint member 50B4 constitute a magnetic induction switch. That is, one of the middle member 501 and the joint member 50B4 is a magnet, and the other is a magnetic sensor. When the vacuum cleaner combination is used to suck wastewater, the wastewater is collected at the bottom of the dust chamber 1041 and gradually rises. The float member 30B moves to the top portion 1043 under the action of buoyancy and drives the middle member 50B1 to rotate. When the magnet moves into the sensing range of the magnetic sensor, the magnetic sensor detects the magnet, and a trigger signal is generated. According to the trigger signal, the control element sends an alarm signal and/or controls the driving member to stop driving. The alarm signal includes sound information and/or warning light information. In addition, the control element may directly send a prompt message or may communicate with a user's mobile device carried by the user and remind the user by using the mobile device. This is not limited herein.

In addition, non-contact sensors may be alternatively ultrasonic sensors, optical sensors, or other sensor devices that can achieve signal interfacing. When the middle member 50B1 and the joint member 50B4 are ultrasonic sensors, one is an ultrasonic transmitter and the other is an ultrasonic receiver. When the middle member 50B1 and the joint member 50B4 are optical sensors, one is an optical transmitter and the other is an optical receiver.

In this specific embodiment, the middle member 50B1 is a magnetic member, and the joint member 50B4 is a magnetic sensor that generates an induced magnetic field. It can be understood that, in some other embodiments, the middle member 50B1 may be a magnetic sensor and the joint member 50B4 may be a magnetic member. This is not limited herein.

Contact manner: One of the middle member 50B1 and the joint member 50B4 in the switch assembly 50B is a triggering member, and the other is a triggered member. When the float member 30B reaches the preset level, the triggering member contacts the triggered member to generate the trigger signal.

In an embodiment, one of the middle member 50B1 and the joint member 50B4 is a trigger, and the other is a trigger switch. When the vacuum cleaner combination is used to suck wastewater, the wastewater is collected at the bottom of the dust chamber 1041 and gradually rises. The float member 30B moves to the top portion 1043 under the action of buoyancy and drives the middle member 50B1. When the trigger triggers the trigger switch, a trigger signal is generated. According to the trigger signal, the control element sends an alarm signal and/or controls the driving member to stop driving.

In another embodiment, a circuit implementation is used. One of the middle member 501 and the joint member 50B4 is a first electric connection terminal, and the other is a second electric connection terminal. When the vacuum cleaner combination is used to suck wastewater, the wastewater is collected at the bottom of the dust chamber 1041 and gradually rises. The float member 30B moves to the top portion 1043 under the action of buoyancy and drives the middle member 50B1. When the first electric connection terminal is in contact with the second electric connection terminal, a trigger signal is generated. According to the trigger signal, the control element sends an alarm signal and/or controls the driving member to stop driving.

In the foregoing two embodiments, the switch assembly may be triggered by a switch or a change in a current/voltage parameter. This is not limited herein.

In this specific embodiment, the middle member 50B1 does not have a sensing function, but instead is provided with a sensing element SOBS. It can be understood that, in some other embodiments, the sensing element SOBS may be omitted, and the middle member 50B1 has a sensing function. This is not limited herein.

Referring to FIG. 68, in the foregoing two embodiments, the dust bin 104 further includes a limiting portion 99. The limiting portion 99 extends longitudinally in the direction in which the liquid rises to be joined to the dust bin 104, and the float member 30B is slidably joined to the limiting portion 99 in the direction in which the liquid rises. The limiting portion 99 provides guidance for the float member 30B when the float member 30B floats with the liquid, thereby preventing the float member 30B from shaking under strong suction. Specifically, the limiting portion 99 is disposed on the inner wall of the base portion 1042, and a guide trench 990 is longitudinally opened in the limiting portion 99 in the direction in which the liquid rises. It can be understood that, in some other embodiments, the limiting portion 99 may be disposed on the inner wall of an upper cover 13. This is not limited herein.

In addition, in the foregoing two embodiments, when a liquid in the dust bin 104 needs to be removed, the top portion 1043 needs to be detached from the base portion 1042. When the float member 30B is disposed in the base portion 1042, it can be avoided that the top portion 1043 is unstably placed on the floor after being detached because a part of the float member 30B protrudes from the top portion 1043.

In the dust bin 104 and the vacuum cleaner combination in the present application, the float member 30B rises synchronously with the liquid during the liquid storage process, so as to monitor a current level of the liquid in real time. In addition, when the liquid reaches the preset level, the switch assembly generates a trigger signal, and the control element performs a corresponding action according to the trigger signal (reminds the user to clean up in time or controls the driving member to stop driving). During the whole process, manual observation is not required, and there is no chance that observation fails because a transparent window is blocked, so that a current amount of liquid is more accurately determined.

In the present invention, the dust bin is disposed. In a garage or another area with a large amount of garbage, the dust bin is used to increase the dust collection space. There is usually a large amount of garbage such as wood chips in a garage, and there may be liquid garbage such as water. The present invention can meet dust suction in a dry scenario and a wet scenario, thereby ensuring convenient use. There are a variety of use states, and a plurality of options may be provided.

Compared with the prior art, in the present invention, the detachable multi-purpose dust bin is disposed, so that the structure is simple, and the dust collection chamber of the vacuum cleaner is flexibly increased. In addition, the dust bin can also accommodate the handheld vacuum cleaner, so that the accommodation space is saved, and the accommodation environment is pleasant.

The present invention mainly protects an independent dust bin structure, protects the structure of the handheld vacuum cleaner combination in which the dust bin is combined with the handheld vacuum cleaner, and protects the structure of the stick vacuum cleaner provided with the dust bin and the handheld vacuum cleaner. A structure inside the handheld vacuum cleaner in the present invention is not limited. In the foregoing embodiments of the present invention, the descriptions related to the obliquely disposed filtering apparatus are preferred embodiments of the present invention. To reduce the height and length of the entire machine and provide the vacuum cleaner with a compact structure, a small size, and a light weight, the filtering apparatus is obliquely disposed. As described in the foregoing embodiments, the structure of the filtering apparatus is not limited. The filtering apparatus may be a common filter or may be a cyclone separator having a cyclonic separation effect.

Although only several embodiments of the present invention are described and shown in the specification, a person skilled in the art should easily conceive of other means or structures for performing the functions described herein or obtaining the structures described herein. Any such change or modification is considered to fall within the scope of the present invention.

What is claimed is:

1. A vacuum cleaner combination, comprising:

a dust suction apparatus, the dust suction apparatus having a housing; and a dust cup assembly connected to the housing, and the dust cup assembly comprising:

a dust suction inlet for guiding an external air flow into the dust suction apparatus;

a cup body;

a filter apparatus disposed in the cup body;

a dust outlet disposed on the cup body; and a dust cup cover for sealing the dust outlet, wherein the vacuum cleaner combination further comprises a dust bin that is configured to be joined to the dust suction apparatus, the dust bin comprising a dust chamber and a dust inlet in communication with the dust chamber, and the cup body being joined to the dust inlet, wherein the vacuum cleaner combination is configured to convert between a first working mode and a second working mode;

wherein, in the first working mode, the dust suction apparatus is separated from the dust bin, the filter apparatus of the dust cup assembly filters dust suctioned from the dust suction inlet, and the cup body collects the suctioned dust; and wherein, in the second working mode, the dust suction apparatus is joined to the dust bin, the dust outlet is in communication with the dust inlet, the filter apparatus of the dust cup assembly filters dust suctioned from the dust suction inlet, and the dust bin collects the suctioned dust through the dust outlet and the dust inlet.

2. The vacuum cleaner combination according to claim 1, wherein the dust outlet is airtightly joined to the dust inlet.

3. The vacuum cleaner combination according to claim 2, wherein a first sealing member is disposed between the dust outlet and the dust inlet.

4. The vacuum cleaner combination according to claim 3, wherein the dust cup assembly has a second sealing member that implements mutual sealing between the dust outlet and the dust cup cover, and the first sealing member circumferentially surrounds the second sealing member and the dust cup cover.

5. The vacuum cleaner combination according to claim 4, wherein the dust bin has an abutting portion for controlling the dust cup cover to open.

6. The vacuum cleaner combination according to claim 1, wherein the vacuum cleaner combination comprises a float member disposed in the dust bin and a joint member and a control element that are disposed on the dust suction apparatus, and the float member is floatingly disposed in the dust chamber; the joint member and the float member constitute a switch assembly, and the switch assembly is configured to generate a trigger signal when the float member reaches a preset level; and the control element performs a corresponding action according to the trigger signal.

7. The vacuum cleaner combination according to claim 6, wherein one of the float member and the joint member in the switch assembly is a sensing member, and the other of the float member and the joint member is a sensed member; and when the float member reaches the preset level, the sensing member senses the sensed member to generate the trigger signal.

8. The vacuum cleaner combination according to claim 6, wherein the dust bin comprises a limiting portion, and wherein the float member is joined to the limiting portion and is movable relative to the limiting portion.

9. The vacuum cleaner combination according to claim 6, wherein the dust suction apparatus has a control element, and according to the trigger signal, the control element sends an alarm signal and/or controls the driving member to stop driving.

10. The vacuum cleaner combination according to claim 1, wherein the vacuum cleaner combination comprises a float member disposed in the dust bin, a switch assembly, and a control element disposed on the dust suction apparatus, the float member is floatingly disposed in the dust chamber, the switch assembly is configured to generate a trigger signal when the float member reaches a preset level, and the control element performs a corresponding action according to the trigger signal.

11. The vacuum cleaner combination according to claim 1, wherein the dust suction apparatus has a first dust collection capacity, the dust bin has a second dust collection capacity, and a dust collection capacity of the vacuum cleaner combination is the sum of the first dust collection capacity and the second dust collection capacity.

12. A stick vacuum cleaner, comprising a hollow extension pipe and a cleaner head, wherein the stick vacuum cleaner further comprises the vacuum cleaner combination according to claim 1, the dust suction apparatus in the vacuum cleaner combination is detachably connected to the extension pipe, one end of the extension pipe is in communication with the dust suction inlet of the dust suction apparatus, the other end of the extension pipe is in communication with the cleaner head, and the cleaner head is provided with a suction passage in communication with the inside of the extension pipe.

* * * * *